US007204577B2

(12) United States Patent
Kanamitsu et al.

(10) Patent No.: US 7,204,577 B2
(45) Date of Patent: Apr. 17, 2007

(54) WASTE LIQUID TREATING DEVICE AND LIQUID EJECTING APPARATUS INCORPORATING THE SAME

(75) Inventors: Masatomo Kanamitsu, Fukuoka (JP); Naruhiko Katagiri, Nagano (JP); Hajime Wada, Nagano (JP); Keisuke Haba, Nagano (JP); Midori Araya, Nagano (JP); Masahiro Isono, Nagano (JP); Hikaru Kobayashi, Nagano (JP); Kazuhisa Takeda, Nagano (JP); Kenjiro Ishihara, Nagano (JP); Seiji Tezuka, Fukuoka (JP); Satoshi Kaneta, Nagano (JP); Takashi Sato, Nagano (JP)

(73) Assignee: Seiko Epson Corporaion, Tokyo (JP)

( * ) Notice: Subject to any disclaimer, the term of this patent is extended or adjusted under 35 U.S.C. 154(b) by 251 days.

(21) Appl. No.: 10/857,476

(22) Filed: Jun. 1, 2004

(65) Prior Publication Data

US 2005/0062794 A1 Mar. 24, 2005

Related U.S. Application Data

(63) Continuation-in-part of application No. 10/458,749, filed on Jun. 11, 2003, now Pat. No. 6,910,757.

(30) Foreign Application Priority Data

| | | |
|---|---|---|
| Jun. 11, 2002 | (JP) | P2002-170282 |
| Sep. 19, 2002 | (JP) | P2002-272918 |
| Oct. 22, 2002 | (JP) | P2002-306615 |
| May 29, 2003 | (JP) | P2003-153408 |
| Aug. 19, 2003 | (JP) | P2003-207889 |
| Aug. 28, 2003 | (JP) | P2003-304204 |
| Sep. 18, 2003 | (JP) | P2003-325403 |
| Sep. 25, 2003 | (JP) | P2003-333505 |

(51) Int. Cl.
*B41J 2/165* (2006.01)

(52) U.S. Cl. ..... 347/31; 347/35; 347/36

(58) Field of Classification Search ..... 347/22–35, 347/36; 521/52; 428/310.5
See application file for complete search history.

(56) References Cited

U.S. PATENT DOCUMENTS

| | | | |
|---|---|---|---|
| 6,722,755 | B2 | 4/2004 | Shigeno |
| 6,910,757 | B2 * | 6/2005 | Kanamitsu et al. ..... 347/31 |
| 2002/0033860 | A1 | 3/2002 | Kubota et al. |

FOREIGN PATENT DOCUMENTS

| | | |
|---|---|---|
| EP | 0 995 603 A2 | 4/2000 |

(Continued)

OTHER PUBLICATIONS

Japanese Office Action dated Jan. 25, 2005.

*Primary Examiner*—Shih-Wen Hsieh
(74) *Attorney, Agent, or Firm*—Sughrue Mion, PLLC

(57) ABSTRACT

A liquid ejecting head is operable to move in a first direction. A platen is opposed to the liquid ejecting head to support an object to which a liquid droplet is ejected from the liquid ejecting head and to define a gap between the liquid ejecting head and the object. The platen is formed with a groove hole to which a liquid droplet deviated from an edge of the object is disposed, and through holes formed in a bottom portion of the groove hole and arranged in the first direction. A tray member is arranged below the platen to receive liquid dropped through the through holes. A first liquid absorber is provided in the groove hole. A second liquid absorber is provided in the tray member. At least one liquid leading member extends through at least one of the through holes to lead liquid absorbed by the first liquid absorber to the second liquid absorber.

28 Claims, 54 Drawing Sheets

FOREIGN PATENT DOCUMENTS

| | | | |
|---|---|---|---|
| EP | 1 147 901 | A2 | 10/2001 |
| JP | 4-286655 | A | 10/1992 |
| JP | 7-009712 | A | 1/1995 |
| JP | 9-76530 | A | 3/1997 |
| JP | 10-58705 | A | 3/1998 |
| JP | 10-211706 | A | 8/1998 |
| JP | 2002-103706 | A | 4/2000 |
| JP | 2000-141704 | A | 5/2000 |
| JP | 2000-158678 | A | 6/2000 |
| JP | 2001-301201 | A | 10/2001 |
| JP | 2002-86757 | A | 3/2002 |
| JP | 2002-86821 | A | 3/2002 |
| JP | 2002-225313 | A | 8/2002 |
| JP | 2003-211706 | A | 7/2003 |

* cited by examiner

WASTE LIQUID TREATING DEVICE AND LIQUID EJECTING APPARATUS INCORPORATING THE SAME

CROSS REFERENCE OF THE APPLICATION

This is a continuation-in-part application of U.S. patent application Ser. No. 10/458,749 filed on Jun. 11, 2003 now U.S. Pat. No. 6,910,757.

BACKGROUND OF THE INVENTION

The present invention relates to a liquid ejecting apparatus such as an ink jet recording apparatus which can execute so-called marginless printing by disposing ink away from the end of a target medium. Other than recording apparatuses such as printers, copiers, facsimile machines, the liquid ejecting apparatus includes an apparatus for ejecting liquid, in place of ink, from a liquid ejecting head onto an object on which the ejected liquid is landed.

Examples of the liquid ejecting head include a colorant ejecting head to be used for manufacturing a color filter such as a liquid crystal display, an electrode material (conductive paste) ejecting head to be used in the formation of an electrode such as an organic EL display or a surface emitting display (FED), a biological organic matter ejecting head to be used for manufacturing a biochip and a sample ejecting head to be a precision pipette in addition to the recording head.

An ink jet recording apparatus (hereinafter referred to as a "printer") has an ink jet recording head (hereinafter referred to as a "recording head") for discharging an ink, and a platen provided opposite to the recording head and supporting a sheet from below to define a distance between the recording head and a printing surface. Furthermore, some printers can execute so-called marginless printing to print a sheet without a margin (for example, see Japanese Patent Publication No. 2002-86821A).

In the printer capable of executing the marginless printing, a groove hole is formed on the upper surface of the platen (a platen surface). The groove hole includes a groove hole formed to be extended in a primary scanning direction over the platen surface and a groove hole provided to be localized in a portion positioned on the end of a sheet. For example, when the leading end of the sheet is positioned above the groove hole formed to be extended in the primary scanning direction, ink is also ejected to a region provided out of the leading end so that the marginless printing is carried out at the leading end. In other words, the ink is disposed into the groove hole.

In general, an ink absorber (hereinafter referred to as a "first waste liquid absorber") for absorbing ink is provided in the groove hole. If such a first waste liquid absorber is not provided, there is a possibility that the ink disposed into the groove hole might become an ink mist to deteriorate printing quality or might stick to the driving components of a printer to disturb a normal printing operation.

A plurality of through holes are provided in the bottom portion of the groove hole. The ink disposed into the groove hole is once absorbed into the first waste liquid absorber and is then dropped downward from the through hole. Accordingly, a waste liquid tray for receiving the ink thus dropped is provided under the platen. An ink absorber (hereinafter referred to as a "second waste liquid absorber") for absorbing ink is provided in the waste liquid tray in the same manner as the groove hole. Consequently, the ink stored in the waste liquid tray is reliably held so as not to leak to the outside.

The ink disposed into the groove hole is absorbed by the first waste liquid absorber. The ink thus absorbed is not entirely dropped into the waste liquid tray. More specifically, a part of the ink is dropped from the through hole toward the waste liquid tray and the other part is maintained in the lower part of the first waste liquid absorber according to the ink holding property of the first waste liquid absorber.

If the printer is greatly inclined in the handling or transportation of a user in such a state, for example, the ink held in the lower part of the first waste liquid absorber concentrates on the end of a platen and might overflow out of the groove hole in the worst case. When such a phenomenon arises, there is a possibility that the components of the printer (for example, a driving system or an electric system) might be adversely influenced, and furthermore, the ink might leak out of the printer.

In the method described above, furthermore, the ink is not dropped until the amount of the absorption of the ink in the first waste liquid absorber approaches a saturation. Accordingly, there is a possibility that the ink might be maintained in a large amount in the first waste liquid absorber for a long period of time. As a result, in the case in which an ink jet recording apparatus is used with an inclination due to transportation between users, the ink stored in the first waste liquid absorber flows out of the apparatus in some cases. In the case in which an ink which is easily solidified, for example, a pigment based ink is used, particularly, there is a possibility that the ink might be held in the first waste liquid absorber for a long period of time and the ink solidified on the surface of the first waste liquid absorber might be thus deposited to deteriorate the absorbing capability of the first waste liquid absorber.

As another configuration of the ink jet recording apparatus, therefore, a first waste liquid absorber and a second waste liquid absorber are formed integrally (for example, see Japanese Patent Publication No. 2001-301201A; page 7 and FIG. 7). Consequently, an ink absorbed in the first waste liquid absorber is only moved exactly in the direction of a gravity in the first waste liquid absorber and is then held by the second waste liquid absorber so that the movement of the ink from the first waste liquid absorber to the second waste liquid absorber can be carried out quickly. Thus, the ink can be prevented from overflowing from the first waste liquid absorber or being solidified.

However, a component having such a configuration that the first waste liquid absorber and the second waste liquid absorber are integrated has a novel configuration which has not been conventionally obtained. For this reason, there is an anxiety that the design of an ink jet recording apparatus might be changed considerably when the such a component is employed. There is an anxiety that a cost might be increased due to the change in a design and a production efficiency might be reduced.

SUMMARY OF THE INVENTION

It is therefore an object of the invention to provide a liquid ejecting apparatus, in which waste liquid disposed to a waste liquid absorber provided in a groove hole can be smoothly lead to a waste liquid tray arranged in a lower portion of the apparatus, without involving cost increasing or remarkable design change.

In order to achieve the above object, according to the invention, there is provided a liquid ejecting apparatus, comprising:

a liquid ejecting head, operable to move in a first direction;

a platen, opposed to the liquid ejecting head to support an object to which a liquid droplet is ejected from the liquid ejecting head and to define a gap between the liquid ejecting head and the object, the platen formed with a groove hole to which a liquid droplet deviated from an edge of the object is disposed, and through holes formed in a bottom portion of the groove hole and arranged in the first direction;

a tray member, arranged below the platen to receive liquid dropped through the through holes;

a first liquid absorber, provided in the groove hole;

a second liquid absorber, provided in the tray member; and at least one liquid leading member, extending through at least one of the through holes to lead liquid absorbed by the first liquid absorber to the second liquid absorber.

In such a configuration, the liquid is hardly held in the lower part of the first waste liquid absorber. Also in the case where the liquid ejecting apparatus is inclined greatly in handling or transportation, there can be eliminated a drawback that the liquid held in the first waste liquid absorber is collected into the end part of the platen and then overflows to the outside. Consequently, a safety can be enhanced in the handling or the transportation.

Preferably, the liquid leading member is a third liquid absorber having a liquid absorbance higher than a liquid absorbance of the first liquid absorber.

In such a configuration, the liquid leading member can be obtained inexpensively and easily. The "high liquid absorbance" means that the capillary action is relatively remarkable so that the same amount of liquid can be spread over a wider area.

Here, it is preferable that a liquid absorbance of the second liquid absorber is higher than the liquid absorbance of the third liquid absorber.

In such a configuration, the liquid can be reliably led into the tray member.

Preferably, the through hole in which the liquid leading member is provided is placed at a position where a flushing operation of the liquid ejecting head is performed.

In the liquid ejecting apparatus, a so-called flushing (recovery) operation in which liquid is idly ejected is performed so that the nozzle orifice of the liquid ejecting head is not clogged up. The flushing operation is carried out in the vicinity of the end of the primary scanning region (the first direction) of the liquid ejecting head. In the position where the flushing operation is performed, accordingly, the liquid is disposed in a larger amount.

According to the above configuration, therefore, the function of the liquid leading member can be exhibited more effectively. Thus, the problem related to the overflow of the ink can be solved more reliably.

Here, it is preferable that the position at which the flushing operation is performed is not located at a home position of the liquid ejecting head.

In such a configuration, even in the case where an electronic component is arranged on the away position side, the liquid overflow problem can be solved by the function of the liquid leading member, and there is no anxiety that the electronic component might be adversely influenced.

Preferably, the through hole in which the liquid leading member is provided is placed at a position where a lower position of the platen which is an inclined state in connection with the first direction.

The platen is elongated in the first direction. In some cases in which the platen is provided in the liquid ejecting apparatus, it is inclined at a predetermined angle in the first direction by the influence of precision in a component or precision in an assembly. By such an inclination, the liquid disposed into the groove hole would be collected into the lower side so that the liquid overflow problem is apt to arise.

However, according to the above configuration, the function of the liquid leading member can be exhibited at the lower side where the liquid would be collected. Thus, the liquid overflow problem can be prevented reliably.

Preferably, the liquid leading member is an individual member comprised of a porous material.

In such a configuration, since the liquid leading member and the second liquid absorber are provided separately, one which has conventionally been used can be utilized exactly as the second liquid absorber. Therefore, a considerable change in a design is not required on the liquid ejecting apparatus.

Preferably, the liquid leading member is a sheet-like member having a portion to be extended through the at least one of the through holes.

In such a configuration, it is possible to easily form the liquid leading member by slightly processing the liquid absorber which has conventionally been used, and a considerable change in a design is not required. Therefore, a production efficiency can be enhanced.

Here, it is preferable that the liquid leading member has a size which is at least equal to a movable range of the liquid ejecting head in the first direction.

In such a configuration, in a case where the size of the object is set within the movable range of the liquid ejecting head, the disposed liquid can be reliably absorbed in the liquid leading member even if the liquid is deviated from all the edges of the object. As a result, the liquid can be ejected to all the edges of targets having various shapes.

It is also preferable that the liquid leading member is fitted into the groove hole, and the first liquid absorber is laminated thereon.

In such a configuration, by setting the total thickness of the first liquid absorber and the liquid leading member to be smaller than the depth of the groove hole, it is possible to prevent the object from coming in contact with the first liquid absorber when the object is supported by the platen. As a result, it is possible to prevent the object from being contaminated with the liquid absorbed in the first liquid absorber.

Preferably, a tip end of the liquid leading member which is to be brought into contact with the second liquid absorber is cut out obliquely.

In such a configuration, a capillary action can easily be generated between the liquid leading member and the second liquid absorber, so that the liquid absorbed in the liquid leading member can readily be moved to the second liquid absorber.

Preferably, a liquid absorbance of the liquid leading member is different from a liquid absorbance of the second liquid absorber.

In such a configuration, by setting the liquid absorbance of the second liquid absorber to be higher than that of the liquid leading member, the liquid absorbed in the liquid leading member can easily be moved to the second liquid absorber. As a result, even if the liquid ejecting apparatus is inclined by the transportation between users, the liquid does not leak out of the platen. Moreover, a time taken for the liquid to stay in the liquid leading member is shortened. Therefore, it is possible to prevent the liquid from being dried and solidified in the liquid leading member.

Preferably, the first liquid absorber is comprised of a material having a first density, and the liquid leading member is comprised of a material having a second density.

In such a configuration, by using a material having a relatively lower density for the first liquid absorber and a material having a relatively higher density for the liquid leading member, for example, a mist generated by liquid disposed into the groove hole can be absorbed by the material having the lower density. Thus, the generation of the mist can be decreased. Furthermore, the liquid absorbed in the material having the lower density is easily moved toward the material side having the higher density by a capillary action. Consequently, the liquid can be moved quickly to the liquid leading member, whereby the liquid can be moved to the second liquid absorber more reliably.

Preferably, the platen is operable to support a plurality of objects having different sizes, and the through holes are located so as to correspond to edges of the objects.

In such a configuration, the through holes are provided in places where the liquid is frequently disposed, that is, places where the liquid tends to be collected. Consequently, the liquid can be efficiently moved toward the second liquid absorber side.

Preferably, the liquid ejecting apparatus is an ink jet recording apparatus in which an ink droplet is ejected toward a target medium supported by the platen.

According to the invention, there is also provided a waste liquid treating device, comprising:

a platen, opposed to a liquid ejecting head of a liquid ejecting apparatus, to support an object to which a liquid droplet is ejected from the liquid ejecting head, the platen formed with a groove hole to which a liquid droplet deviated from an edge of the object is disposed, and a through hole formed in a bottom portion of the groove hole;

a tray member, arranged below the platen to receive liquid dropped through the through hole;

a first liquid absorber, provided in the groove hole;

a second liquid absorber, provided in the tray member;

a liquid leading member, extending through the through hole to lead liquid absorbed by the first liquid absorber to the second liquid absorber; and a guide member, which regulates an attitude and a position of the liquid leading member.

In such a configuration, the liquid disposed from the liquid ejecting head into the groove hole is hardly held in the bottom portion of the first waste liquid absorber. In other words, the liquid is smoothly led from the first waste liquid absorber to the second waste liquid absorber. Even in the case where the liquid ejecting apparatus is greatly inclined in the handling or transportation, there is no anxiety that the liquid staying in the bottom portion of the first waste liquid absorber is collected into the end part of the platen and overflows to the outside. Thus, it is possible to maintain a safety in the handling or the transportation.

Furthermore, the attitude and position of the liquid leading member can be uniformly determined without a change caused by a variation in an assembly or a vibration generated by the transportation. Consequently, the first waste liquid absorber and the second waste liquid absorber can be reliably connected to each other through the liquid leading member. Thus, the liquid can always be led from the first waste liquid absorber to the second waste liquid absorber reliably.

Preferably, the guide member is a sheet member formed with a slit through which the liquid leading member extends.

In such a configuration, the regulating function of the guide member can be attained inexpensively with a simple structure.

Here, it is preferable that the sheet member is comprised of an elastic resin material, so that the handling of the guide member can be carried out very easily.

It is also preferable that a portion of the sheet member in which no slit is formed is opposed to an electronic unit of the liquid ejecting apparatus.

In the case where the electronic unit is provided in the vicinity of the platen, there is an anxiety that the performance of the electronic unit might be deteriorated when the liquid leading member which is wetted with the liquid comes in contact with the electronic unit.

However, according to the above configuration, the electronic unit can be guarded by the no-slit portion of the guide member from the liquid leading member. Thus, there is no anxiety that the performance of the electronic unit might be deteriorated.

Preferably, the waste liquid treating device further comprises a cover member, which covers an upper portion of the tray member, while retaining the guide member.

In such a configuration, the attitude and position of the liquid leading member can be held more reliably.

Preferably, the liquid leading member is integrally formed with the first liquid absorber.

As compared with the case where the liquid leading member and the first waste liquid absorber are constituted separately, the liquid leading member can be obtained at a lower cost.

According to the invention, there is also provided a waste liquid treating device, comprising:

a platen, opposed to a liquid ejecting head of a liquid ejecting apparatus, to support an object to which a liquid droplet is ejected from the liquid ejecting head, the platen formed with a groove hole to which a liquid droplet deviated from an edge of the object is disposed, and a through hole formed in a bottom portion of the groove hole;

a tray member, arranged below the platen to receive liquid dropped through the through hole;

a first liquid absorber, provided in the groove hole;

a second liquid absorber, provided in the tray member; and a liquid leading member, extending through the through hole to lead liquid absorbed by the first liquid absorber to the second liquid absorber, the liquid leading member integrally formed with the first liquid absorber.

In such a configuration, the liquid disposed from the liquid ejecting head into the groove hole is hardly held in the bottom portion of the first waste liquid absorber. In other words, the liquid is smoothly led from the first waste liquid absorber to the second waste liquid absorber. Even in the case where the liquid ejecting apparatus is greatly inclined in the handling or the transportation, there is no anxiety that the liquid staying in the bottom portion of the first waste liquid absorber is collected into the end part of the platen and overflows to the outside. Thus, it is possible to maintain a safety in the handling or the transportation.

Furthermore, as compared with the case where the liquid leading member and the first waste liquid absorber are constituted separately, the liquid leading member can be obtained at a lower cost.

Preferably, the first liquid absorber and the liquid leading member are comprised of a porous soft material.

In such a configuration, the first waste liquid absorber and the liquid leading member can be obtained inexpensively and a liquid absorbance can be enhanced. Thus, the liquid ejected from the liquid ejecting head can be absorbed reliably, whereby the liquid can be reliably led from the first waste liquid absorber to the second waste liquid absorber.

Preferably, the second liquid absorber has a liquid absorbance higher than a liquid absorbance of the first liquid absorber and the liquid leading member.

In such a configuration, it is possible to increase such a degree that the second waste liquid absorber draws the liquid from the first waste liquid absorber and the liquid leading member. Thus, the liquid can be led from the first waste liquid absorber to the second waste liquid absorber more reliably.

Preferably, a first part of an inner face of the groove hole and a second part of an inner face of the through hole are made flush with each other, and the liquid leading member extends along the first part and the second part.

In such a configuration, even when the liquid ejecting apparatus is inclined, the liquid collected in the end part of the groove hole smoothly flows to the tray member. Thus, a safety can be reliably maintained in the handling or the transportation.

Here, it is preferable that: at least one more through hole is arranged with the through hole in a direction along which the liquid ejecting head is operable to move; and the liquid leading member is provided in each of the through holes.

In such a configuration, even in the case where the liquid ejecting apparatus is placed and used in a horizontal state, the liquid disposed into the groove hole can be led to the tray member more smoothly.

Preferably, the liquid leading member is deformably connected to the first liquid absorber.

According to the invention, there is also provided a liquid ejecting apparatus, comprising the above waste liquid treating device, wherein the platen is arranged so as to define a gap between the liquid ejecting head and the object.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A first embodiment of the invention will be described below with reference to FIGS. 1 through 6.

Figure 1:
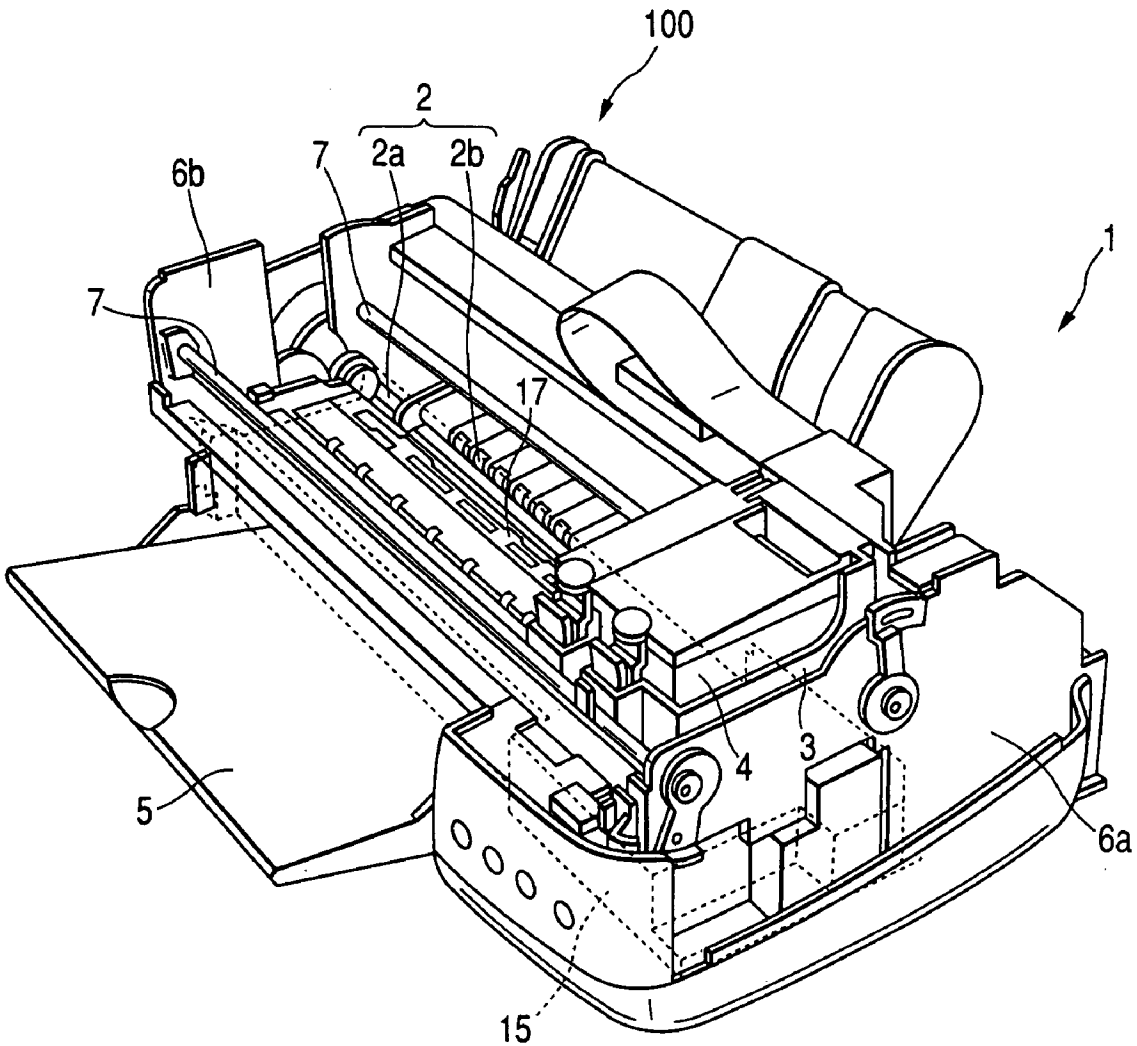
FIG. 1 is a perspective view showing the appearance of an ink jet printer according to a first embodiment of the invention.

In FIG. 1, an ink jet printer 100 (hereinafter referred to as "printer") as a liquid ejecting apparatus comprises a feeder 1 to feed an uppermost one of sheets stacked thereon toward an ink jet recording head 8 (which will be hereinafter referred to as a "recording head": see FIG. 2) provided under a carriage 3, at which recording is performed, and the sheet is ejected to a sheet discharge stacker 5 after the recording is carried out.

The carriage 3 mounts an ink cartridge 4 which supplies ink to the recording head 8. Moreover, the carriage 3 inserts a carriage guide shaft 7 provided between side frames 6*a* and 6*b* constituting the base member of the printer 100 and is guided in a primary scanning direction by the carriage guide shaft 7. The carriage 3 is reciprocated in the primary scanning direction by a driving member which is not shown.

In FIG. 1, a lower right side is defined as a "home position side" and an upper left side is defined as an "away position side". When the carriage 3 is placed at the home position side, the recording head 8 may be subjected to a maintenance operation such as capping or cleaning. When the carriage 3 is placed as the away position side, the recording head 8 may be subjected to a so-called flushing operation for performing the idle injection of ink so that ink in the nozzle orifice of a nozzle array 9 is not clogged up.

Next, the structure of the recording section of the printer 100 will be described with reference to FIG. 2. In FIG. 2, a delivery roller 2 is constituted by a delivery driving roller 2*a* to be rotated and a delivery driven roller 2*b* to be driven via a pressure contact with the delivery driving roller 2*a*, and a sheet S fed from the upstream side (the right side in FIG. 2) by the feeder 1 is nipped between the delivery driving roller 2*a* and the delivery driven roller 2*b* and is delivered to a portion provided under the recording head 8.

The nozzle array 9 for ejecting ink is provided on the recording head 8. The sheet S delivered to the lower part of the recording head 8 is subjected to the recording operation performed by ejecting ink from the nozzle array 9. At this time, the sheet S is supported from below by a platen 10 arranged opposite to the recording head 8 so that a distance from the nozzle array 9 to the sheet S (sheet gap) is defined.

More specifically, ribs 11*a* and 11*b* are formed in the upper part of the platen 10, and the sheet S is supported by the ribs 11*a* and 11*b* from below. Groove holes 12*a* and 12*b* extended in a primary scanning direction are formed in the upstream and downstream sides of the rib 11*b*, respectively. The ink deviated from the leading and trailing ends of the sheet S is disposed into the groove holes 12*a* and 12*b* so that marginless printing is executed on the leading end side and trailing end side of the sheet S. More specifically, when the leading end of the sheet S is positioned above the groove hole 12*b*, a part 9*b* of the nozzle array 9 is driven to eject ink into a portion deviated from the leading end of the sheet S, thereby executing the marginless printing at the leading end. At this time, the ink deviated from the leading end of the sheet S is disposed into the groove hole 12*b*. When the trailing end of the sheet S is positioned above the groove hole 12*a*, similarly, the part 9*a* of the nozzle array 9 is driven to eject ink into the portion deviated from the trailing end of the sheet S, thereby executing the marginless printing at the trailing end.

Figure 2:
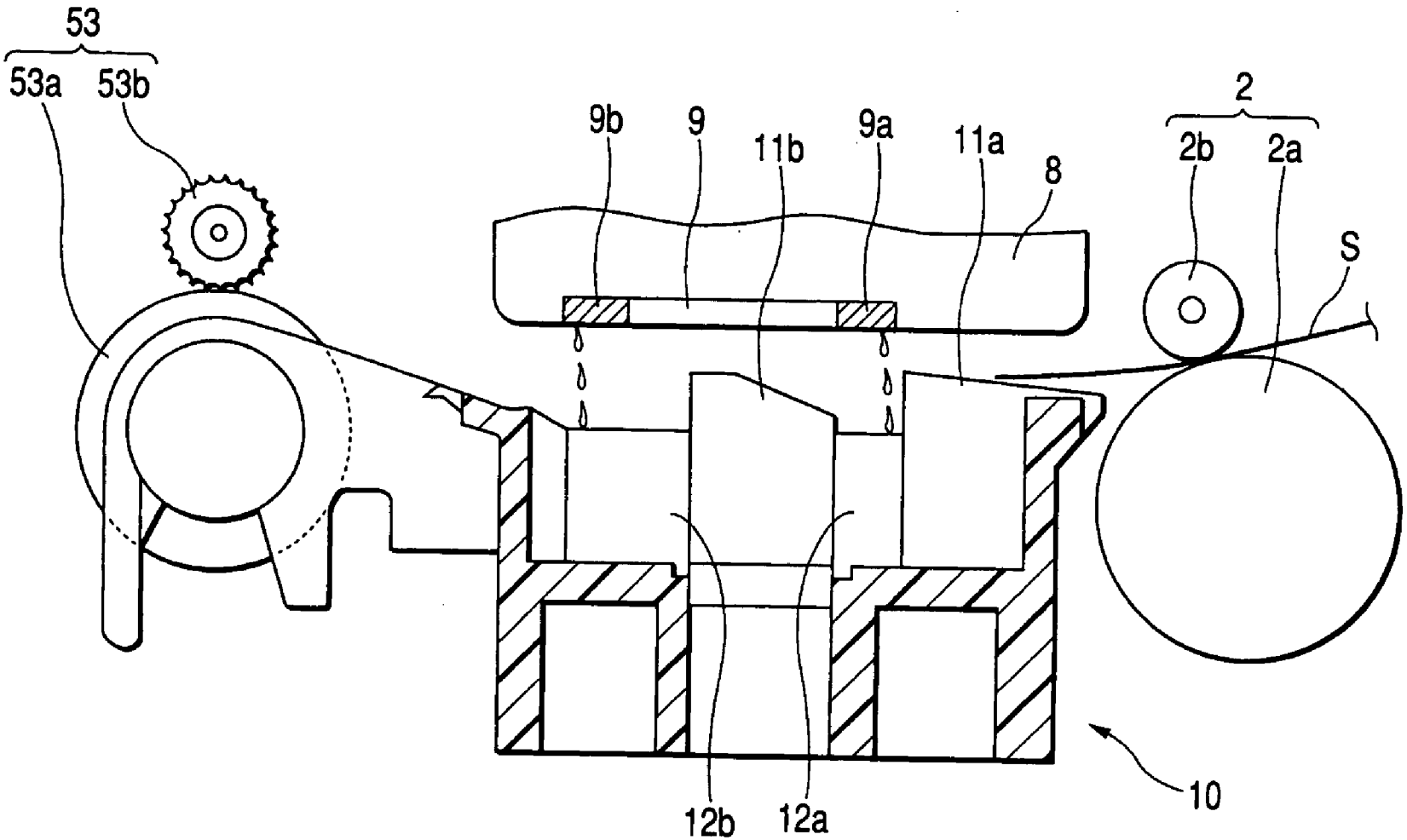
FIG. 2 is a sectional side view showing a recording section of the ink jet printer of FIG. 1.

The groove holes 12*a* and 12*b* are provided with a first waste liquid absorber 17 (see FIGS. 1 and 6) which is not shown for simplicity of FIG. 2. The structure of the platen 10 including the first waste liquid absorber 17 will be described later in more detail.

Next, a sheet discharge roller 53 to be rotated is provided on the downstream side of the platen 10. The sheet discharge roller 53 is constituted by a sheet discharge driving roller 53*a* to be rotated and a sheet discharge driven roller 53*b* to be driven via a contact with the sheet discharge driving roller 53*a*. The sheet S recorded by the recording head 8 is nipped between the sheet discharge driving roller 53*a* and the sheet discharge driven roller 53*b* and is delivered to the lower part of the discharged sheet stacker 5.

The structure of the platen 10 will be described below with reference to FIGS. 3 to 6.

Figure 3:
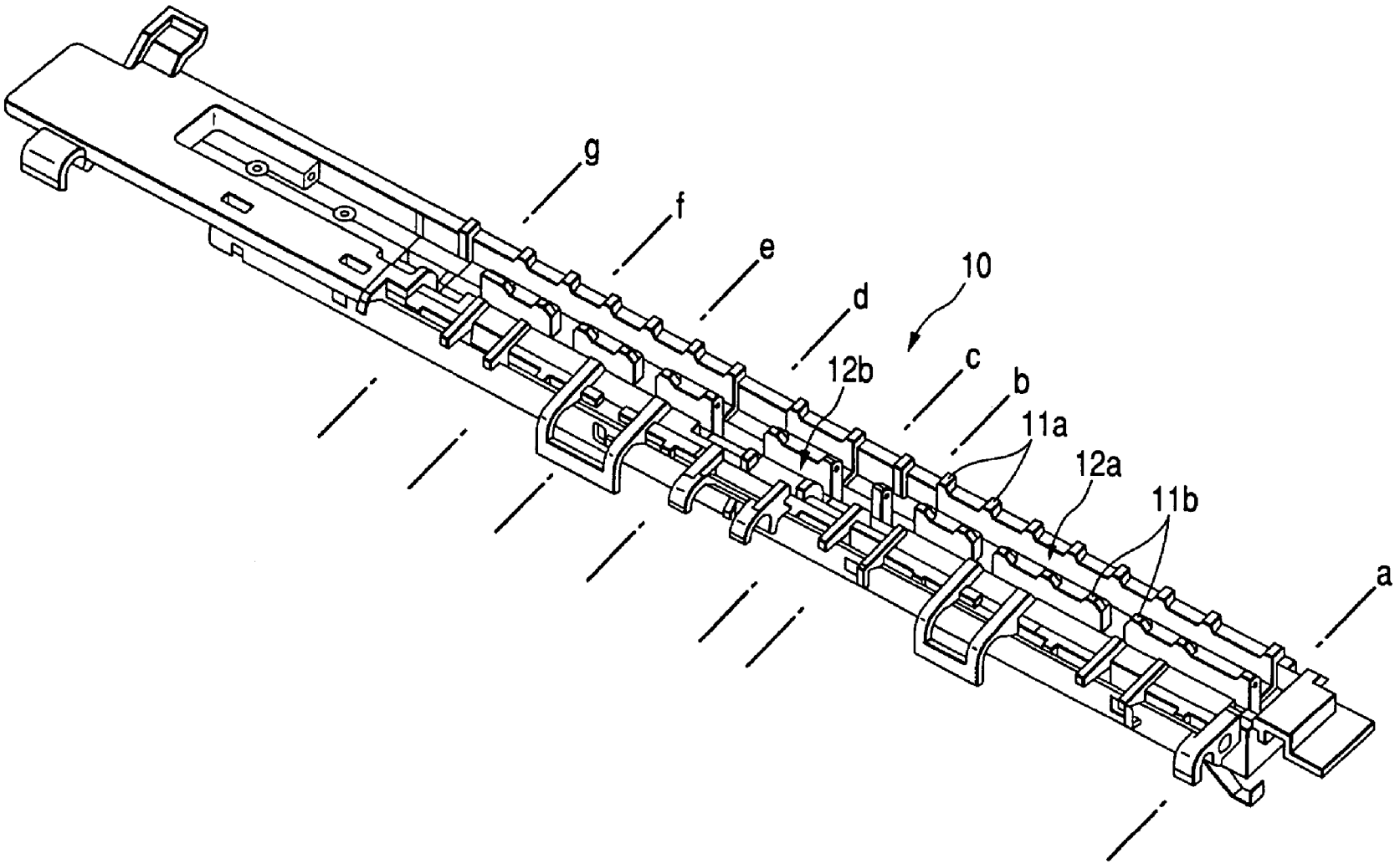
FIG. 3 is a perspective view showing the appearance of a platen in the ink jet printer of FIG. 1.
Figure 4:
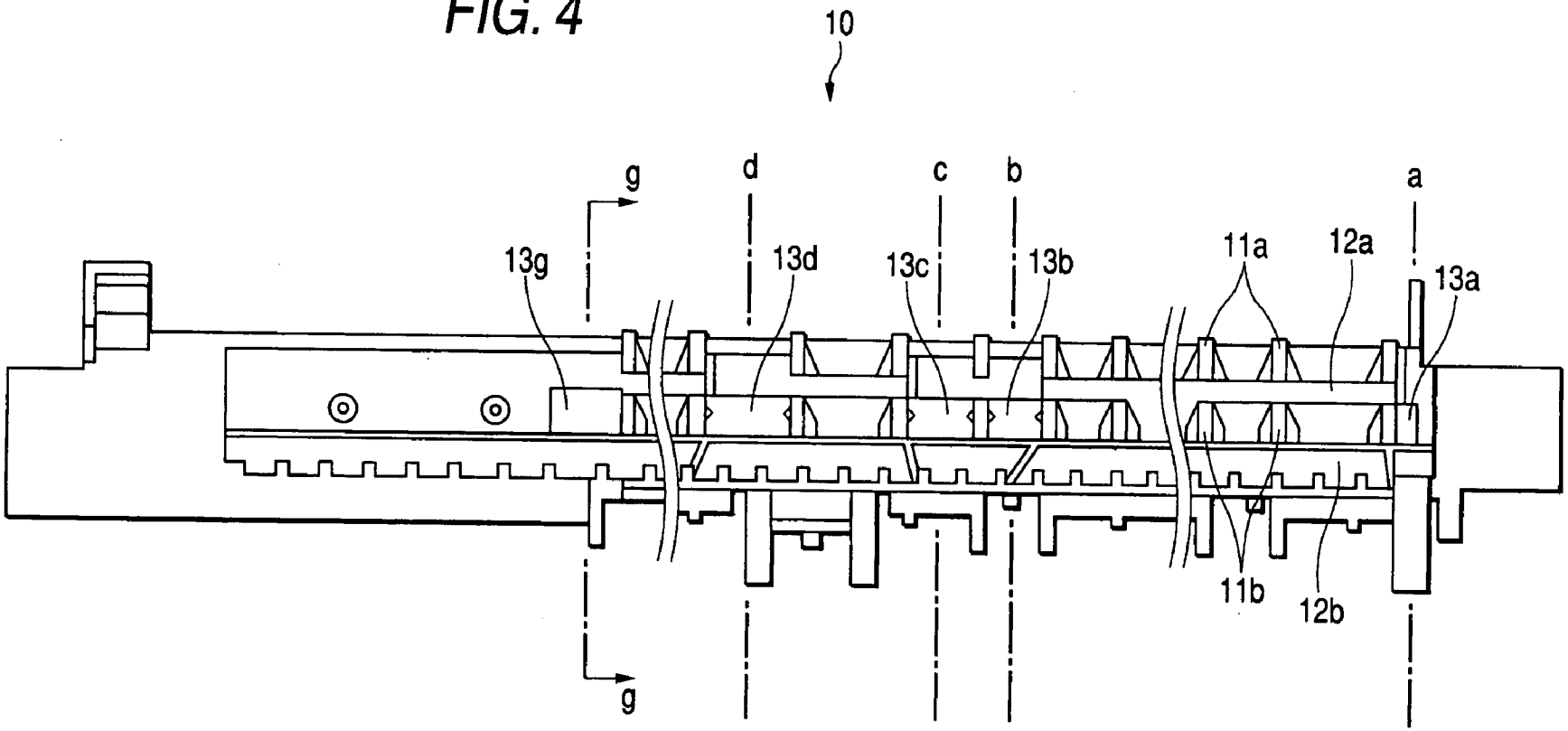
FIG. 4 is a plan view showing the platen.

As shown in FIGS. 3 and 4, the platen 10 has an elongated shape in the primary scanning direction (the direction of a sheet width) and a plurality of ribs 11*a* and 11*b* formed on the upper surface of the platen 10 at a predetermined interval in the primary scanning direction. The groove holes 12*a* and 12*b* are formed on the upstream and downstream sides of the rib 11*b* so as to be extended in the primary scanning direction of the platen 10.

The groove holes 12*a* and 12*b* are used for the marginless printing of the leading and trailing ends of the sheet as described above, and groove holes for carrying out the marginless printing at the left and right ends of the sheet are formed in positions indicated as the designations of "a" to "g" in FIG. 3 so as to be localized in positions corresponding to the width of the sheet. More specifically, the groove is formed between two adjacent ribs 11*b* in the positions indicated as the designations of "a" to "g".

The groove hole to be formed in the position "a" is placed on the most home position side, and the ends on the home position side in sheets having all sizes pass through the groove hole formed in the position "a". The groove holes to be formed in the positions "b" to "g" are placed on the away position side of the sheet, and the positions "b" to "g" are formed to correspond to an end on the away position side of sheets having various sizes. In the marginless printing to be carried out the left and right ends of the sheet, the ink is disposed into the groove hole formed in the position "a" and any of the groove holes formed in the positions "b" to "g". Consequently, the marginless printing is executed at the left and right ends of the sheet.

In FIGS. 3 and 4, the first waste liquid absorber 17 are not shown for simplicity of the drawings. All the groove holes formed in the plate 10 are provided with the first waste liquid absorber 17 to fill up them.

Through holes indicated as the designations of 13*a*, 13*b*, 13*c*, 13*d* and 13*g* (which will be hereinafter referred to as through holes 13) in FIG. 4 are formed in the bottom portions of a part of the groove holes provided in the positions "a" to "g". The through holes 13 are formed in the bottom portions of the groove holes formed in the positions indicated as "a", "b", "c", "d" and "g". Consequently, the ink disposed into the platen 10 is dropped downward from the through holes 13.

Figure 5:
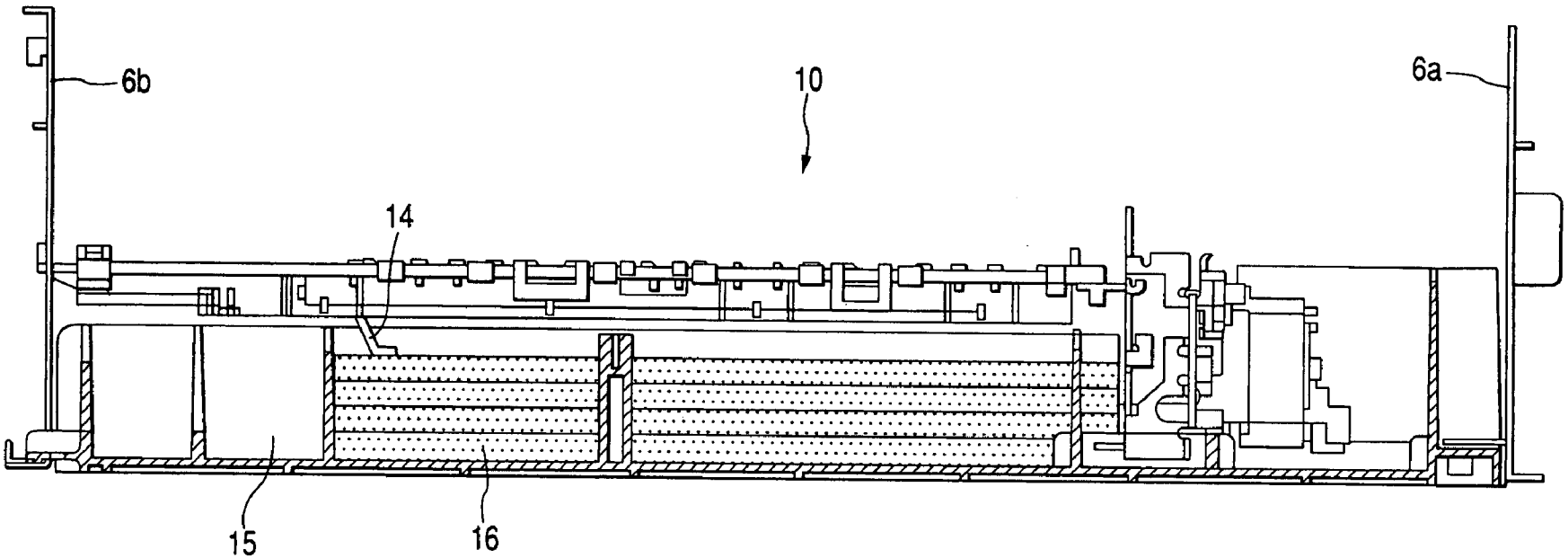
FIG. 5 is a transverse section view showing a main part of the ink jet printer of FIG. 1.

As shown in FIG. 5, the ink dropped downward from the through holes 13 is stored in the waste liquid tray 15 provided in the lower part of the platen 10 (the position of arrangement in the printer 100 is shown in FIG. 1). The waste liquid tray 15 is almost box-shaped and includes a second waste liquid absorber 16 for absorbing ink to fill up the waste liquid tray 15. Accordingly, the ink dropped downward from the through hole 13 is stored in the waste liquid tray 15 and is reliably held therein by the second waste liquid absorber 16 without the ink easily overflowing to the outside even if the printer 100 is inclined.

Figure 6:
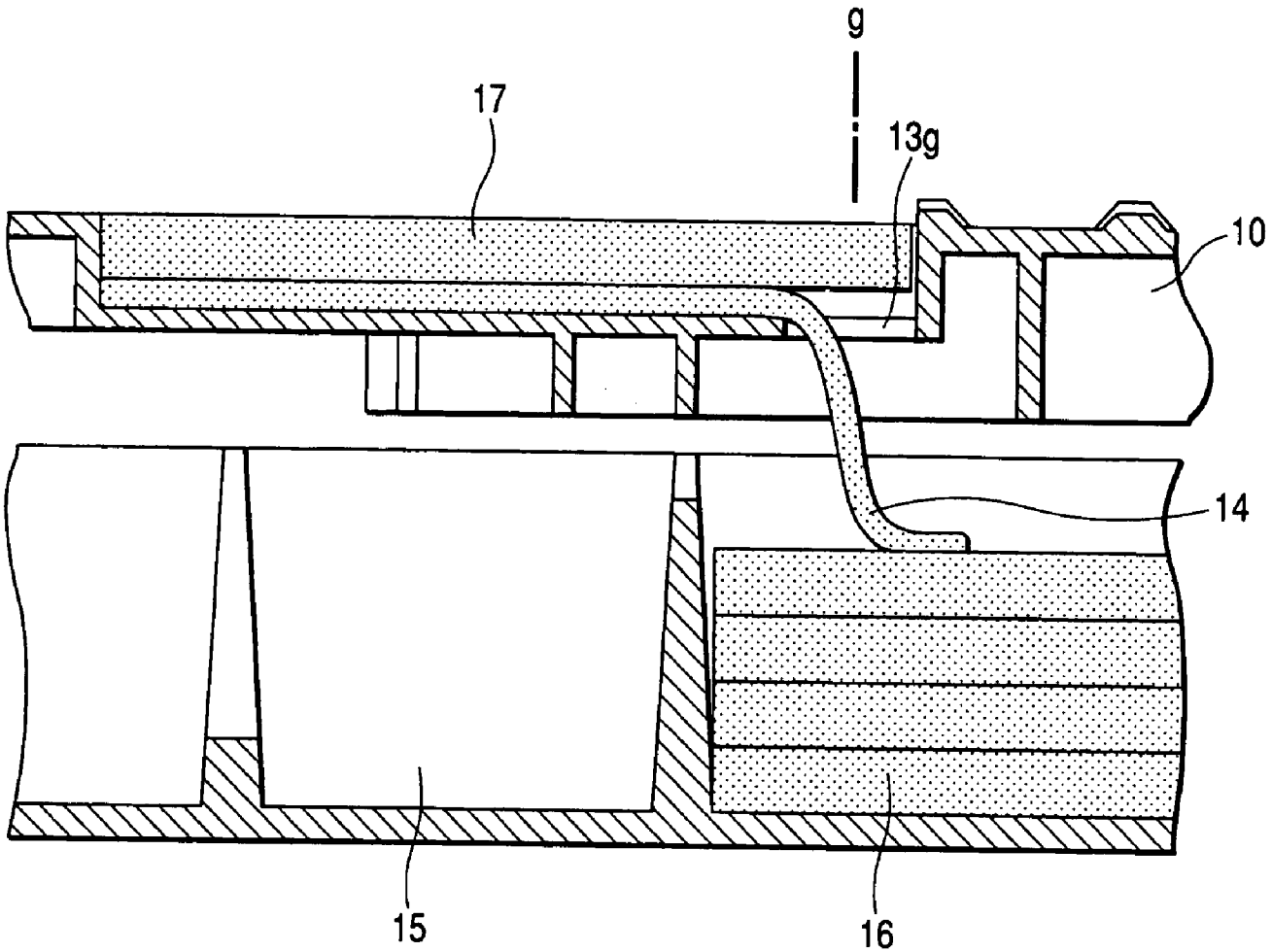
FIG. 6 is a longitudinal section view showing a main part of the platen and a waste liquid tray in the ink jet printer of FIG. 1.

As shown in FIG. 6, the first waste liquid absorber 17 is provided in the groove hole 12*a*, 12*b* formed on the platen 10. The first waste liquid absorber 17 may be formed by any material having a high ink absorbance and a high ink-resistance. For example, a synthetic fiber such as polyethylene terephthalate, acryl or rayon, a felt material formed of pulp or a porous material such as a sponge can be used. This is also common to the second waste liquid absorber 16 and the third waste liquid absorber 14 which will be described below. In the embodiment, a sponge (for example, a trade name of "Ever Light" manufactured by BRIDGESTONE CORPORATION) is used for the first waste liquid absorber 17. The ink disposed into the platen 10 is first absorbed by such a first waste liquid absorber 17.

The third waste liquid absorber 14 is provided under the waste liquid absorber 17. The third waste liquid absorber 14 is provided in only the groove hole formed in the position "g" as shown in FIG. 6, that is, a groove hole formed on the most away position side in the platen 10 (see FIG. 5) and is provided to hang downward via the through hole 13*g*. In other words, the third waste liquid absorber 14 is provided to connect the bottom portion of the first waste liquid absorber 17 to the top of the second waste liquid absorber 16. In the embodiment, "Belleater" (a trade name of Kanebo Chemical Industries) to be a porous member is used for the third waste liquid absorber 14. In the embodiment, moreover, a nonwoven fabric (manufactured by OJI QUINOCROSS CO., LTD., for example) is used for the second waste liquid absorber 16 provided in the waste liquid tray 15.

The ink absorbance of each of the first waste liquid absorber 17, the second waste liquid absorber 16 and the third waste liquid absorber 14 is relatively set to be increased in order of the first waste liquid absorber 17, the third waste liquid absorber 14 and the second waste liquid absorber 16.

Description will be given to the functions and advantages of the first to third waste liquid absorbers constituted as described above. The ink disposed into the groove hole formed in the platen 10 is first absorbed in the first waste liquid absorber 17. The whole ink thus absorbed is not always dropped quickly from the through hole 13 into the waste liquid tray 15. More specifically, a part of the ink is dropped from the through hole 13 toward the waste liquid tray 15 and is then absorbed in the second waste liquid absorber 16, while the other part is held in the lower part of the first waste liquid absorber 17 because of the ink holding property of the first waste liquid absorber 17.

When the printer 100 is greatly inclined in such a state at time of the handling or transportation of a user, for example, the ink held in the lower part of the first waste liquid absorber 17 would be collected into the end part of the platen 10 (the groove hole on the most away position side shown in FIG. 6, for example) and might overflow out of the platen 10 in the worst case. When such a phenomenon arises, there is also an anxiety that the components of the printer 100 (for example, a driving system or an electric system) might be adversely influenced, and furthermore, the ink might leak out of the printer 100.

Therefore, the through hole 13*g* formed in the groove hole on the most away position side is provided with the third waste liquid absorber 14 as shown in FIG. 6. The third waste liquid absorber 14 has a higher ink absorbance than the first waste liquid absorber 17. Accordingly, the third waste liquid absorber 14 serves as a waste liquid leading member to lead the ink from the lower part of the first waste liquid absorber 17 to the second waste liquid absorber 16. The second waste liquid absorber 16 has a higher ink absorbance than the third waste liquid absorber 14. Therefore, the ink is smoothly transferred from the third waste liquid absorber 14 to the second waste liquid absorber 16.

As described above, accordingly, the ink is hard to be held in the first waste liquid absorber 17. Consequently, it is possible to eliminate the drawback that the ink is collected into the end part of the platen 10 and overflows to the outside when the printer 100 is inclined. Thus, it is possible to enhance safety in handling or transportation.

In the printer 100 according to the embodiment, particularly, since the position on the away position side where the third waste liquid absorber 14 is provided acts as the flushing position of the recording head 8, the ink is disposed into that place most remarkably in the platen 10 which is elongated in the primary scanning direction. Consequently, the advantages of the waste liquid leading member can be enhanced still more. At the same time, the third waste liquid absorber 14 is not provided in all of the through holes 13 (13*a*, 13*b*, 13*c* and 13*g*) localized in the primary scanning direction but in only the most effective place in the embodiment. Consequently, an increase in a cost can be prevented. However, it is apparent that the third waste liquid absorber 14 may be provided in all the through holes 13 to lead the ink to the waste liquid tank 15 reliably.

In addition, in some cases in which the platen 10 is provided in the printer 100, either the home position side or the away position side is inclined depending on precision in a component or precision in an assembly. In these cases, the ink is intensively collected on the low position side so that it is apt to overflow as described above. In such cases, therefore, the third waste liquid absorber 14 is provided in the through hole 13 on the low position side so that it is possible to more reliably eliminate a drawback that the ink overflows as described above.

Next, an ink jet printer (hereinafter referred to as a "printer") 200 as a liquid ejecting apparatus according to a second embodiment of the invention will be described with reference to FIGS. 7 to 11.

Figure 9:
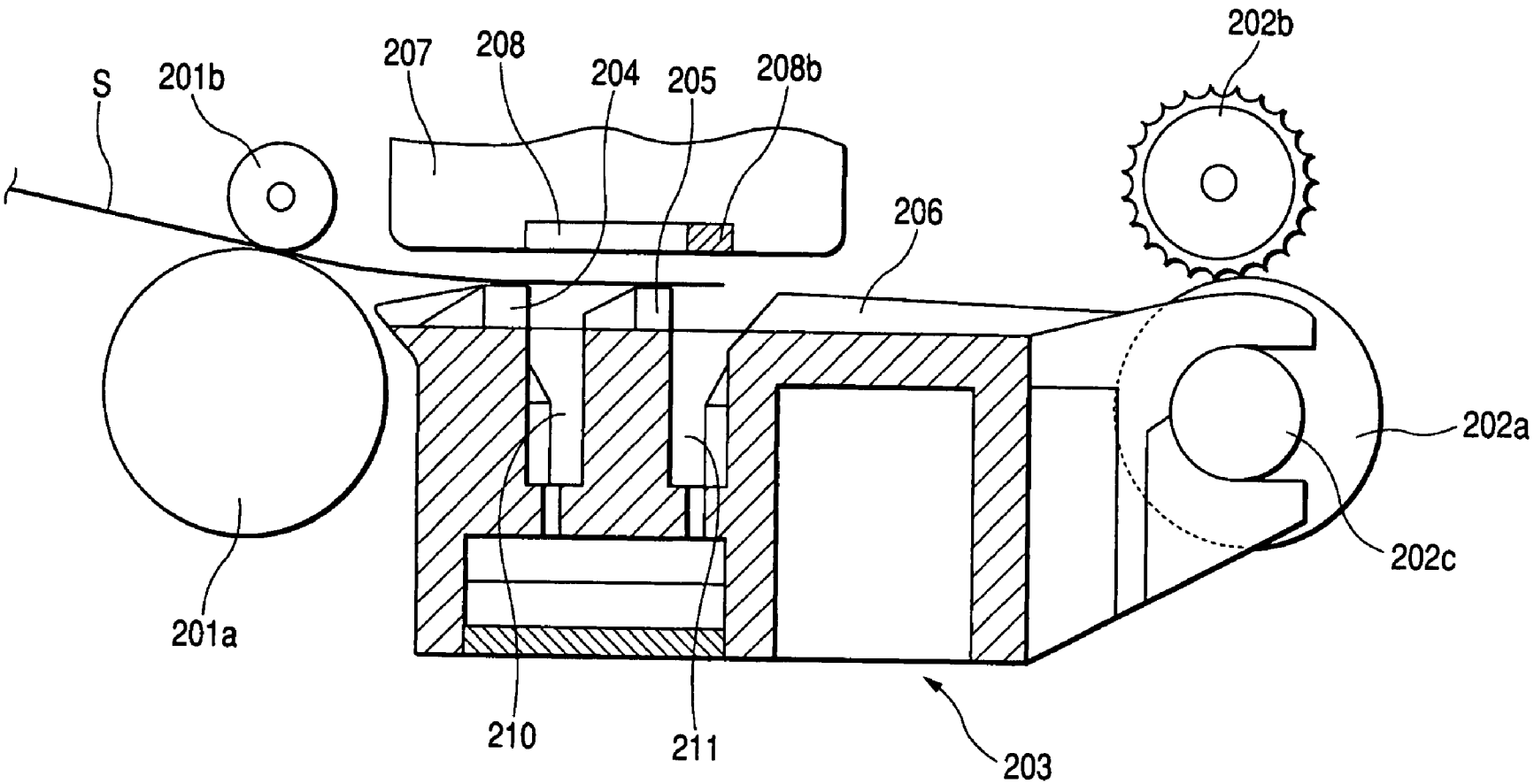
FIG. 9 is a sectional side view showing the recording section in the ink jet printer of FIG. 7, showing a condition that the marginless printing for a leading end of a sheet is performed.

The printer 200 comprises a feeder in the rear part of the apparatus (an upper left part in FIG. 7) which is not shown in detail, and feeds cut-form sheets one by one to the recording section (see FIG. 9). Moreover, the feeder includes a rolled sheet holder 228 so that a rolled sheet R can be set to be freely rotatable. In the embodiment, the medium which can be fed by the feeder will be collectively referred to as a sheet S.

The recording section provided on the downstream side of the feeder includes a delivery roller having a delivery driving roller 201*a* and a delivery driven roller 201*b* as shown in FIG. 9. The delivery driving roller 201*a* is rotated by a driving motor which is not shown and the delivery driven roller 201*b* is rotated via a pressure contact with the delivery driving roller 201*a*. The delivery roller nips the sheet S fed by the feeder from the upstream side in a delivery direction (the left side in FIG. 9) by the delivery driving roller 201*a* and the delivery driven roller 201*b*, and the delivery driving roller 201*a* is then rotated in the nip state so that the sheet S is delivered (fed precisely) to a portion provided under an ink jet recording head (hereinafter referred to as a "recording head") 207.

Figure 7:
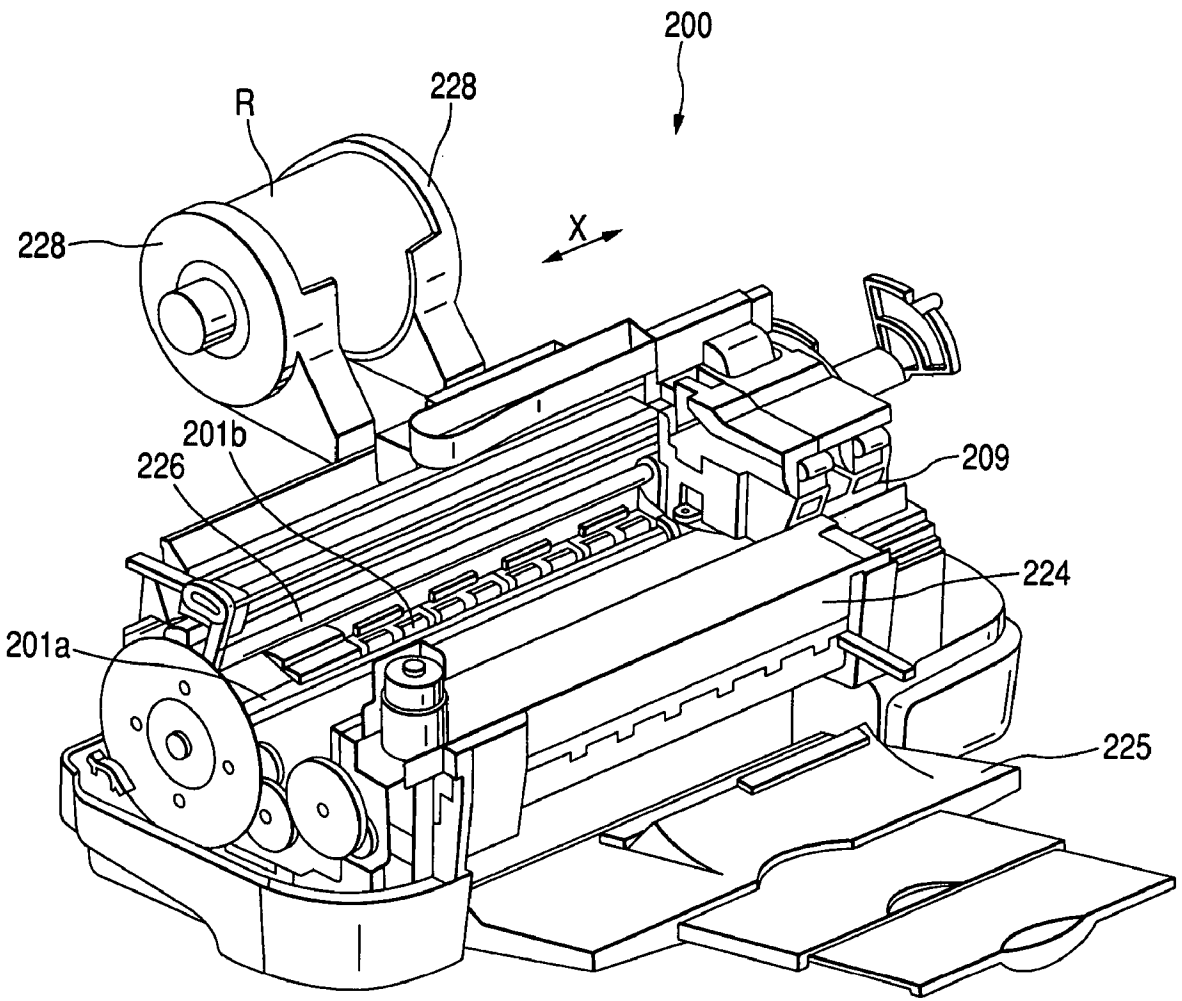
FIG. 7 is a perspective view showing the appearance of an ink jet printer according to a second embodiment of the invention.

The recording head 207 is provided in the bottom portion of a carriage 209 as shown in FIG. 7. The carriage 209 mounts an ink cartridge which supplies ink to the recording head 207. The carriage 209 is provided to insert a carriage guide shaft 226 extended in parallel with a primary scanning direction of the recording head 207 and is driven by a driving motor which is not shown, and is thus reciprocated in the primary scanning direction (a direction of an arrow X in FIG. 7).

Returning to FIG. 9, the recording head 207 has a nozzle array 208 from which ink is ejected. The sheet S delivered to the lower part of the recording head 207 is subjected to ink ejection from the recording head 207 to perform printing. At this time, the sheet S is supported from below by a platen 203 provided opposite to the recording head 207 so that a distance with the nozzle array 208 (sheet gap) is defined.

Figure 8:
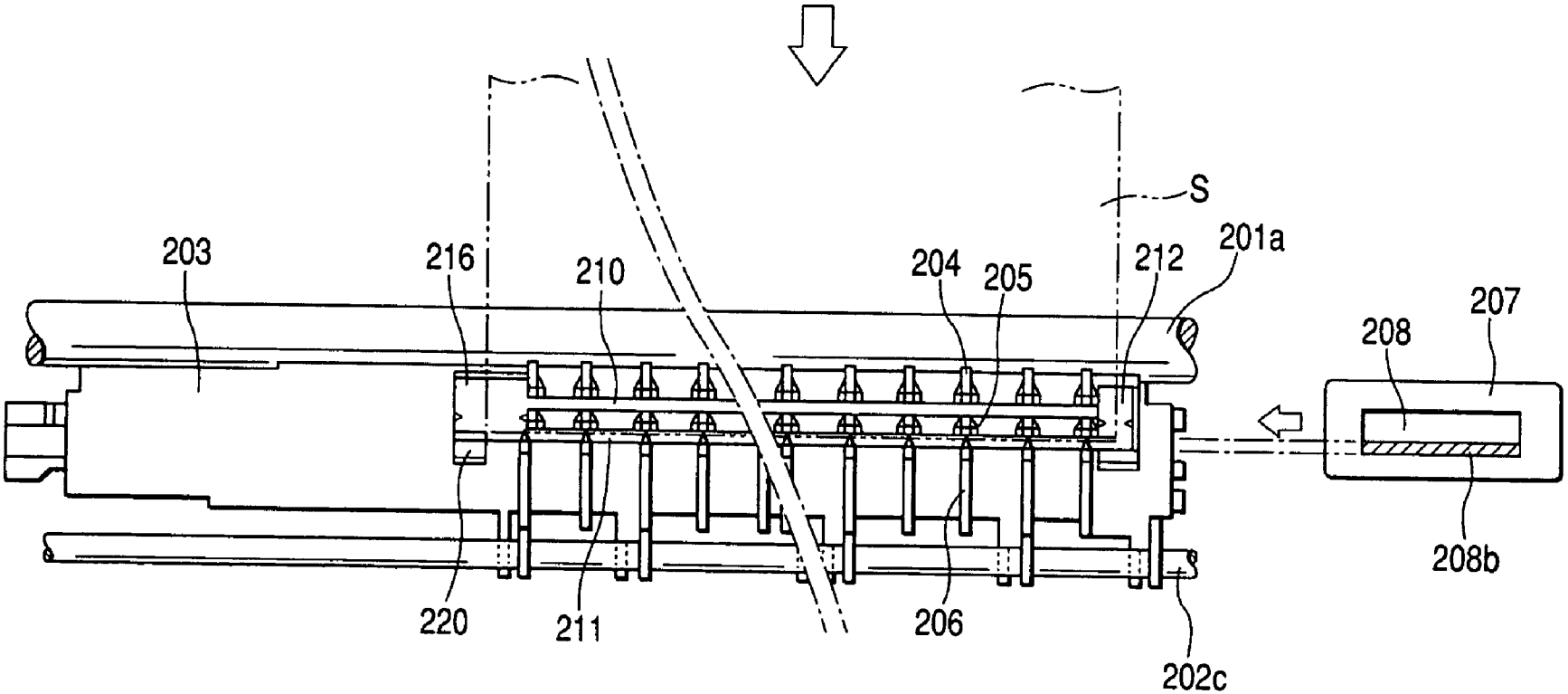
FIG. 8 is a plan view showing a recording section in the ink jet printer of FIG. 7, showing a condition that the marginless printing for a leading end of a sheet is performed.

Marginless printing to be carried out over the sheet S will be described with reference to FIGS. 8 to 11. In FIG. 8, the platen 203 is elongated in the primary scanning direction (a transverse direction in FIG. 8) and ribs 204, 205 and 206 are formed on a platen surface (the upper surface of the platen 203: an opposed surface to the recording head 207) so as to extend in the delivery direction (secondary scanning direction) and arranged at a predetermined interval in the primary scanning direction as shown in FIG. 8.

Moreover, two groove holes 210 and 211 extended in the primary scanning direction are formed on the platen surface of the platen 203 as shown in FIG. 8, and furthermore, square groove holes 212 to 216 (see FIG. 15) are formed in portions to be positioned on the side edges of the sheet S. The groove holes 210 and 211 are formed to have predetermined depths from the recording head 207 as shown in FIG. 9. Moreover, the groove holes 212 to 216 are also formed to have almost the same depths as those of the groove holes 210 and 211. While a waste liquid absorber for absorbing an ink drop is provided in the groove holes 210 to 216, it will be described below in detail.

The groove holes 210, 211 and 212 to 216 are used for disposing away ink (liquid) to print four sides of the sheet S without a margin and the ink ejected from the nozzle array 208 is disposed into the groove holes 212 to 216. For example, in the marginless printing at the leading end of the sheet S, when the leading end of the sheet S reaches the upper part of the groove hole 211 positioned on the downstream side in the delivery direction as shown in FIGS. 8 and 9, only a part 208*b* of the nozzle array 208 is driven to eject ink drop onto the sheet S. Consequently, the ink drop deviated from the leading end of the sheet S is disposed into the groove hole 211. Accordingly, the platen surface can be prevented from being contaminated with the ink drop.

Figure 10:
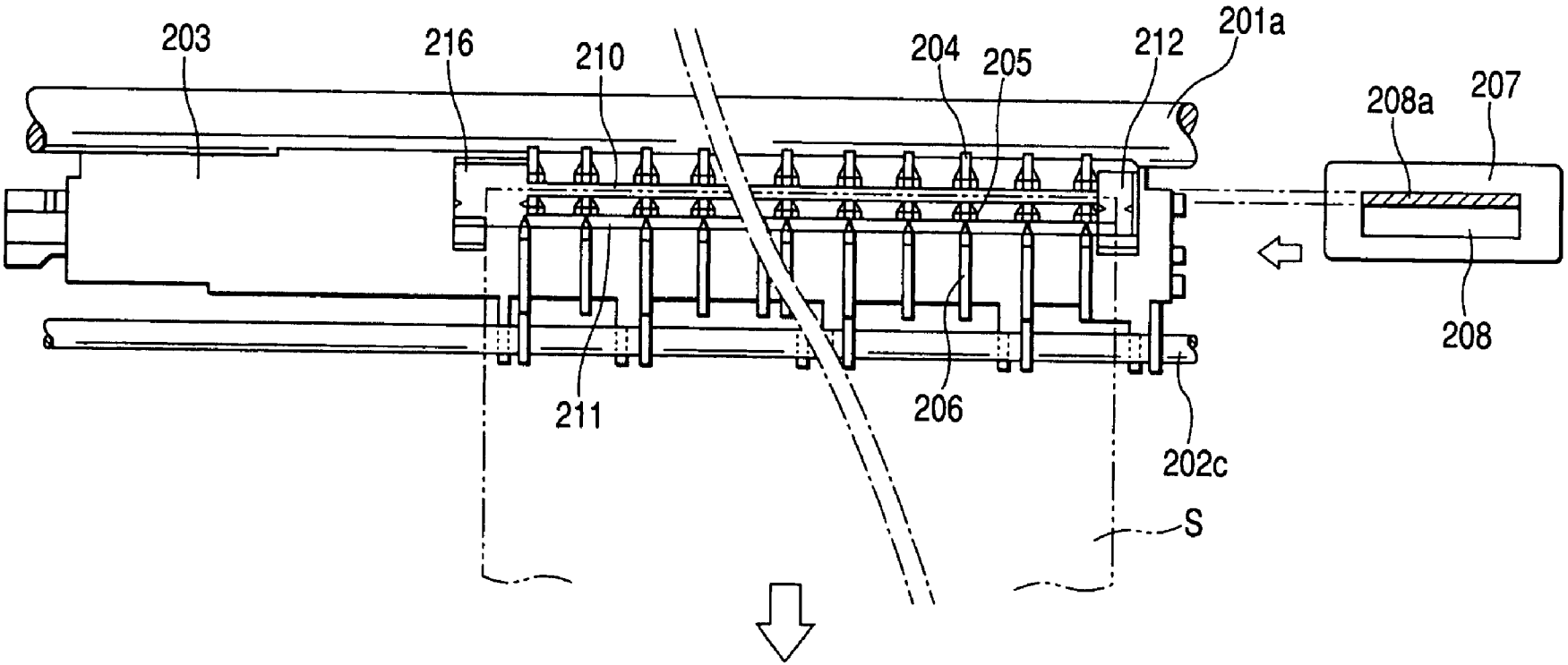
FIG. 10 is a plan view showing the recording section in the ink jet printer of FIG. 7, showing a condition that the marginless printing for a trailing end of a sheet is performed.
Figure 11:
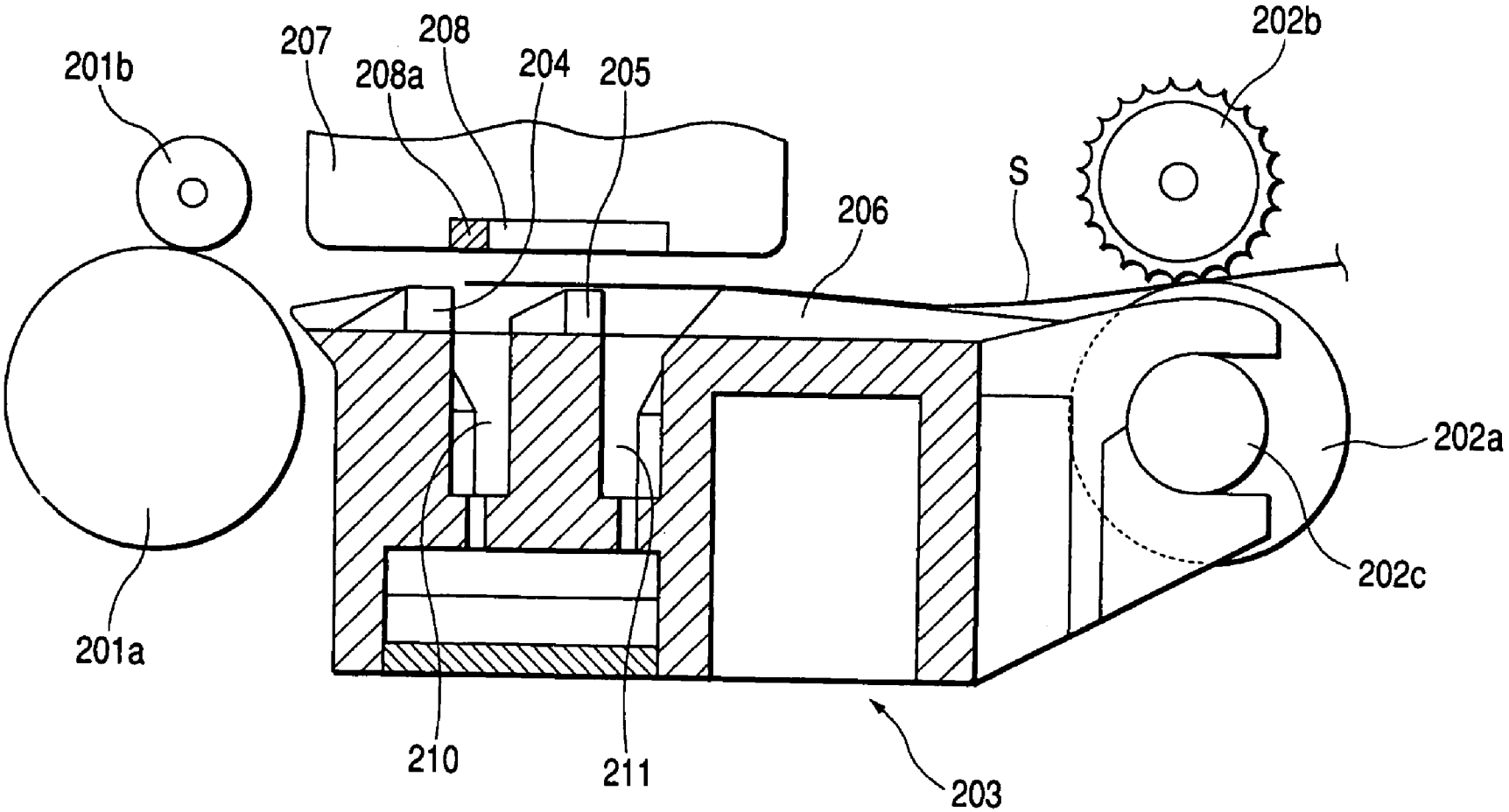
FIG. 11 is a sectional side view showing the recording section in the ink jet printer of FIG. 7, showing a condition that the marginless printing for a trailing end of a sheet is performed.

On the other hand, in the marginless printing at the trailing end of the sheet S, when the trailing end of the sheet S reaches the upper part of the groove hole 210 positioned on the upstream side in, the delivery direction as shown in FIGS. 10 and 11, only the part 208*a* of the nozzle array 208 is driven to eject ink onto the sheet S. Consequently, the ink drop deviated from the trailing end of the sheet S is disposed into the groove hole 210. Accordingly, the platen surface can be prevented from being contaminated with the ink.

Figure 15:
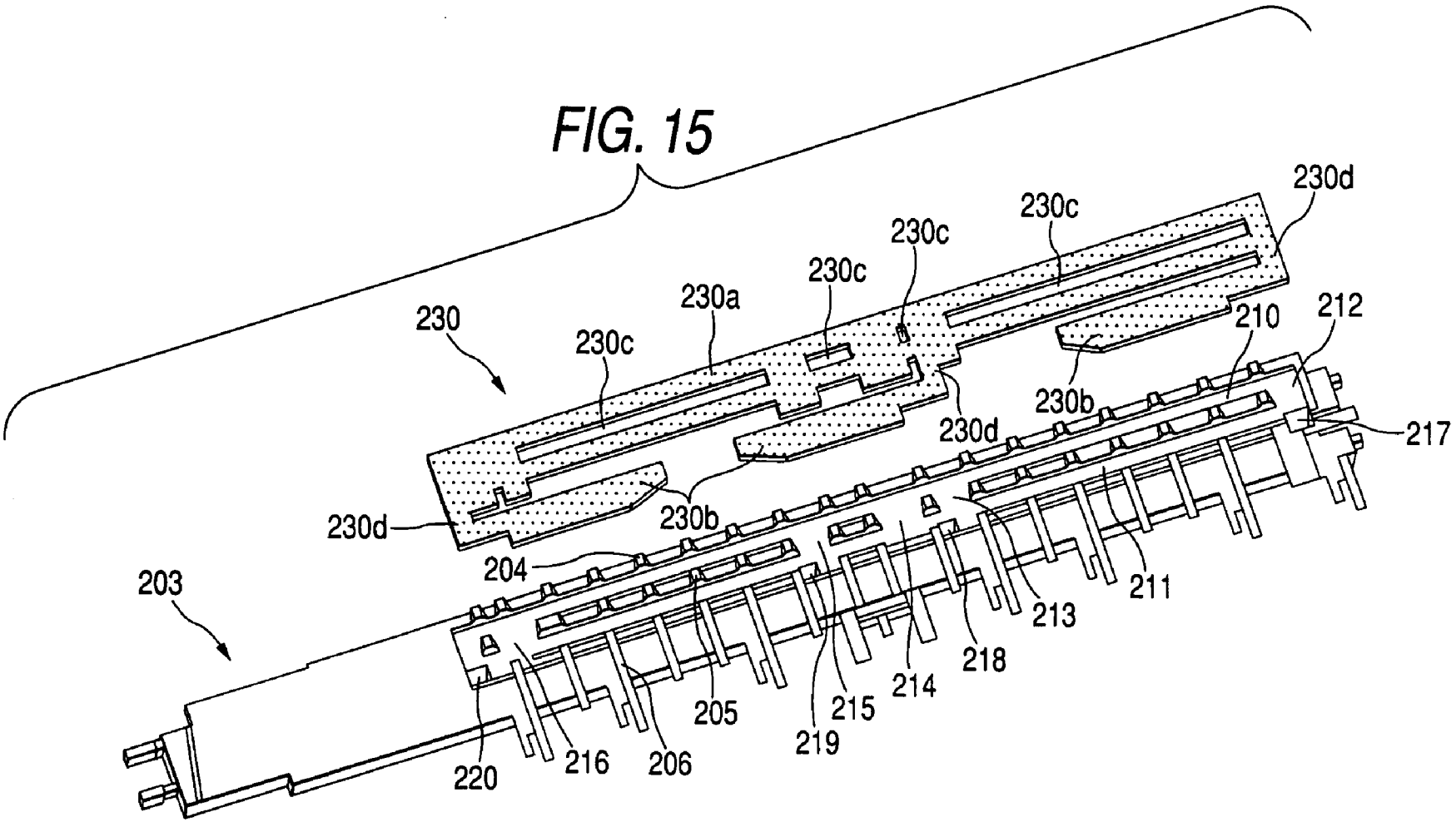
FIG. 15 is an exploded perspective view showing the appearance of a platen and a waste liquid absorber in the ink jet printer of FIG. 7.

In the marginless printing on both side ends of the sheet S, the groove holes 212 to 216 fulfill the same functions. More specifically, in the sheet S shown in a virtual line of FIGS. 8 and 10, the ink drop deviated from both side ends of the sheet S is disposed into the groove hole 212 and the groove hole 216. As shown in FIG. 15, moreover, the groove holes 212 to 216 are provided to be localized at a predetermined interval in the primary scanning direction. More specifically, the groove hole 212 is provided in a place through which one of the side ends of each of the sheets P having all sizes passes, and the groove holes 213 to 216 are provided in places through which the other side end of each of the sheets P having predetermined sizes (for example, an A4 size, a postcard size and an L-type photograph size having a width of 89 mm) passes. Accordingly, four-side marginless printing can be executed over the predetermined sheet sizes.

A sheet discharge roller including a sheet discharge driving roller 202*a* and a sheet discharge driven roller 202*b* is provided on the downstream side of the platen 203 as shown in FIG. 9. The sheet discharge driving roller 202*a* is provided on a roller shaft 202*c* to be rotated and driven by a driving motor (not shown) so as to be localized in the transverse direction of the sheet S, and the sheet discharge driven roller 202*b* is rotated in accordance with the rotation of the sheet discharge driving roller 202*b* via a contact with the sheet discharge driving roller 202*a*. The sheet S is nipped by the sheet discharge driving roller 202*a* and the sheet discharge driven roller 202*b* and the sheet discharge driving roller 202*a* is rotated so that the sheet S subjected to printing is ejected toward a discharged sheet stacker 225 (FIG. 7).

With reference to FIGS. 12 to 16, subsequently, detailed description will be given to a waste liquid treating device for treating ink drop disposed into the platen 203 by the marginless printing.

Figure 13:
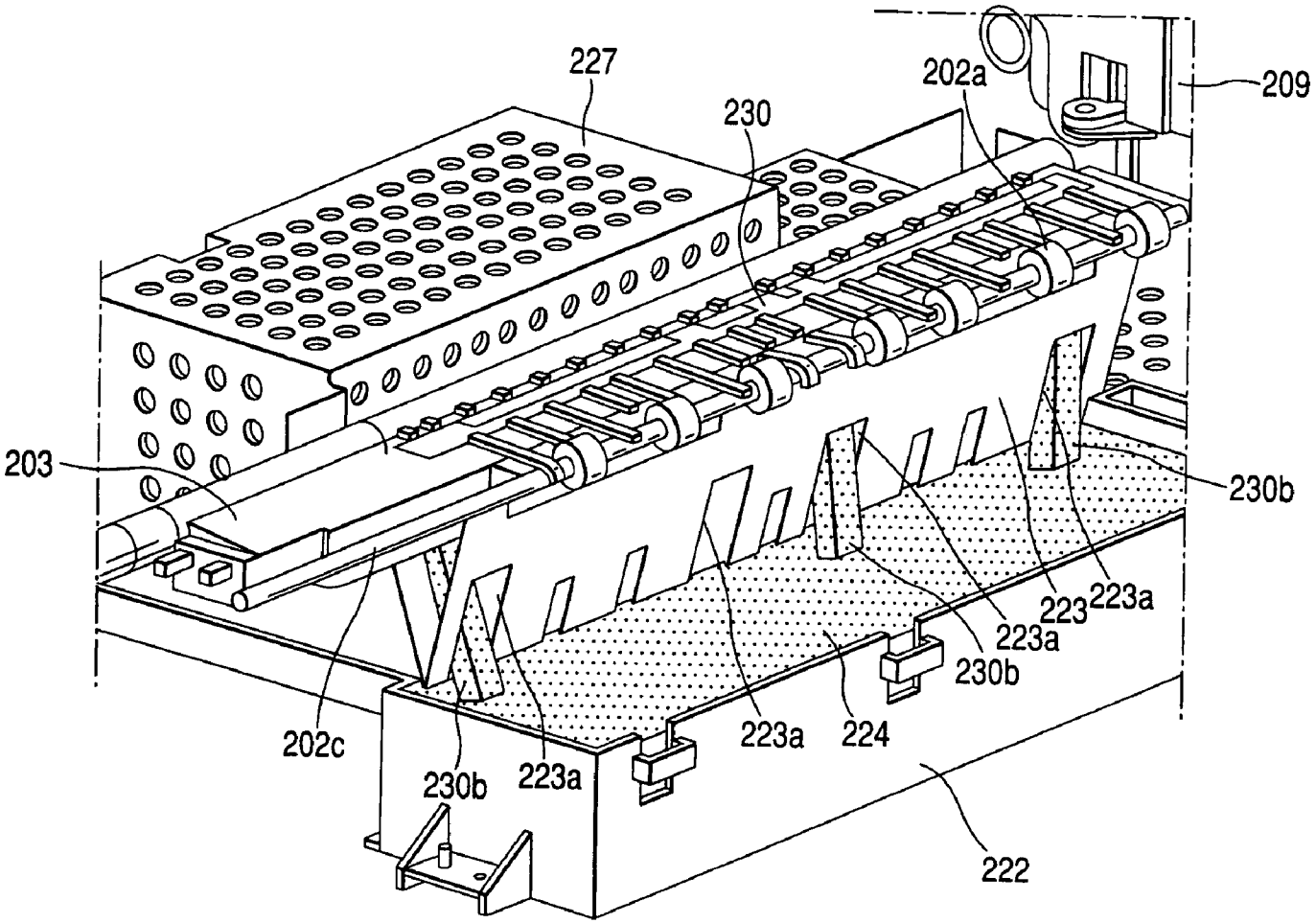
FIG. 13 is an enlarged perspective view showing the main part of the ink jet printer of FIG. 7.

The waste liquid treating device has a first waste liquid absorber shown in FIG. 15, a waste liquid tray 222 and a second waste liquid absorber 224 shown in FIG. 13, a liquid leading member 230*a*, and a guide member 223.

In FIG. 15, the first waste liquid absorber 230 is provided to be filled in the groove holes 210 to 216 formed in the platen 203 to first absorb the ink drop disposed into the groove holes 210 to 216. The first waste liquid absorber 230 may be formed by any material having a high ink absorbance and a high ink-resistance. For example, a synthetic fiber such as polyethylene terephthalate, acryl or rayon, a felt material formed of pulp or a porous material such as a sponge can be used. This is also common to the second waste liquid absorber 224 which will be described below. In the embodiment, a foaming soft material (a so-called sponge material: for example, a trade name of "Ever Light" manufactured by BRIDGESTONE CORPORATION) is used for the first waste liquid absorber 230.

The first waste liquid absorber 230 is provided with a plurality of holes 230*c* to keep away from the rib 205 formed on the platen 203. Consequently, all the groove holes 210 to 216 can be filled with a single and integrally formed first waste liquid absorber 230. Moreover, the first waste liquid absorber 230 is formed with a plurality of tongue piece sections 230*b* serving as a waste liquid leading member which will be described below.

As shown in FIG. 15, each of the tongue piece sections 230*b* is formed to be extended in the primary scanning direction through a connecting section 230*d*. The respective connecting sections 230*d* are formed at both ends of the first waste liquid absorber 230 and a portion shifted from a longitudinal center portion of the first waste liquid absorber 230 to the home position side (the right side in FIG. 15). When the first waste liquid absorber 230 is to be provided in the groove holes 210 to 216, the connecting section 230*d* is first wrenched and the tongue piece section 230*b* is thus set to be extended downward. Next, the tongue piece sections 230*b* are inserted into the through holes 217, 218 and 220 respectively continued from the groove holes 212, 213 and 216, and are thus caused to hang downward from the platen 203.

On the other hand, the waste liquid tray 222 which is elongated in the primary scanning direction and is almost-box shaped as shown in FIG. 13 is provided under the platen 203, and a second waste liquid absorber 224 is filled in the waste liquid tray 222 without a clearance. While the second waste liquid absorber 224 may be formed by any material having a high ink absorbance and a high ink-resistance, a nonwoven fabric (manufactured by OJI QUINOCROSS CO., LTD., for example) is used in the embodiment. The lower end of the liquid leading member 230*b* hanging down from the platen 203 is maintained in contact with the upper surface of the second waste liquid absorber 224 provided in the waste liquid tray 222 (see FIG. 14).

The ink drop disposed into the groove holes 210 to 216 of the platen 203 is first absorbed in the first waste liquid absorber 230 provided in the groove holes 210 to 216 and proceeds to the bottom portion of the first waste liquid absorber 230, and then passes the through holes 217, 218, 219 and 220 formed in the platen 203 and is then absorbed in the second waste liquid absorber 224 provided thereunder.

In the case in which the waste liquid leading member 230*b* is not provided, for example, the ink drop does not smoothly proceed from the first waste liquid absorber 230 toward the second waste liquid absorber 224 so that the ink drop is apt to stay in the bottom portion of the first waste liquid absorber 230. More specifically, although the first waste liquid absorber 230 has a high ink absorbance, it easily holds the absorbed ink drop so that the ink drop stays in the bottom portion of the first waste liquid absorber 230.

When the printer 200 is greatly inclined in such a state by the handling of a user or in transportation, for example, the ink drop held in the bottom portion of the first waste liquid absorber 230 would be collected into the end portions of the groove holes 210 and 211, more specifically, the groove hole 212 or 216 portion shown in FIG. 15. In the worst case, there is an anxiety that the ink drop might overflow out of the platen 203. If such a phenomenon arises, there is also an anxiety that the components of the printer 200 (for example, a driving system or an electric system) might be adversely affected, and furthermore, the ink might leak out of the printer 200, resulting in the contamination of the appearance of the printer 200.

Figure 14:
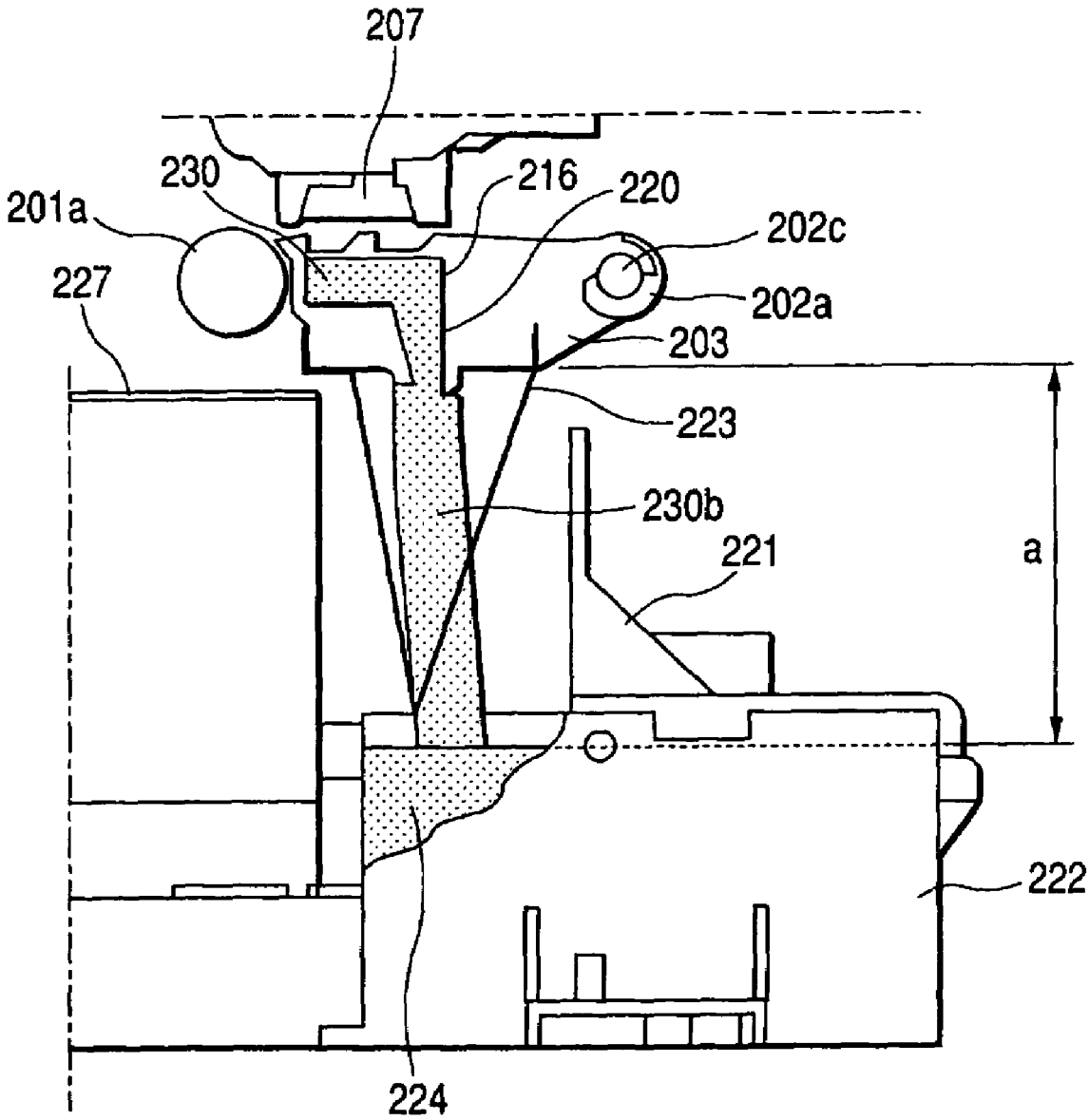
FIG. 14 is a sectional side view showing the main part of the ink jet printer of FIG. 7.

In the embodiment, therefore, the waste liquid leading member 230*b* is provided to hang downward from the through holes 217, 218 and 220 and the lower end thereof is caused to come in contact with the upper surface of the second waste liquid absorber 224 as shown in FIGS. 13 and 14. In this case, the liquid absorbance of the second waste liquid absorber 224 acts on the waste liquid leading member 230*b* and the first waste liquid absorber 230. Consequently, the ink drop does not stay in the bottom portion of the first waste liquid absorber 230 but smoothly proceeds to the second waste liquid absorber 224 side.

In other words, there is provided the waste liquid leading member 230*b* for reaching the upper surface of the second waste liquid absorber 224 from the groove holes 210 to 216 via the through holes 217, 218 and 220, thereby connecting the first waste liquid absorber 230 to the second waste liquid absorber 224 to smoothly lead the ink drop from the first waste liquid absorber 230 to the second waste liquid absorber 224. Also in the case in which the printer 200 is greatly inclined in handling or transportation, it is possible to eliminate a drawback that the ink drop staying in the bottom portion of the first waste liquid absorber 230 is collected into the end of the platen 203 and overflows to the outside. Thus, a safety can be maintained during the handling or the transportation.

In the case in which the platen 203 is provided in the printer 200 in such a manner that either the home position side or the away position side is inclined depending on precision in a component or precision in an assembly, the ink would be collected at the low position side so that the ink is apt to overflow as described above. Also in such a case, according to the embodiment, the ink drop is smoothly absorbed in the second waste liquid absorber 224 in the lower part. Consequently, the problem of the ink overflow described above can be solved more reliably.

In the embodiment, such a structure as to obtain advantages is further employed as will be described below. In the embodiment, a difference in a height (an interval "a" in FIG. 14) between the upper surface of the second waste liquid absorber 224 and the bottom portion of the platen 203 is approximately 40 to 50 mm. Accordingly, the waste liquid leading member 230*b* vertically hangs downward from the through holes 217, 218 and 220 almost straight as shown in FIG. 14. Consequently, the ink passing through the waste liquid leading member 230*b* forms a long water column so that force for leading the ink drop staying in the bottom portion of the first waste liquid absorber 230 to the second waste liquid absorber 224, that is, sucking force is increased still more. In the embodiment, accordingly, the ink can be led from the first waste liquid absorber 230 to the second waste liquid absorber 224 still more reliably.

The waste liquid leading member 230*b* is provided integrally with the first waste liquid absorber 230. As compared with the case in which the waste liquid leading member 230*b* and the first waste liquid absorber 230 are constituted separately, the waste liquid leading member 230*b* can be provided at a very low cost.

In the embodiment, the liquid absorbance of the second waste liquid absorber 224 is constituted to be higher than that of each of the first waste liquid absorber 230 and the waste liquid leading member 230*b*. Consequently, it is possible to increase such a degree (sucking force) that the second waste liquid absorber 224 draws the liquid from the first waste liquid absorber 230 and the waste liquid leading member 230*b*. Accordingly, the liquid can be led from the first waste liquid absorber 230 to the second waste liquid absorber 224 still more reliably. The "high liquid absorbance" implies that the capillary action of the second waste liquid absorber 224 is more remarkable than that of each of the first waste liquid absorber 230 and the waste liquid leading member 230*b* and the liquid is absorbed in the same amount within a wider range.

Figure 16:
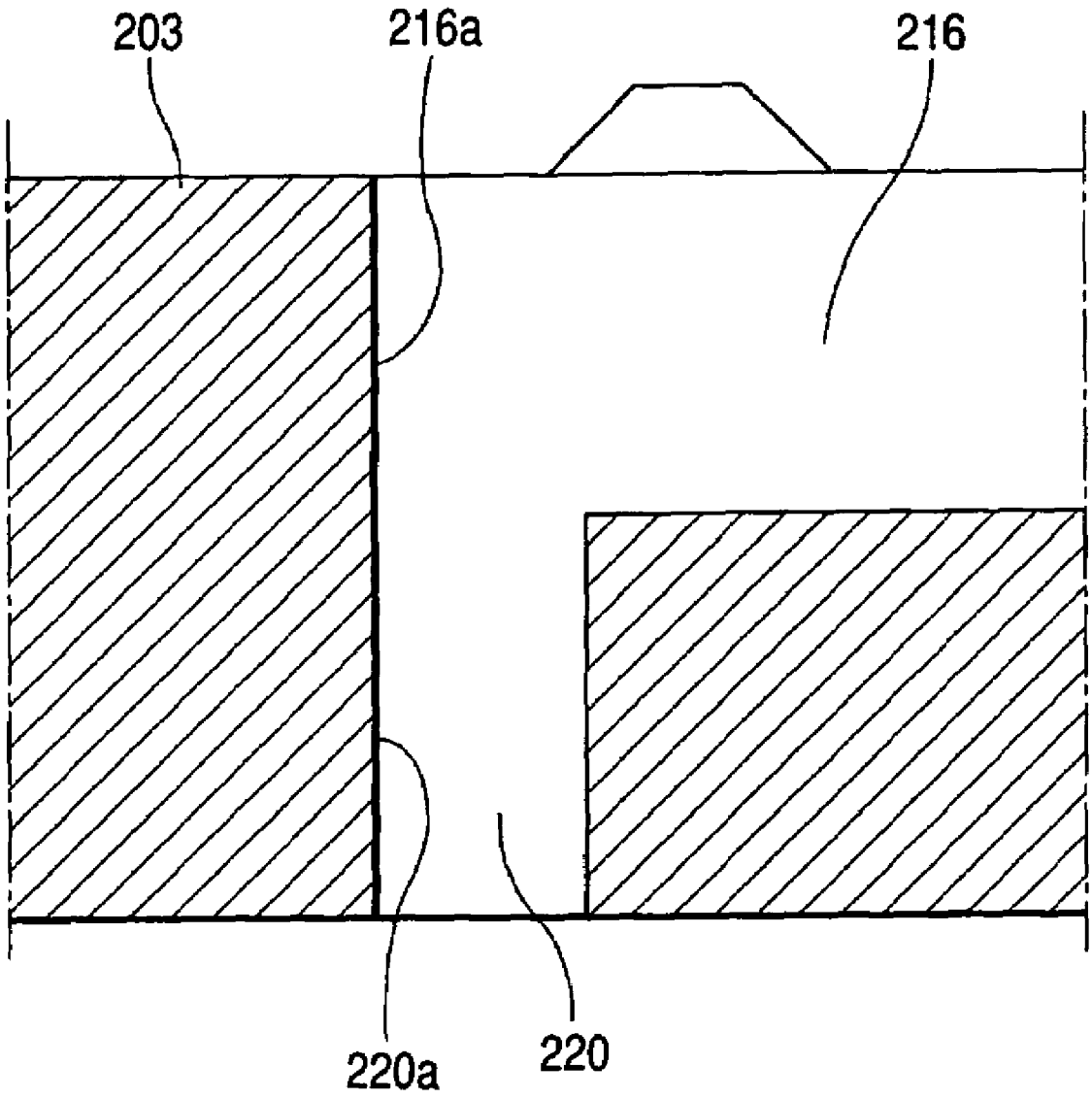
FIG. 16 is an enlarged section view showing the platen in the ink jet printer of FIG. 7.

The through holes 217 and 220 are provided on both ends of the groove holes 210 and 211 extended in the primary scanning direction and the internal wall surfaces of the through holes 217 and 220 are made flush with the side walls of both ends of the groove holes 210 and 211 (the side walls of the groove holes 212 and 210), and the waste liquid leading member 230*b* is provided to reach the upper surface of the second waste liquid absorber 224 along the side walls of both ends of the groove holes 210 and 211 (the side walls of the groove holes 212 and 216) and the internal wall surfaces of the through holes 217 and 220 linked to the side walls. FIG. 16 shows, as a typical example, the sections of the groove hole 216 and the through hole 220.

As shown in this figure, a side wall 216*a* of the groove hole 216 and a side wall 220*a* of the through hole 220 are made flush with each other. The waste liquid leading member 230*b* is provided to hang downward along the side wall 216*a* and the side wall 220*a* (which is not shown in FIG. 16). In other words, in the case in which the printer 200 is greatly inclined in such a manner that the groove hole 216 side is set into the lower side, the ink would be collected into the groove hole 216. At this time, if the side wall 220*a* of the through hole 220 is positioned in an upper part than the side wall 216*a* of the groove hole 216 (the right side in FIG. 16), for example, an ink staying portion having the side wall 216*a* to be a bottom portion is formed. Consequently, there is an anxiety that the ink might overflow from the staying portion.

In order to eliminate the ink staying portion when the printer 200 is inclined in this way, the side wall 220*a* of the through hole 220 is made flush with the side wall 216*a* of the groove hole 216, and the waste liquid leading member 230*b* is provided in the same portion. Consequently, it is possible to reliably solve the problem of the ink overflow described above. In the embodiment, furthermore, the first waste liquid absorber 230 is provided to reliably cause an end face thereof to come in contact with the side wall 216*a* of the groove hole 216 (which is not shown). Consequently, the ink is smoothly led downward in the same manner.

The platen 203 is provided with the through holes 218 and 219 in the positions slightly shifted from the longitudinal center portion toward the home position side in addition to the through holes 217 and 220 on both longitudinal ends, and the waste liquid leading member 230*b* is provided in the through hole 218. Consequently, the ink drop disposed into the groove holes 210 to 216 can be led to the second waste liquid absorber 224 (the waste liquid tray 222) still more smoothly in the case in which the printer 200 is usually installed in a horizontal state to be used as well as the case in which the printer 200 is inclined.

As shown in FIGS. 13 and 14, the guide member 223 is provided under the platen 203. The guide 223 is formed by bending a transparent and flexible sheet material to have an almost V shape seen from a side as shown in FIG. 14, and has an elongated shape in the primary scanning direction in the same manner as the platen 203. An upper end of the guide member 223 is fixed to the platen 203.

A plurality of slits 223*a* extended in a vertical direction as shown in FIG. 13 are formed on the side wall at the front side (the right side of FIG. 14) at a predetermined interval in the longitudinal direction (the primary scanning direction) of the platen 203. Each of the slits 223*a* is formed in a place which is almost coincident with the position in which the waste liquid leading member 230*b* hanging downward from the platen 203 is provided, so that the waste liquid leading member 230*b* is inserted through the slit 223*a* to reach the upper surface of the second waste liquid absorber 224 as shown in FIG. 13.

Accordingly, the attitude and position of each waste liquid leading member 230*b* hanging downward is restrained by each slit 223*a*. Consequently, the attitude and position of each waste liquid leading member 230*b* is not changed but determined uniformly without the influence of a variation in an assembly or a vibration generated by transportation.

More specifically, the lower end of the waste liquid leading member 230*b* comes in contact with the upper surface of the second waste liquid absorber 224 so that the ink is led from the first waste liquid absorber 230 to the second waste liquid absorber 224. If the lower end of the waste liquid leading member 230*b* does not come in contact with the upper surface of the second waste liquid absorber 224 due to the variation in an assembly or the vibration generated by the transportation, for example, the above described advantages cannot be obtained. However, the attitude and position of each liquid leading member 230*b* is restrained by the guide member 223 (the slits 223*a*). Consequently, the ink can be always led reliably from the first waste liquid absorber 230 to the second waste liquid absorber 224.

As shown in FIGS. 13 and 14, an electronic unit 227 is provided on the rear side of the guide member 223. The electronic unit 227 is formed by a housing having an electromagnetic shielding property. When the waste liquid leading member 230*b* wetted with the ink drop comes in contact with the electronic unit 227, the ink drop might enter the electronic unit 227, resulting in a deterioration in the electrical characteristic of the electronic unit 227. However, the slits 223*a* are formed on only the wall surface at the front side of the sheet material bent to have the almost V shape and is not formed on the wall surface at the rear side (the left side of FIG. 14). Consequently, the waste liquid leading member 230*b* does not come in contact with the electronic unit 227. Thus, the electrical characteristic of the electronic unit 227 is not deteriorated.

Figure 12:
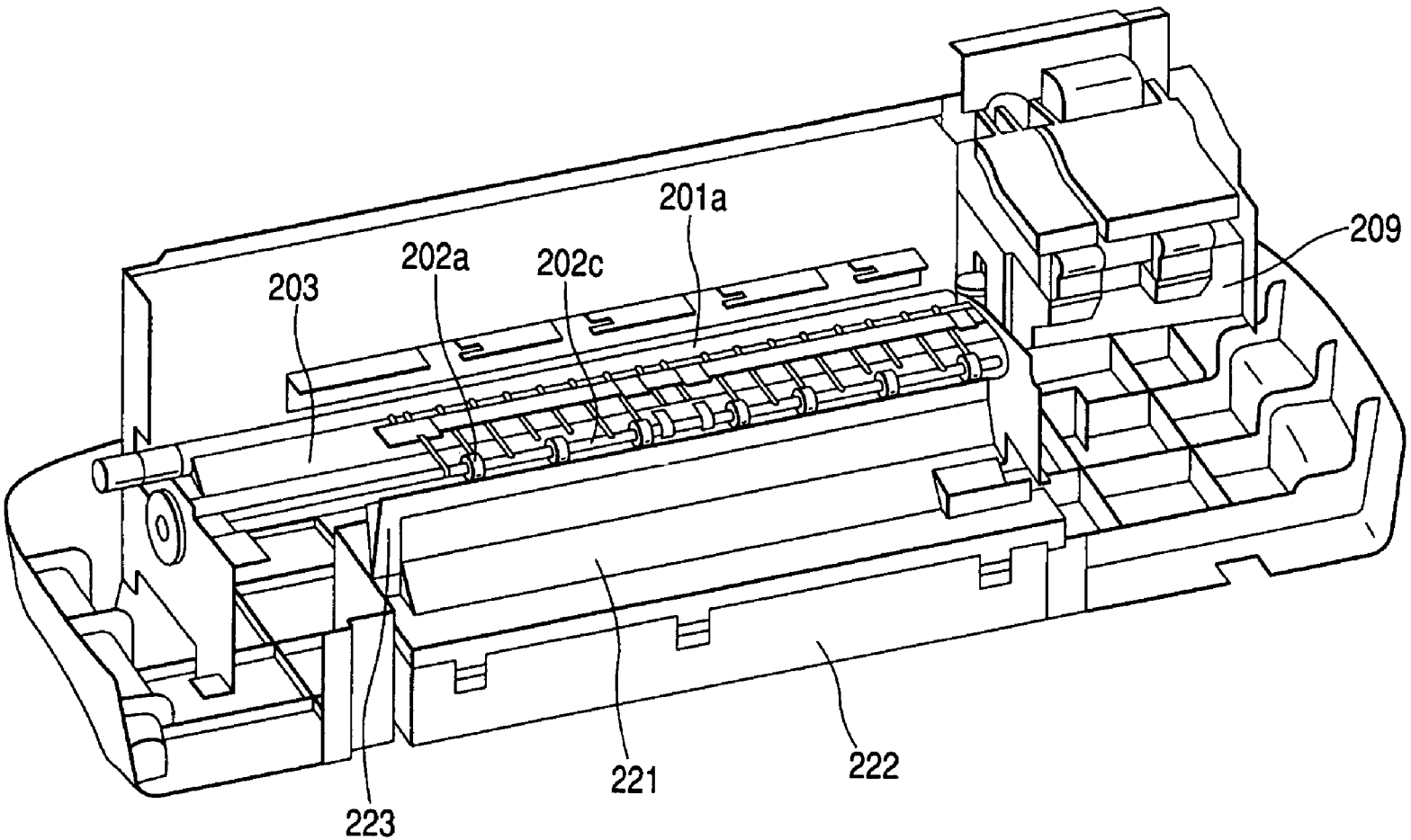
FIG. 12 is a perspective view showing the appearance of a main part of the ink jet printer of FIG. 7.

Moreover, a cover member 221 for covering the upper part of the waste liquid tray 222 is provided on the front side of the guide member 223 as shown in FIGS. 12 and 14. Therefore, the amount of forward movement of the guide member 223 is regulated so that the attitude and position of the waste liquid leading member 230*b* can be held still more reliably.

Figure 17:
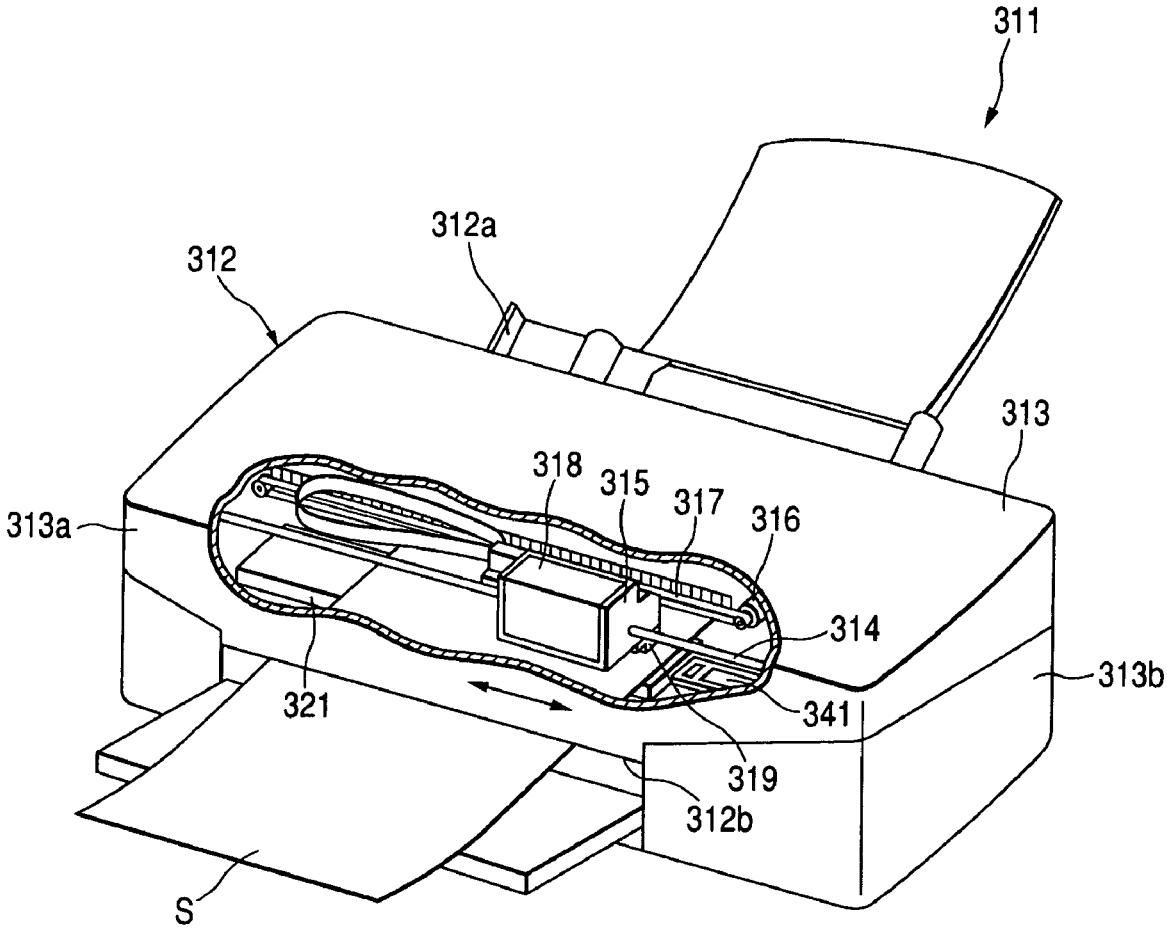
FIG. 17 is a partially broken perspective view showing the appearance of an ink jet printer according to a third embodiment of the invention.

Next, a third embodiment of the invention will be described with reference to FIGS. 17 to 20. As shown in FIG. 17, an ink jet printer 311 as a liquid ejecting apparatus comprises a printer body 312 and a feeder 312*a* provided on the rear side of the printer body 312. Sheets S stacked on the feeder 312*a* are fed into the printer body 312 one by one.

The printer body 312 includes a case 313 having the shape of an almost rectangular parallelepiped and a carriage guide shaft 314 is provided between both of left and right side plates 313*a* and 313*b* of the case 313. A carriage 315 is slidably supported on the carriage guide shaft 314. The carriage 315 is coupled to a carriage motor 316 through a timing belt 317 and is driven in a direction of an arrow in the drawing, that is, a primary scanning direction by the driving operation of the carriage motor 316.

Moreover, an ink cartridge 318 for storing ink (liquid) is removably attached to the upper side of the carriage 315, and a recording head 319 as a liquid ejecting head for receiving the supply of ink from the ink cartridge 318 is provided on the lower side of the carriage 315. The recording head 319 includes a nozzle driving member formed by a piezoelectric vibrator (which is not shown) and serves to eject an ink drop downward from a nozzle formation surface (not shown) based on the vibrating action of the nozzle driving member.

Figure 18:
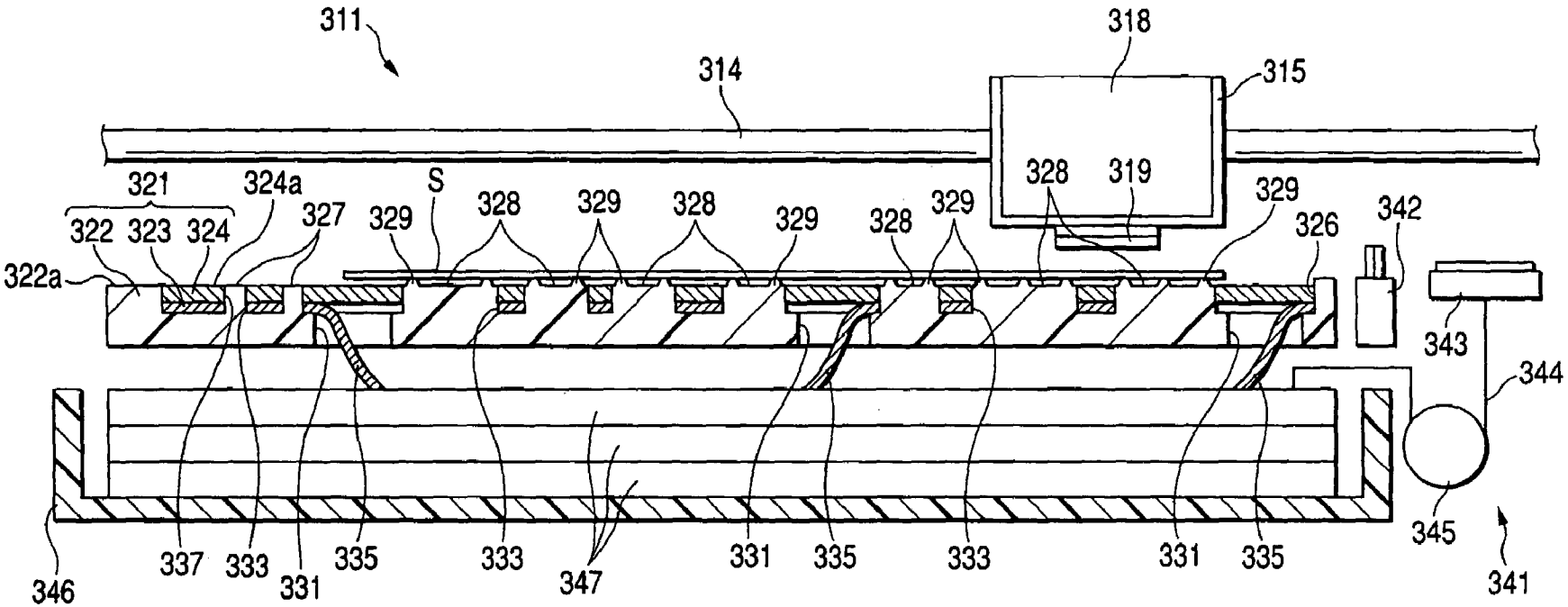
FIG. 18 is a transverse section view showing a main part of the ink jet printer of FIG. 17.

As shown in FIGS. 17 and 18, moreover, a platen 321 is provided in parallel with the carriage guide shaft 314 under a portion in which the recording head 319 is to be scanned. The sheet S fed by the feeder 312*a* is guided onto the platen 321, and is delivered by a sheet feeding member (not shown) in a secondary scanning direction which is orthogonal to the scanning direction of the carriage 315, and the ink is ejected from the recording head 319 over the platen 321 so that a character and an image are printed on the sheet S.

Figure 19:
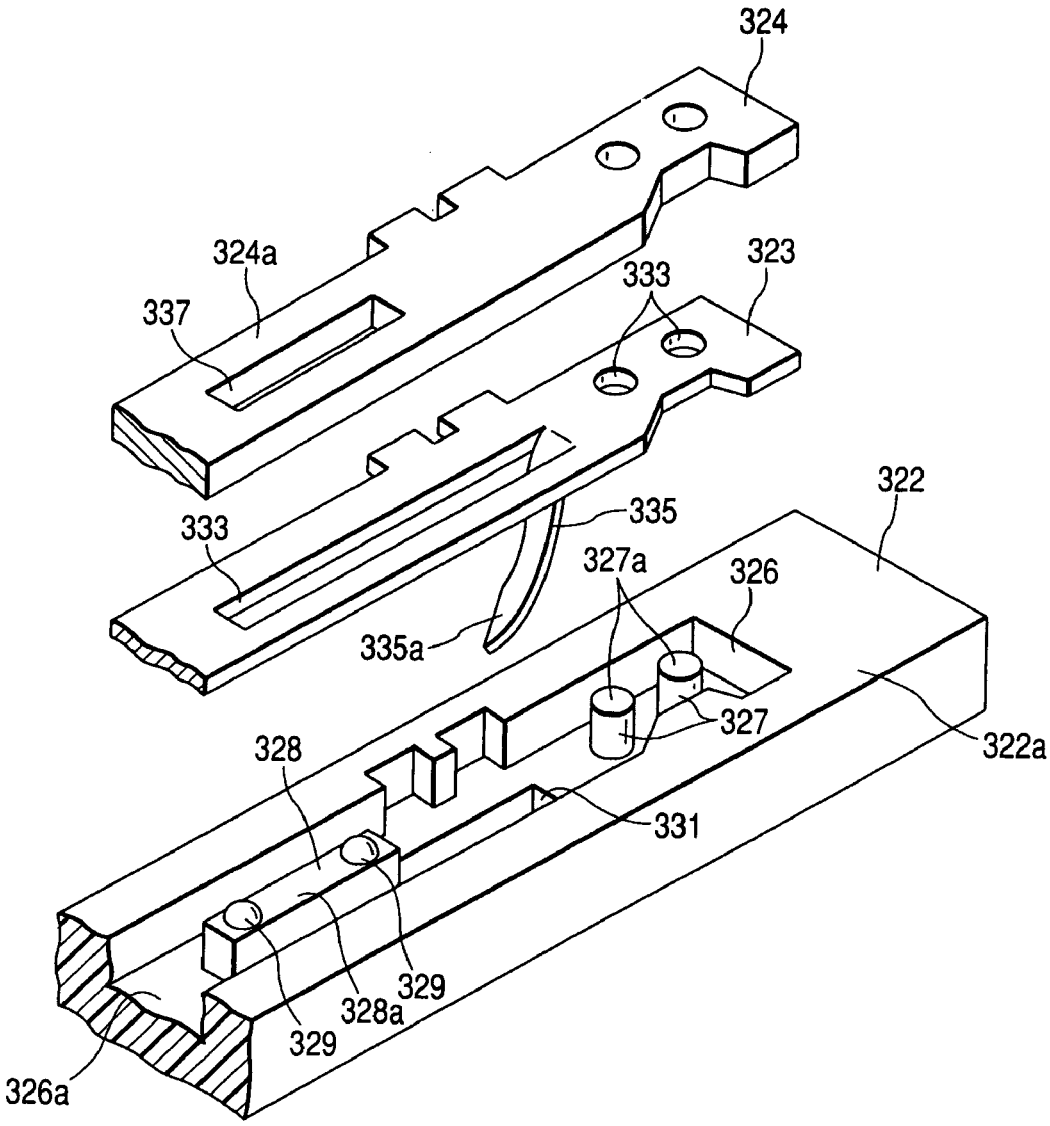
FIG. 19 is an exploded perspective view showing a platen and waste ink absorbers in the ink jet printer of FIG. 17.
Figure 20:
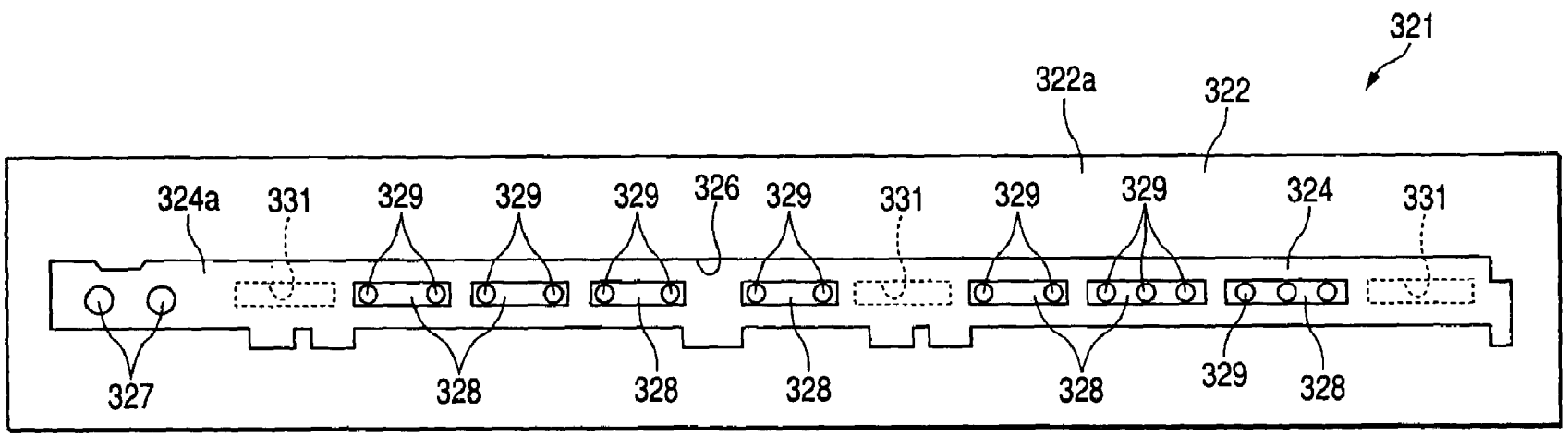
FIG. 20 is a plan view showing the platen in the ink jet printer of FIG. 17.

As shown in FIG. 18, the platen 321 is constituted by a platen base 322 to be a plate-shaped base member, a first liquid absorber 324 and a third liquid absorber 323. More specifically, as shown in FIGS. 19 and 20, the platen base 322 is formed of resin and formed with a concaved portion 326 having the shape of an almost rectangular parallelepiped on an upper surface 322*a*. The concave portion 326 is provided in such a size as to include the movable range of the recording head 319 in the primary scanning direction.

A plurality of cylindrical convex portions, 327 and a plurality of rectangular parallelepiped-shaped convex portions 328 are protruded upward from a bottom surface 326*a* of the concave portion 326. An upper surface 327*a* of the cylindrical convex portion 327 and an upper surface 328*a* of the rectangular parallelepiped-shaped convex portion 328 have a height which is coincident with the upper surface 322*a* of the platen base 322. Moreover, two or three hemispherical portions 329 are provided on the upper surface 328*a* of each of the rectangular parallelepiped-shaped convex portions 328. In the platen base 322, accordingly, the upper end of the hemispherical portion 329 is placed in the highest position.

Furthermore, the platen base 322 includes a through hole 331 having an almost rectangular section to penetrate through the bottom surface 326*a* of the concave portion 326. Three through holes 331 are arranged in the primary scanning direction as shown in FIG. 18.

The printer 311 according to this embodiment can carry out marginless printing. In FIG. 18, the through hole 331 formed on the rightmost side is provided in such a position as to receive an excessive ink deviated from the right edge of the sheet S when the marginless printing is executed. Moreover, two other through holes are provided in such positions as to receive an excessive ink deviated from the left edge of the sheet S when the sheet S having a rated size, for example, an A4 size or a postcard size is guide onto the platen 321. The sheet S shown in FIG. 18 has the A4 size and the margin of the sheet S overlaps with the through hole 331 on the leftmost side. The structure of the platen base 322 has conventionally been used.

The third liquid absorber 323 is formed by a porous material having a great sucking force and has an outer shape in a plane direction which is almost coincident with the concave portion 326 of the platen base 322. Moreover, a thickness is approximately a quarter of the whole depth of the concave portion 326 of the platen base 322. As shown in FIG. 20, the third liquid absorber 323 has an opening portion 333 in such positions as to overlap with the cylindrical convex portion 327 and the rectangular parallelepiped convex portion 328 of the platen base 322. The above structure has conventionally been employed.

In addition to the conventional structure, moreover, the third liquid absorber 323 is newly provided with a plurality of tongue piece sections (waste liquid leading members) 335 in such positions as to overlap with three through holes 331 provided in the platen base 322. Each of the tongue piece sections 335 is formed by providing an U-shaped slit in the third liquid absorber 323 and then bending a portion inside the slit downward.

Moreover, a tip 335*a* of each tongue piece section 335 is cut obliquely with respect to the scanning direction of the carriage 315.

The third liquid absorber 323 is fitted in the concave portion 326 with the convex portions 327 and 328 penetrating through the opening portions 333. Moreover, the third liquid absorber 323 causes each tongue piece section 335 to hang downward via each of the through holes 331 of the platen base 322 in a fitting state in the concave portion 326 (see FIG. 18).

The first liquid absorber 324 is formed by a porous material having a lower density than the third liquid absorber 323 and has an outer shape in a plane direction which is almost coincident with the concave portion 326 of the platen base 322. Moreover, a thickness is approximately three quarters of the whole depth of the concave portion 326 of the platen base 322. The first liquid absorber 324 has an opening portion 337 in such positions as to overlap with the cylindrical convex portion 327 and the rectangular parallelepiped-shaped convex portion 328 of the platen base 322. The first liquid absorber 324 is fitted in the concave portion 326 to be superposed on the third liquid absorber 323 in such a state that the convex portions 327 and 328 penetrate through the opening portions 337.

Accordingly, the platen 321 is constituted by sequentially fitting the third liquid absorber 323 and the first liquid absorber 324 in the concave portion 326 of the platen base 322. In this case, as shown in FIG. 18, the upper surface 322*a* of the platen base 322 is positioned on almost the same level with an upper surface 324*a* of the first liquid absorber 324. As a result, only the hemispherical portion 329 formed on the rectangular parallelepiped-shaped convex portion 328 of the platen base 322 is protruded from the upper surface of the platen 321, and the sheet S guided onto the platen 321 is supported by the hemispherical portion 329 to form a predetermined sheet gap with the recording head 319.

As shown in FIG. 17, moreover, the printer 311 comprises a capping member 341 in a non-print region (a home position). The capping member 341 includes a wiping member 342, a cap 343, a sucking tube 344 connected to the cap 343, and a sucking pump 345 provided in the middle of the sucking tube 344 as shown in FIG. 18.

The wiping member 342 is provided on the print region side of the cap 343 and is constituted to sweep and clean the nozzle formation surface of the recording head 319 if necessary. The cap 343 is constituted to seal the nozzle formation surface of the recording head 319 of the carriage 315 moved to the home position, and serves as a cover member, for preventing the nozzle formation surface of the recording head 319 from being dried for the deactivated period of the printer 311.

Moreover, the sucking pump 345 can apply a negative pressure into the cap 343 sealing the nozzle formation surface through the sucking tube 344, so that ink is sucked out from nozzle orifices, thereby carrying out cleaning for recovering the ink ejecting capability of the recording head 319.

Furthermore, the printer 311 comprises a waste liquid tank 346 having an upper side opened at a lower bottom part in the case 313. A plurality of second waste liquid absorber 347 formed by a porous material are stacked in the waste liquid tank 346. The end of the sucking tube 344 of the capping member 341 is positioned in the waste liquid tank 346 and the ink generated during the cleaning is fed into the waste liquid tank 346 and is absorbed and held in the second waste liquid absorber 347. The waste liquid tank 346 and the second waste liquid absorber 347 are positioned just below the platen 321, and furthermore, has such a size as to include a whole region in the longitudinal direction of the platen 321.

A distance between the platen 321 and the waste liquid tank 346 is set in such a manner that each tongue piece section 335 of the third liquid absorber 323 comes in contact with the upper surface of the second waste liquid absorber 347. Moreover, the second waste liquid absorber 347 has a higher absorbance than the third liquid absorber 323 so that the liquid absorbed in the third liquid absorber 323 is easily moved to the second waste liquid absorber 347 through the tongue piece sections 335.

By the above structure, accordingly, in the case in which marginless printing for setting vertical and transverse margins to be zero is carried out in the printer 311, an ink drop ejected to a position deviated from the edge of the sheet S is caused to fly toward the first liquid absorber 324 of the platen 321. The ink drop is captured and absorbed by the first liquid absorber 324 and is then moved toward the third liquid absorber 323 provided on the lower side which has a higher absorbance.

The first liquid absorber 324 is formed by a porous material having a relatively lower density. Therefore, the ink is moved quickly to the third liquid absorber 323 so that the generation of an ink mist can be suppressed as greatly as possible in the vicinity of the surface of the first liquid absorber 324.

The ink moved to the third liquid absorber 323 is moved to the second waste liquid absorber 347 through the tongue piece sections 335 of the third liquid absorber 323. Each tongue piece section 335 is provided in a position overlapping with the through hole 331 of the platen base 322, that is, a position in which the ink deviated from the edge on the right side and the edge on the left side in the sheet S is concentrated in the platen 321. Accordingly, the ink is easily collected into the tongue piece sections 335 and is thus moved easily to the second waste liquid absorber 347. Then, the ink is held in the second waste liquid absorber 347 having a high water-holding property and hardly flows to the outside even if the printer 311 is inclined by mistake due to transportation between users.

In the embodiment, the through holes 331 are provided on the platen base 322 of the platen 321 to insert the tongue piece sections 335 and to cause the tongue piece sections 335 to come in contact with the second waste liquid absorber 347.

Accordingly, the ink disposed from the recording head 319 beyond the sheet S is absorbed in the tongue piece sections 335 and is absorbed in the second waste liquid absorber 347 via the through hole 331. As a result, the ink is quickly moved to the second waste liquid absorber 347 through the tongue piece sections 335 so that a time taken for a stay on the platen 321 is shortened. In the case in which the tongue piece sections 335 are not provided, the ink stays on the platen 321 until the absorption limits of the first absorber and the second absorber are reached. In the embodiment, however, the ink is moved to the second waste liquid absorber 347 before the absorption limit is reached. As a result, even if the printer 311 is inclined due to the transportation between users, the ink can be prevented from leaking out of the platen 321.

In the embodiment, the tongue piece sections 335 and the second waste liquid absorber 347 are provided separately and the waste liquid absorber which has conventionally been used can be exactly used. Therefore, it is not necessary to considerably change the design of the printer 311.

In the embodiment, the tongue piece sections 335 are formed by cutting and bending the third waste liquid absorber 323 in a position of the platen base 322 overlapping with the through hole 331.

Accordingly, it is possible to easily form the tongue piece sections 335 by slightly processing the third liquid absorber 323 which has conventionally been used. Therefore, it is not necessary to considerably change the design of the printer 311.

In the embodiment, the third liquid absorber 323 and the first liquid absorber 324 have such sizes as to include the moving range of the recording head 319. When the size of the sheet S is included in the moving range of the recording head 319, accordingly, the disposed ink can be reliably absorbed in each of the liquid absorbers 323 and 324 even if the ejected ink is deviated from all the edges of the sheet S, that is, so-called overall marginless printing is carried out.

In the embodiment, the third liquid absorber 323 and the first liquid absorber 324 are fitted in the concave portion 326 of the platen base 322. In a state in which each of the liquid absorbers 323 and 324 is fitted, the hemispherical portion 329 of the platen base 322 is placed in the highest position. When the sheet S is supported on the platen 321, accordingly, a gap can be formed by the hemispherical portion 329 between the sheet S and the first liquid absorber 324 so that they can be prevented from coming in contact with each other. As a result, the sheet S can be prevented from being contaminated with the ink absorbed in each of the liquid absorbers 323 and 324.

In the embodiment, the tip 335*a* of each tongue piece section 335 is cut obliquely with respect to the scanning direction of the carriage 315. Accordingly, the capillary action can easily be generated between each tongue piece section 335 and the second waste liquid absorber 347 so that the ink absorbed in the tongue piece sections 335 can easily be moved to the second waste liquid absorber 347.

In the embodiment, the second waste liquid absorber 347 has a higher absorbance than the third liquid absorber 323. Accordingly, the ink absorbed in the tongue piece sections 335 can easily be absorbed in the second waste liquid absorber 347. As a result, even if the printer 311 is inclined due to the transportation between users, the ink can be prevented from leaking out of the printer 311. Consequently, the time in which the liquid stays in each of the liquid absorbers 323 and 324 is shortened so that the ink can be prevented from being dried and solidified in each of the liquid absorbers 323 and 324.

In the embodiment, the platen 321 is provided with two kinds of waste liquid absorbers, that is, the third liquid absorber 323 and the first liquid absorber 324. Accordingly, a mist generated by the ink disposed into the platen 321 can easily be absorbed by the first liquid absorber 324 formed by a material having a relatively lower density. As a result, the generation of the mist can be decreased. Moreover, the ink can easily be moved by the capillary action from the first liquid absorber 324 having the relatively lower density to the third liquid absorber 323 formed by a material having a relatively higher density. As a result, the ink can be quickly moved to the tongue piece sections 335 of the third liquid absorber 323. Thus, the ink can be moved to the second waste liquid absorber 347 more reliably.

In the embodiment, the through holes 331 formed on the platen base 322 are provided in the positions overlapping with the edges on the left and right sides of the sheet S having a rated size.

Accordingly, the through holes 331 and the tongue piece sections 335 are provided in a place in which the ink can easily be disposed, that is, a place in which the disposed ink tends to be concentrated. Thus, the ink can efficiently be moved toward the second waste liquid absorber 347 side.

The embodiment may be modified in the following manner.

While each tongue piece section 335 is formed by providing a U-shaped slit in the third liquid absorber 323 and bending a portion inside the slit downward in the embodiment, it may be formed to have another shape. Moreover, each tongue piece section 335 is not integrated with the third liquid absorber 323 but may be provided separately therefrom and may be thus attached to the third liquid absorber 323 by connecting means such as an adhesive.

Furthermore, each tongue piece section 335 is not formed by cutting out the third liquid absorber 323 but may be formed by molding simultaneously with the molding of the third liquid absorber 323.

In the embodiment, each of the liquid absorbers 323 and 324 has such a size as to include the moving range of the recording head 319. They may be provided partially.

While the tip 335*a* of the tongue piece section 335 is cut out acutely in the embodiment, it does not need to be cut out.

Although the second waste liquid absorber 347 has a higher absorbance than the third liquid absorber 323 including the tongue piece section 335 in the embodiment, it may have an equal or lower absorbance.

While the third liquid absorber 323 and the first liquid absorber 324 having different densities are provided as the liquid absorbers in the embodiment, at least three kinds of waste liquid absorbers may be used. Moreover, only one kind of waste liquid absorber may be used.

In the embodiment, the through hole 331 of the platen base 322 and the tongue piece sections 335 are provided in the positions overlapping with the edges on the left and right sides of the sheet S having a rated size. They may be provided in non-overlapping positions. While the number is set to be three, moreover, another number may be employed.

Next, an ink jet recording apparatus 410 as a liquid ejecting apparatus according to a fourth embodiment of the invention will be described with reference to FIGS. 21 to 27.

The ink jet recording apparatus 410 comprises a tray 412 for mounting a target medium 420 thereon, a feeder 414 for feeding the target medium 420 mounted on the tray 412 to a recording region, and a ejector 416 for ejecting the target medium 420 from the recording region.

The ink jet recording apparatus 410 further comprises: a recording head 4100 schematically shown in FIG. 22 which serves to eject ink in a direction of an arrow Z of FIG. 21 in the recording region; a carriage 4200 for reciprocating in a primary scanning direction shown in an arrow X of FIG. 21; and an ink absorber 4300 (first waste liquid absorber) and an holder 4400 which are provided below the scanning region of the recording head 4100. As shown in FIG. 22, the recording head 4100 has nozzle arrays 4100C, 4100M and 4100Y for ejecting cyan, magenta and yellow ink respectively.

Figure 21:
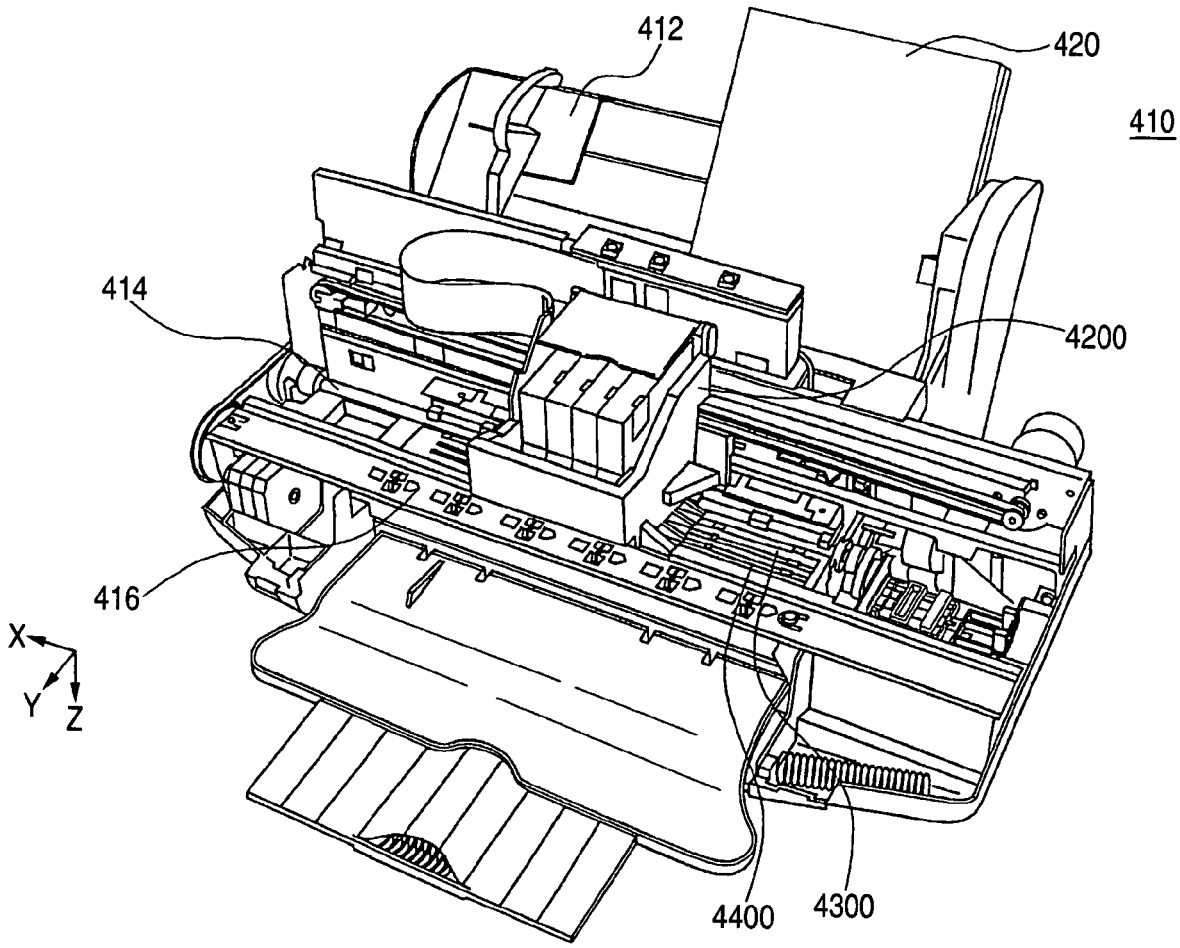
FIG. 21 is a perspective view showing an ink jet recording apparatus according to a fourth embodiment of the invention.
Figure 22:
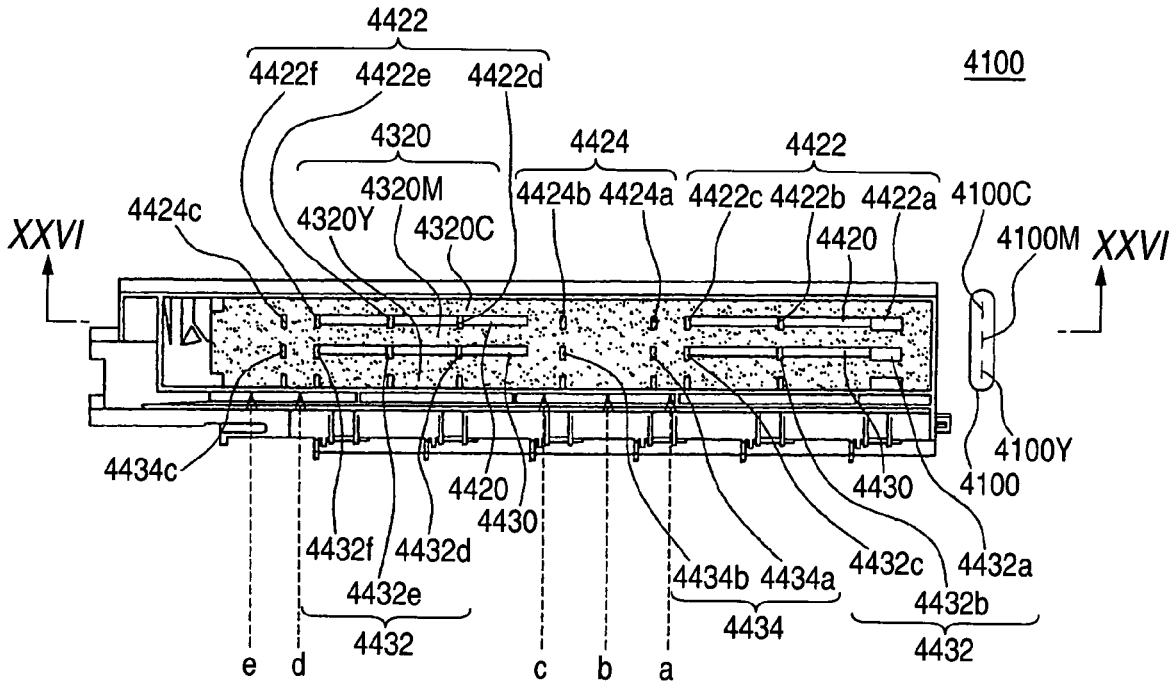
FIG. 22 is a plan view showing an ink absorber and a holder for holding the ink absorber which are incorporated in the ink jet recording apparatus of FIG. 21.

In the ink jet recording apparatus 410 shown in FIG. 21, the feeder 414 delivers the target medium 420 mounted on the tray 412 in a delivery direction shown in an arrow Y. In a case where the target medium 420 is delivered to the recording region on the holder 4400, the holder 4400 defines a distance between the target medium 420 delivered to the recording region and the recording head 4100. Furthermore, the carriage 4200 mounting the recording head 4100 reciprocates in the primary scanning direction, and at the same time, the recording head 4100 ejects the ink to the target medium 420, thereby carrying out recording over the target medium 420. The ejector 416 further delivers the target medium 420 subjected, to the recording in the delivery direction, thereby ejecting the target medium 420 from the recording region.

In a case where the recording is to be carried out without a margin at the side end of the target medium 420, the recording head 4100 ejects the ink to an outside from the side end of the target medium 420 to be discarded. The ink absorber 4300 is provided below the scanning direction of the recording head 4100 and thus absorbs the ink discarded to the outside of the side end of the target medium 420. If the amount of the ink held in the ink absorber 4300 is large, an ability for holding the ink absorbed once therein might be reduced and the ink might soak out of the ink absorber 4300 to contaminate the target medium 420 and the exterior of the ink jet recording apparatus 410.

As shown in FIG. 22, the holder 4400 is provided with a plurality of ribs 4422 and 4432 aligned with each other in the delivery direction of the target medium 420 (the Y-direction in FIG. 21). In this embodiment, the rib 4422 includes ribs 4422*a*, 4422*b*, 4422*c*, 4422*d*, 4422*e* and 4422*f* which are aligned with each other in the primary scanning direction of the carriage 4200 (the X-direction in FIG. 21). The rib 4432 includes ribs 4432*a*, 4432*b*, 4432*c*, 4432*d*, 4432*e* and 4432*f* which are aligned with the ribs 4422*a*, 4422*b*, 4422*c*, 4422*d*, 4422*e* and 4422*f* respectively in the delivery direction of the target medium 420. The ribs 4422 aligned with each other in the primary scanning direction of the carriage 4200 are coupled to each other to constitute an island portion 4420. Similarly, the ribs 4432 aligned with each other in the primary scanning direction of the carriage 4200 are coupled to each other to constitute an island portion 4430.

In this embodiment, four island portions 4420 and 4430 are provided such that a pair of island portions 4420 and 4430 are aligned in the delivery direction of the target medium 420 while each pair of the island portions 4420 and the island portions 4430 are aligned in the primary scanning direction. Furthermore, the holder 4400 is provided with the rib 4424 aligned with the rib 4422 in the primary scanning direction and the rib 4434 aligned with the rib 4424 in the delivery direction of the target medium 420. In this embodiment, the rib 4424 includes ribs 4424*a*, 4424*b* and 4424*c*, and the rib 4434 includes ribs 4434*a*, 4434*b* and 4434*c* which are aligned with the ribs 4424*a*, 4424*b* and 4424*c* in the delivery direction of the target medium 420 respectively.

The ribs 4422, 4432, 4424 and 4434 define a distance between the target medium 420 delivered to the recording region and the recording head 4100. For example, in a case where the target medium 420 is a sheet of paper having a standardized size such as A4 form or a postcard is often used in the ink jet recording apparatus 410. In this case, one of the ends of each sheet is positioned at a home position side which is a standby position of the recording head 4100. Depending on the sizes of the paper, the other ends of the sheets such as an L form, a postcard, a 2L form, an 8-inch form and an A4 form are placed at positions a, b, c, d and e respectively as shown in FIG. 22.

The ribs 4422*c* and 4432*c* are provided on a slightly inner side of the position so that these ribs 4422*c* and 4432*c* and the ribs 4422*a*, 4422*b*, 4432*a* and 4432*b* support the L form sheet and regulate the distance relative to the recording head 4100. Furthermore, the ink absorber 4300 is provided below the outside of the paper from the position a. Accordingly, in a case where the recording is carried out over the L form sheet without a margin, the ink discarded to the outside of the sheet is reliably absorbed in the ink absorber 4300. Similarly, the ribs 4424*a*, 4424*b*, 4422*f*, 4424*c*, 4434*a*, 4434*b*, 4432*f* and 4434*c* are provided on the slightly inner than the positions b, c, d and e, respectively. In addition, the ink absorber 4300 is provided below the outside of the ends of the sheets placed at the positions b, c, d and e.

Figure 23:
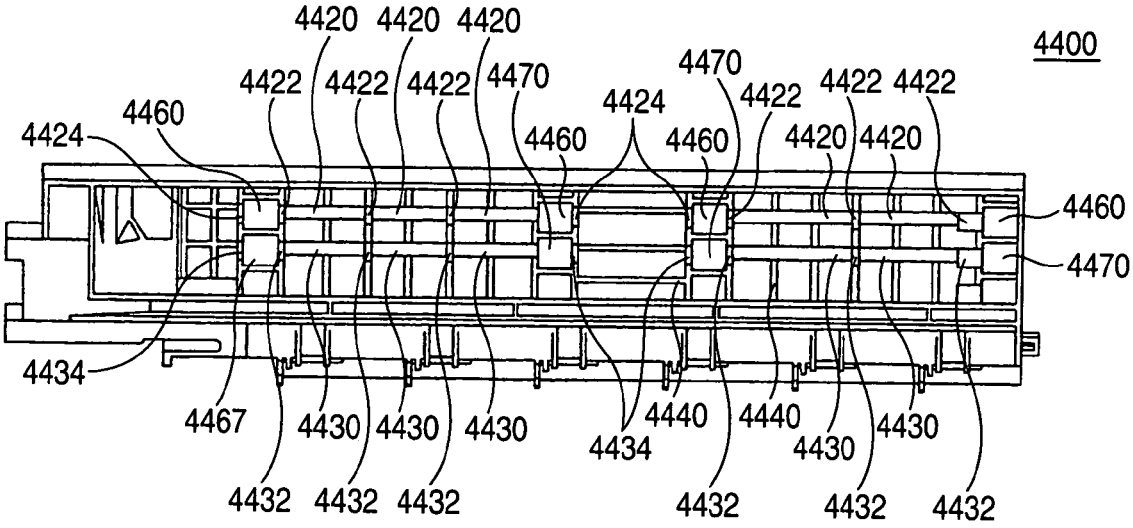
FIG. 23 is a plan view showing the holder of FIG. 22.

As shown in FIG. 23, the holder 4400 has a grid-shaped frame 4440 for supporting the ink absorber 4300. The frame 4440 is provided with holes 4460 and 4470 for inserting leg portion 4340 and 4350 of the ink absorber 4300 which will be described below. In the holder 4400, furthermore, the island portions 4420 and 4430 having the ribs 4422 and 4432 and the ribs 4424 and 4434 are coupled to the frame 4440, respectively.

Figure 24:
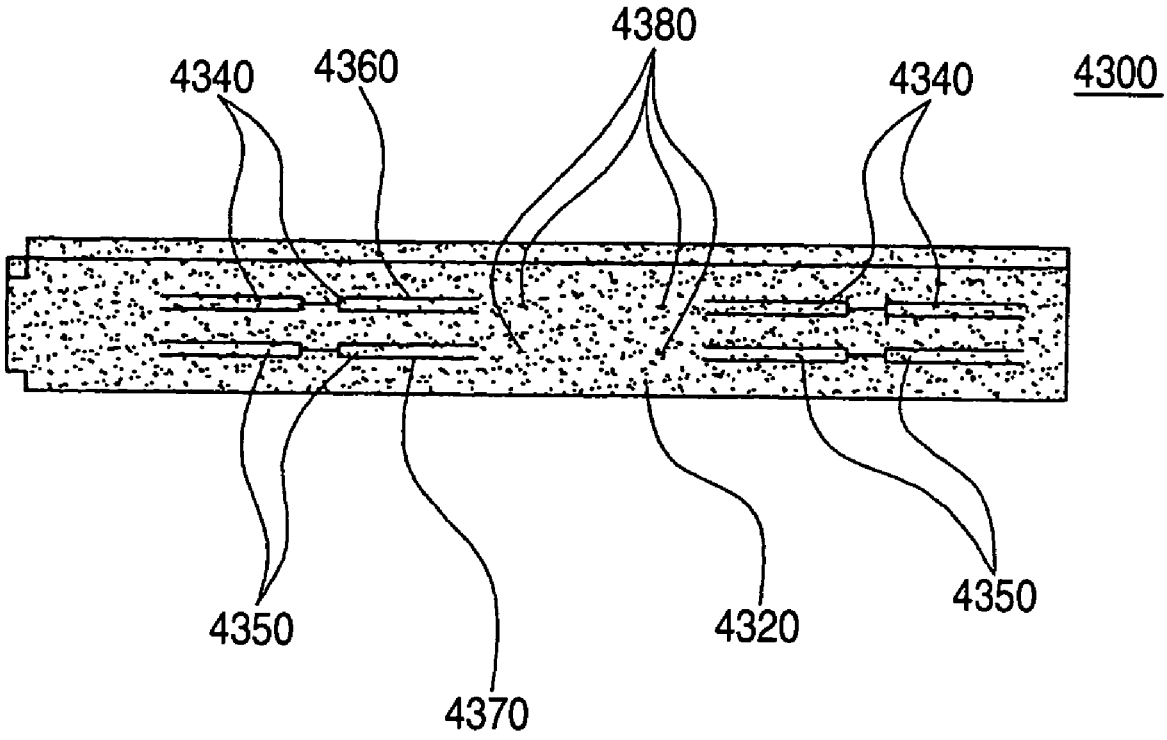
FIG. 24 is a plan view showing the ink absorber of FIG. 22.
Figure 25:
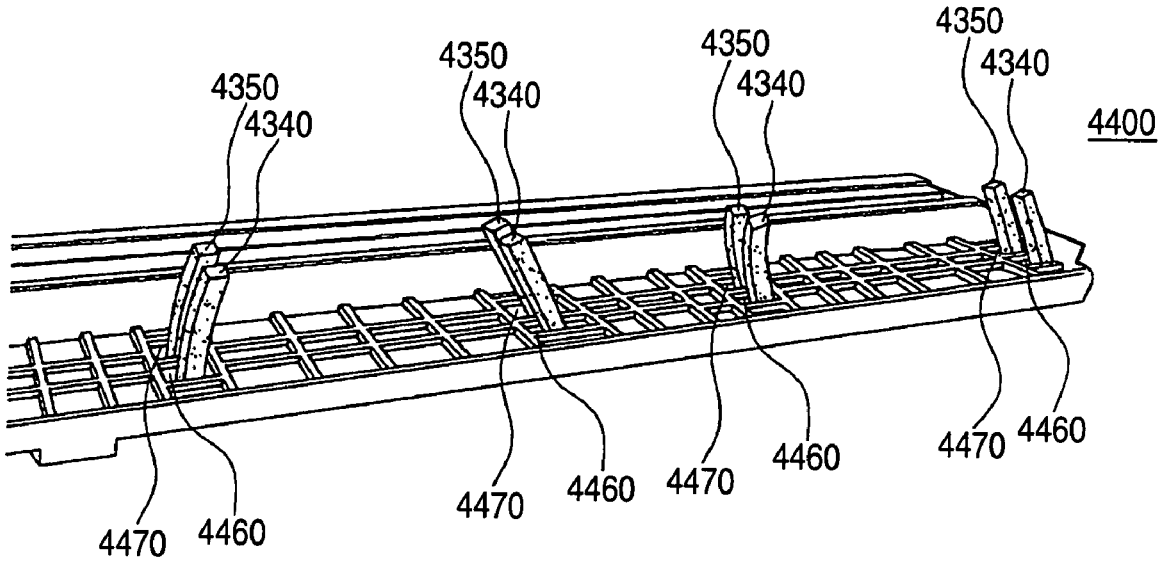
FIG. 25 is a bottom perspective view showing a state that the ink absorber is incorporated in the holder.

As shown in FIG. 24, a main body 4320 of the ink absorber 4300 is made by using a material for absorbing an ink, for example, a foam, and is almost plate-shaped with upper and lower surfaces taking an almost planar shape. The main body 4320 is formed of two pairs of U-shaped slits 4360 such that two pairs of the leg portions 4340 held by the main body 4320 in a cantilevered manner are defined. Each pair of the leg portions 4340 is associated with one of the island portions 4420. Free ends of the leg portions 4340 are directed downward and opposed to the holes 4460 provided at both longitudinal ends of each island portion 4420. Each pair of the slits 4360 is connected by a slit. The main body 4320 is formed of two pairs of U-shaped slits 4370 such that two pairs of the leg portions 4350 held by the main body 4320 in a cantilevered manner are defined. Each pair of the leg portions 4350 is associated with one of the island portions 4430. Free ends of the leg portions 4350 are directed downward and opposed tp the holes 4470 provided at both longitudinal ends of each island portion 4430. Each pair of the slits 4370 is connected by a slit. The main body 4320 is further formed with slits 4380 into which the ribs 4424, 4430 are inserted.

With the above configuration, the leg portions 4340, 4350 (third waste liquid absorber) are integrally formed with the main body 4320 of the ink absorber 4300 by the simple operation of forming the slits 4360 without increasing the number of parts. At the time of assembling, the ink absorber 4300 is inserted into a groove 4440 of the holder 4400 while bending the leg portions 4340, 4350 so as to avoid the island portions 4420, 4430 and to be inserted into the holes 4460, 4470 (see FIG. 25).

Figure 26:
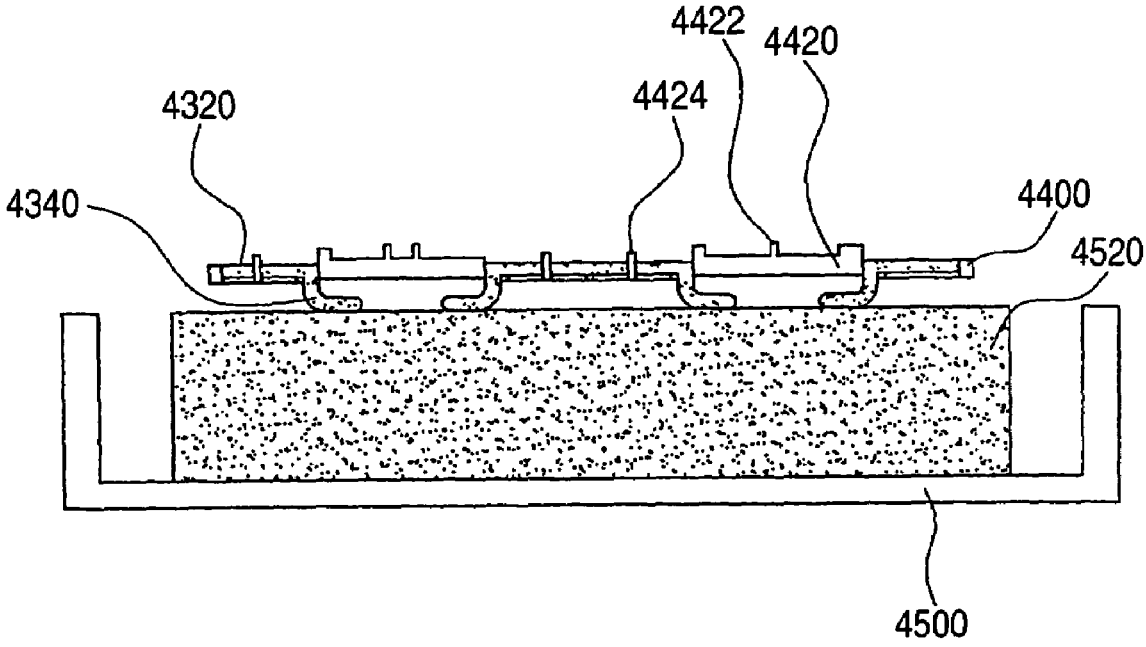
FIG. 26 is a section view taken along the line XXVI—XXVI in FIG. 22.

As shown in FIG. 26, the island portions 4420, 4430 are inserted into the spaces formed by the bending of the leg portions 4340, 4350 and the ribs 4424, 4434 are inserted into the slits 4380. In a state that the ink absorber 4300 is plenarily incorporated into the holder 4400, as shown in FIG. 22, the ribs are projected from the top face of the main body 4320 which surrounds the island portions 4420, 4430. The main body 4320 has a yellow absorbing region 4320Y, a cyan absorbing region 4320C and a magenta absorbing region 4320M below the scanning regions of the nozzle arrays 4100Y, 4100C and 4100M of the recording head 4100.

As shown in FIG. 26, a waste ink holder 4500 (second waste liquid absorber) is provided below the holder 4400 and the ink absorber 4300. The waste ink holder 4500 holds a liquid flowing out of the leg portions 4340 and 4350. The waste ink holder 4500 is provided with an ink holding member 4520 having a higher liquid absorption than that of the ink absorber 4300.

In the state in which the ink absorber 4300 is incorporated in the holder 4400, the leg portion 340 is extended downward from the main body 4320 toward the waste ink holder 4500. In this embodiment, the leg portion 4340 comes in contact with the upper surface of the ink holding member 4520. The leg portion 4350 comes in contact with the upper surface of the ink holding member 4520 in the same manner.

In the structure described above, the target medium 420 is delivered onto the holder 4400 having the ink absorber 4300 incorporated therein. In this case, the rib 4422 supports, above the ink absorber 4300, the target medium 420 delivered onto the holder 4400 from below. Accordingly, the distance between the target medium 420 and the recording head 4100 can be controlled accurately, while the target medium 420 can be prevented from being contaminated in contact with the ink absorber 4300.

In a case where the target medium 420 is delivered to the holder 4400, the carriage 4200 reciprocates in the primary scanning direction so that the recording head 4100 mounted on the carriage 4200 ejects yellow, cyan and magenta ink from the respective nozzle arrays 100Y, 100C and 100M while carrying out a scan over the holder 4400. The ejected ink impact on the target medium 420 so that the recording is carried out. Any of the ink ejected and discarded to the outside of the target medium 420 is absorbed in the main body 4320. The main body 4320 has the yellow absorbing region 4320Y, the cyan absorbing region 4320C and the magenta absorbing region 4320M under the scanning regions of the yellow, cyan and magenta nozzle arrays 4100Y, 4100C and 4100M of the recording head 4100 respectively, and can thereby absorb the respective ink reliably.

The leg portions 4340 and 4350 are extended downward from the main body 4320 toward the waste ink holder 4500. Consequently, the leg portions 4340 and 4350 cause the ink absorbed in the main body 4320 to flow to the waste ink holder 4500. In this embodiment, the leg portion 340 comes in contact with the ink holding member 4520. Consequently, the ink flows from the leg portions 4340 and 4350 to the ink holding member 4520 more reliably and is surely held in the ink holding member 4520. Moreover, the ink absorber 4300 has the leg portions 4340 and 4350 in the vicinity of both longitudinal ends of each of the island portions 4420 and 4430. Thus, the liquid absorbed once in the main body 4320 can be reliably caused to flow to the waste ink holder 4500.

According to the embodiment, the ink absorbed once in the main body 4320 is reliably caused to flow to the waste ink holder 4500. Therefore, the amount of the ink remaining in the main body 4320 is reduced. Accordingly, the target medium 420 delivered onto the main body 4320 can be prevented from being contaminated due to the soak of the ink absorbed once in the main body 4320. Moreover, the amount of the ink remaining in the main body 4320 is decreased. Consequently, the main body 4320 can more reliably absorb the ink discarded to the outside of the target medium 420. Furthermore, the ink absorbed once in the main body 4320 is caused to flow to the waste ink holder 4500 provided in the lower part. In a case where the ink jet recording apparatus 410 is inclined, therefore, it is possible to prevent the ink from flowing out of the ink jet recording apparatus 410.

According to the embodiment, moreover, the leg portions 4340 and 4350 are provided in the lower parts to which the side end of the target medium 420 is to be delivered. Consequently, printing is carried out without a margin on the side end so that the ink is thrown away, and the leg portions 4340 and 4350 can cause the liquid absorbed once in the main body 4320 to flow to the waste ink holder 4500 more reliably in the vicinity of the side end of the target medium 420 in which the ink is apt to collect.

In this embodiment, the leg portions 4340 and 4350 come in contact with the ink holding member 4520. However, the leg portions 4340 and 4350 do not need to come in contact with the ink holding member 4520. In such a case, it is preferable that the leg portions 4340 and 4350 should have such a length as to generate, at the lower ends of the leg portions, a higher pressure than the liquid holding ability of the leg portions. That is, the pressure is generated by the height difference between the top face of the main body 4320 and the lower ends of the leg portions 4340, 4350.

The leg portions 4340 and 4350 do not need to be provided for both of the island portions 4420 and 4430. For example, the island portions 4430 and the corresponding leg portions 4350 situated in the downstream side of the sheet delivery direction may be omitted. In this case, it is possible to prevent the leg portion from being caught in the ejecting roller of the ejector 416 when the ink jet recording apparatus 410 is assembled.

Figure 27:
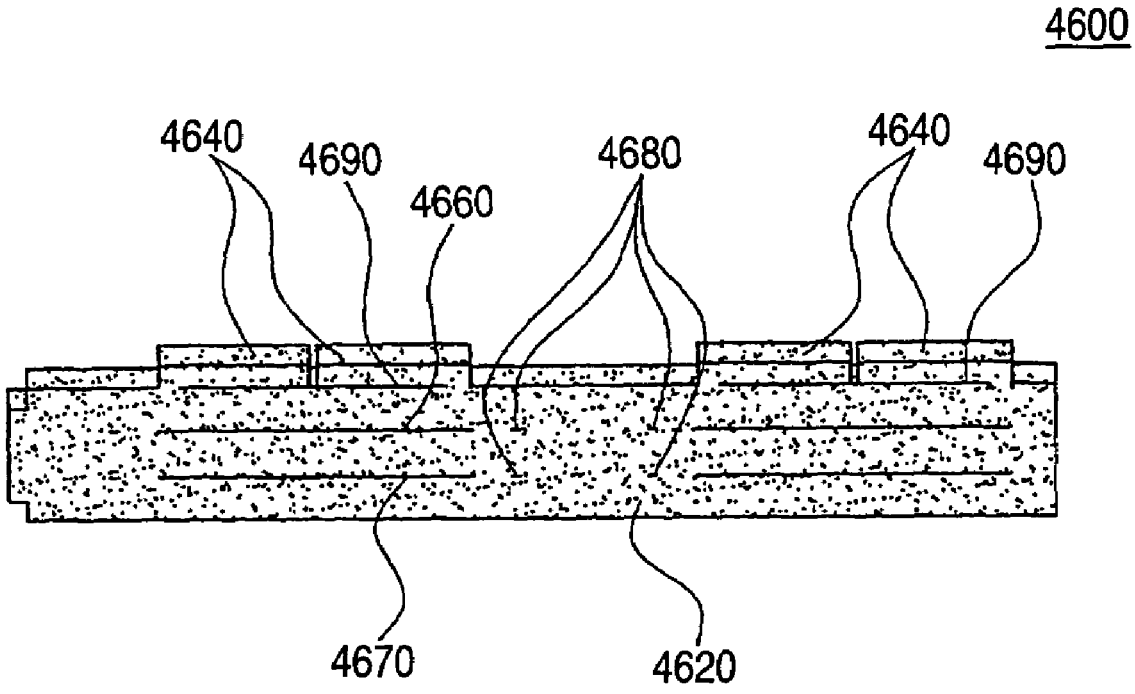
FIG. 27 is a plan view of a modified example of the ink absorber of FIG. 22.

In this embodiment, an ink absorber 4600 shown in FIG. 27 may be adopted.

FIG. 27 shows a modified example of the ink absorber 4300 of the fourth embodiment. The ink absorber 4600 is also made of a material for absorbing an ink, for example, a foam in the same manner as the ink absorber 4300. The ink absorber 4600 includes an main body 4620 having a whole shape of an almost rectangular parallelepiped, and, formed with straight slits 4690 which define leg portions 4640 held on the side end of the main body 4620 in a cantilevered manner. The main body 4620 is further formed with slits 4660, 4670 into which the island portions 4420, 4430 are inserted. The length of the slits 4690 are determined such that the defined leg portions 4640 can have such a length as to generate a higher pressure than the liquid holding ability of the leg portions. The pressure is generated at the lower ends thereof when the free ends thereof are directed downward, due to the height difference between the lower ends of the leg portions 4640 and the top face of the main body 4620.

When the ink absorber 4600 is incorporated in the holder 4400, the leg portions 4640 thus bent are inserted into holes formed in the holder 4400, while the island portions 4420 and 4430 are inserted in the slits 660 and 670. Consequently, the ink absorber 4600 is incorporated in the holder 4400 in the same manner as the ink absorber 4300.

In the same manner as the ink absorber 4300 shown in FIG. 24, consequently, the leg portions 4640 are extended downward from the main body 4620 and can cause the ink absorbed once in the main body 4620 to flow downward from the leg portions 4640 under a pressure generated on the lower surface of the leg portions 4640 due to the height difference between the lower ends of the leg portions 4640 and the top face of the main body 4620. Since the slits 4690 do not need to be provided in the positions in which the island portions 4420 and 4430 are to be inserted. Consequently, it is possible to increase the design freedom of the position in which the leg portion 4640 is to be provided in the ink absorber 4600.

Next, an ink jet printer 501 as a liquid ejecting apparatus according to a fifth embodiment of the invention will be described with reference to FIGS. 28 through 33B.

In the following, a rightward direction (the forward side of the printer) and a leftward direction (the rear side of the printer) in FIG. 28 will be referred to as a "downstream side" and an "upstream side" of a paper delivery path, respectively.

Figure 28:
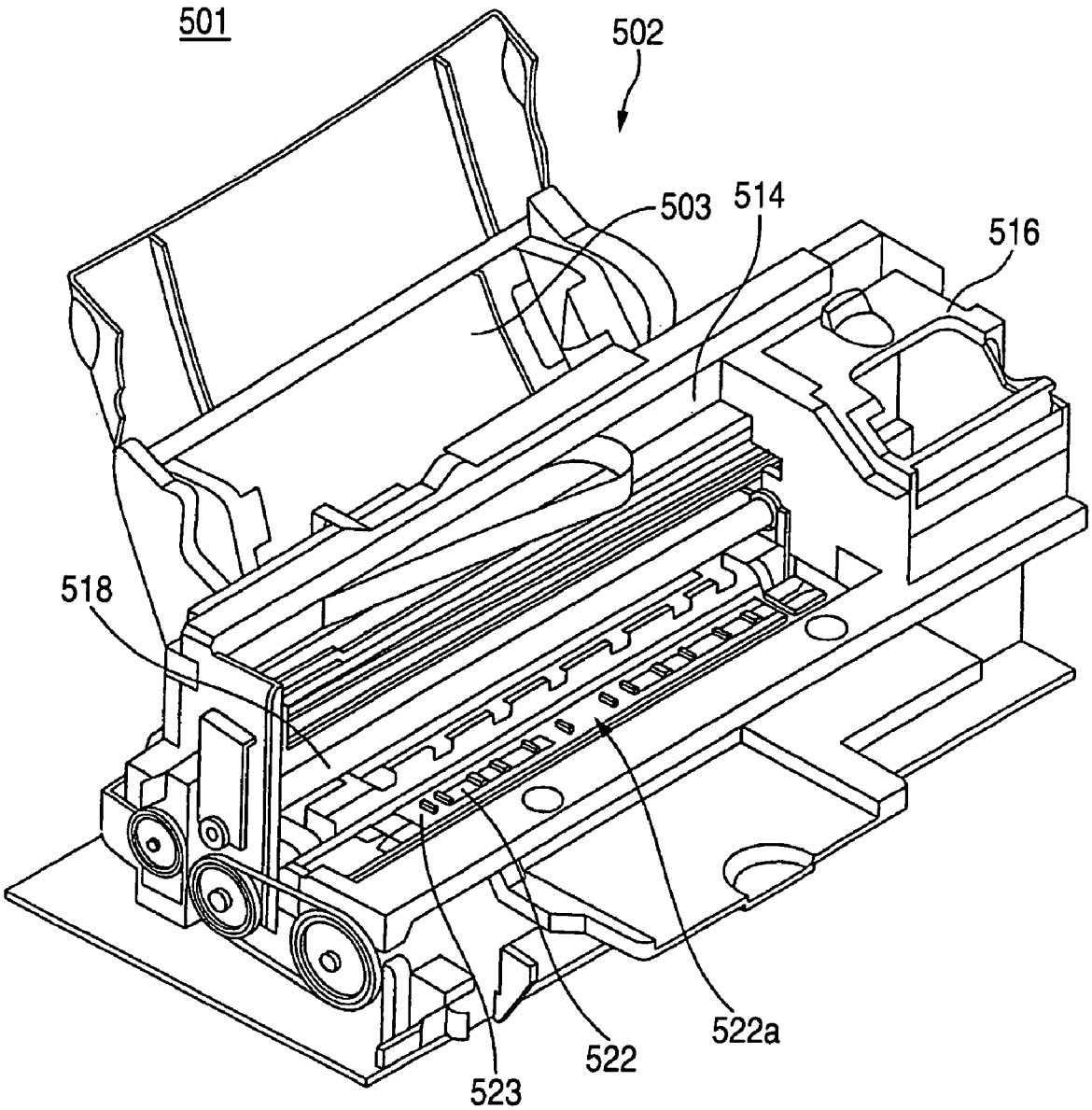
FIG. 28 is a perspective view showing an ink jet printer according to a fifth embodiment of the invention.
Figure 29:
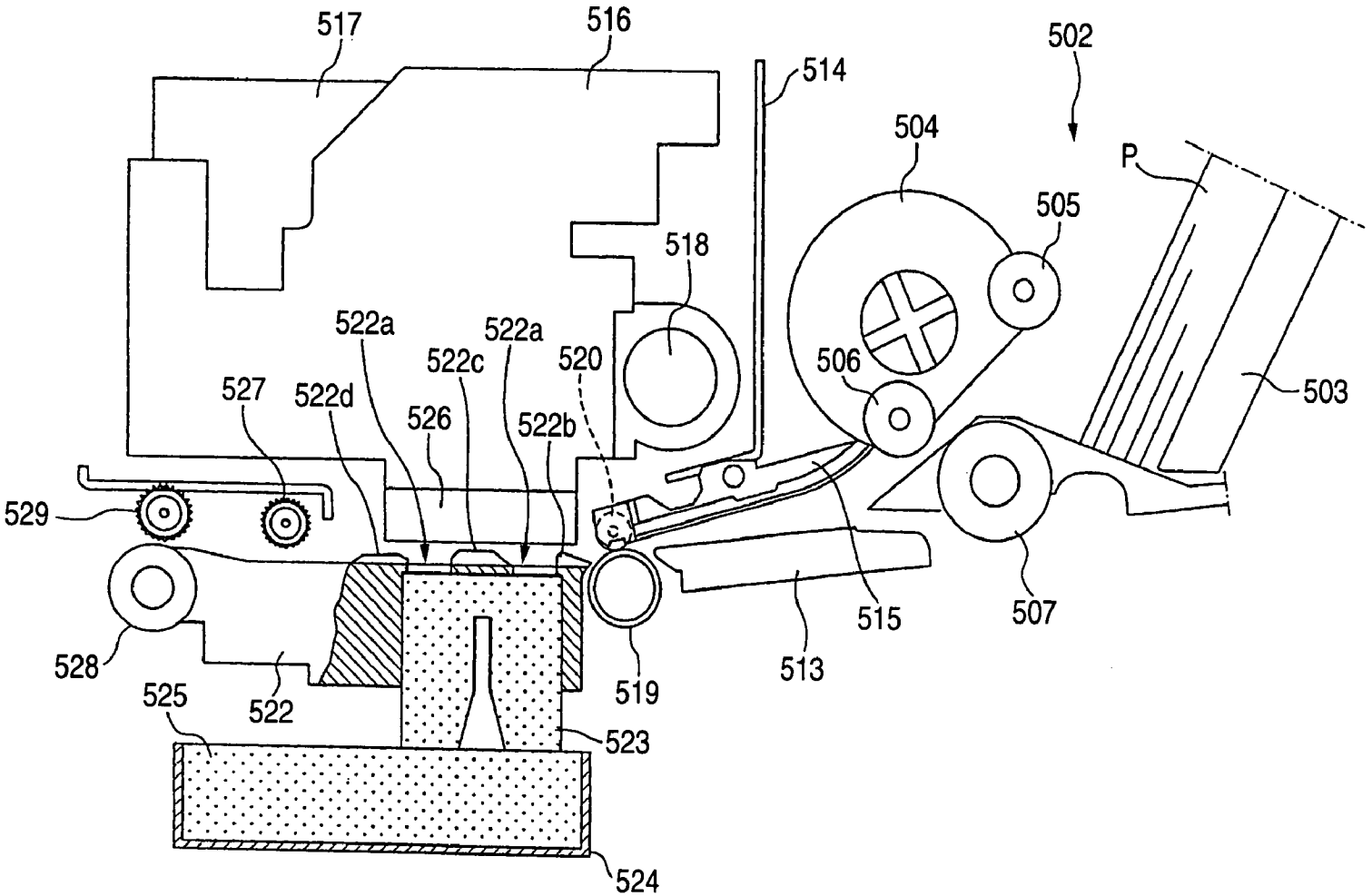
FIG. 29 is a schematic side view of the ink jet printer of FIG. 28.

As shown in FIGS. 28 and 29, the printer 501 comprises a feeder 502 at which a target medium such as paper P is mounted in an inclining posture. The feeder 502 is constituted to include a hopper 503, a feeding roller 504, a retard roller 507 and guide rollers 505 and 506, and feeds the paper P one by one toward a delivery driving roller 519 and a delivery driven roller 520 which deliver the paper P to an ink jet recording head 526.

In more detail, the hopper 503 is formed by a pivotable plate-shaped member to cause the paper P supported on the hopper 503 to come in press contact with the feeding roller 504 or to separate the paper P from the feeding roller 504. The feeding roller 504 is almost D-shaped as seen from a side so as to have an arcuate portion and a flat portion. The arcuate portion is brought into press contact with the paper P to feed it to the downstream side. Once the paper P is nipped by the delivery driving roller 519 and the delivery driven roller 520 to be delivered, the flat portion is opposed to the paper P (i.e., the press contact is released) to reduce the delivery load.

The retard roller 507 is provided to come in press contact with the arcuate portion of the feeding roller 504, and furthermore, is rotated and driven in such a direction as to return the paper P to the upstream side (a clockwise direction in FIG. 29) by a predetermined rotating force. In a case where the overlapping feed of the paper P is not generated but only one paper P is fed, the retard roller 507 is rotated (in a counterclockwise direction in FIG. 29). In a case where a plurality of paper P is present between the feeding roller 504 and the retard roller 507, a coefficient of friction between the paper P is small so that they are rotated in such a direction as to return the paper P to the upstream side (the clockwise direction in FIG. 29). Accordingly, only the uppermost paper is fed to the downstream side.

The guide rollers 505 and 506 are provided to be freely rotatable and preventing the paper P from coming in contact with the feeding roller 504 during the delivery of the paper P by the delivery driving roller 519 and the delivery driven roller 520 to reduce the delivery load.

The paper P delivered by the feeder 502 is guided to the guide 13 and reaches the delivery driving roller 519 to be rotated and driven by a motor and the driven roller to be driven and rotated in press contact with the delivery driving roller 519. The delivery driven roller 520 is rotatably supported by a holder member 515, and the holder member 515 is attached to a frame 14 constituting the base body of the printer 501 through a spring which is not shown. The paper P reaching the delivery driving roller 519 is delivered to the downstream side at a predetermined pitch by the rotation of the delivery driving roller 519.

The downstream side of the delivery driving roller 519 is provided with the ink jet recording head (hereinafter referred to as the "recording head") 526 and a platen 522 opposed thereto. The recording head 526 is provided in the bottom portion of a carriage 516 which is reciprocated along a guide shaft 518 extending in the primary scanning direction by a driving motor which is not shown. Moreover, the carriage 516 mounts an ink cartridge 517 (which is not shown in FIG. 28) provided independently for each of colors and supplies ink to the recording head 526.

The platen 522 for defining a distance between the paper P and the recording head 526 is provided with ribs 522*b*, 522*c* and 522*d* on an opposed surface to the recording head 526 and a concave portion 522*a*. The concave portion 522*a* serves to receive ink ejected to the outside of the end of the paper P. Consequently, it is possible to execute so-called marginless printing in which printing is carried out without a margin on the end of the paper P. The concave portion 522*a* is provided with an ink absorber 523 (first waste liquid absorber) which serves to absorb the discarded ink (will be described below in detail). Moreover, a waste liquid tray 524 is provided under the platen 522, so that the ink absorbed in the ink absorber 523 is guided to the waste liquid tray 524. An ink absorber 525 (second waste liquid absorber) is provided in the waste liquid tray 524 to hold the guided ink therein.

An auxiliary roller 527, an ejection driving roller 528 and an ejection driven roller 529 are provided on the downstream side of the recording head 526. The ejection driven roller 529 is driven and rotated in contact with the ejection driving roller 528, and the paper P is nipped between these rollers and is thus ejected. Moreover, the auxiliary roller 527 positioned on the upstream side of these rollers comes in contact with the paper P from above and is thus driven and rotated, thereby preventing the floatation of the paper P to maintain the distance between the paper P and the recording head 526 to be constant.

Figure 30:
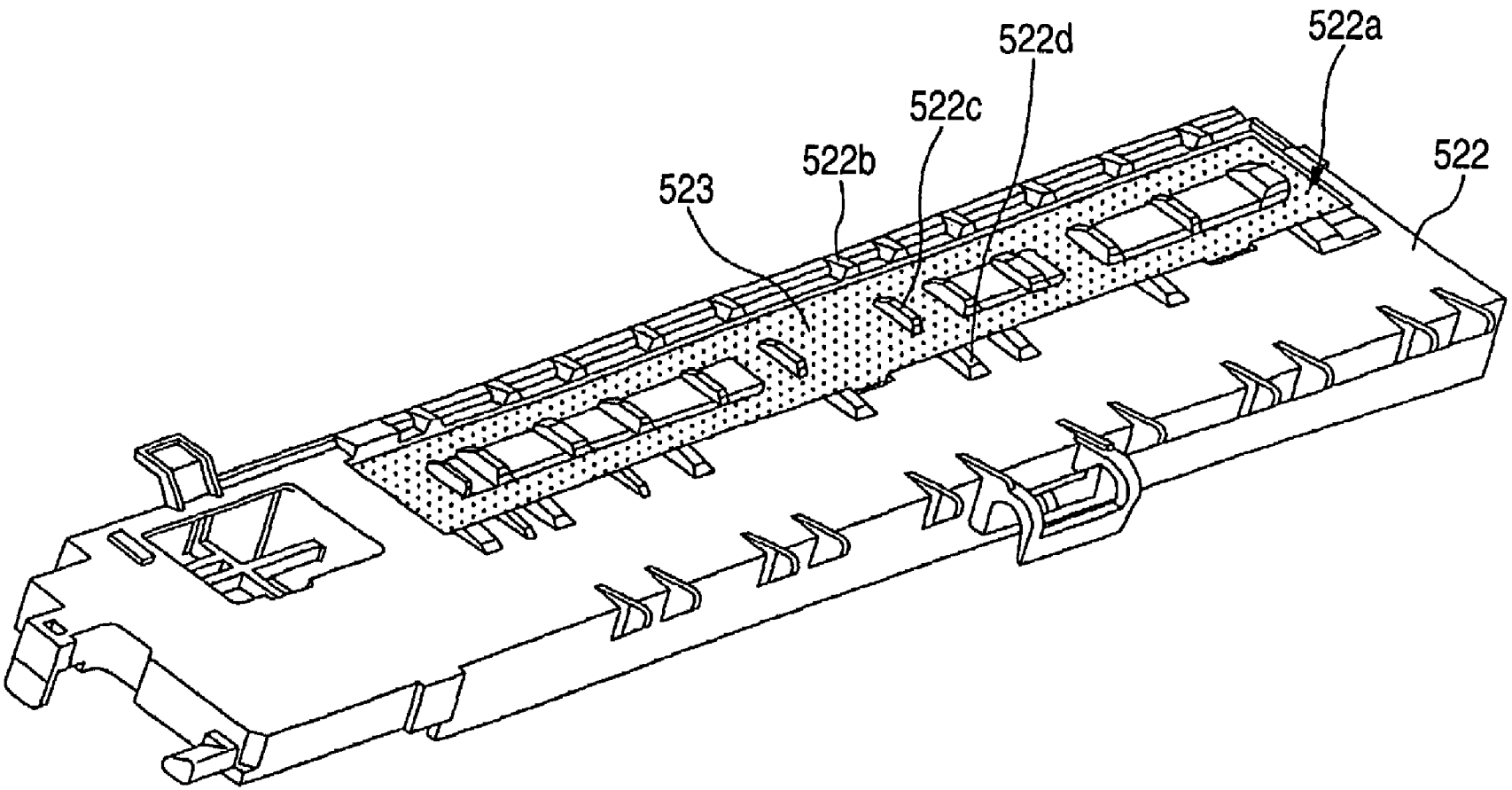
FIG. 30 is a perspective view of an ink absorber and a platen which are incorporated in the ink jet printer of FIG. 28.
Figure 31:
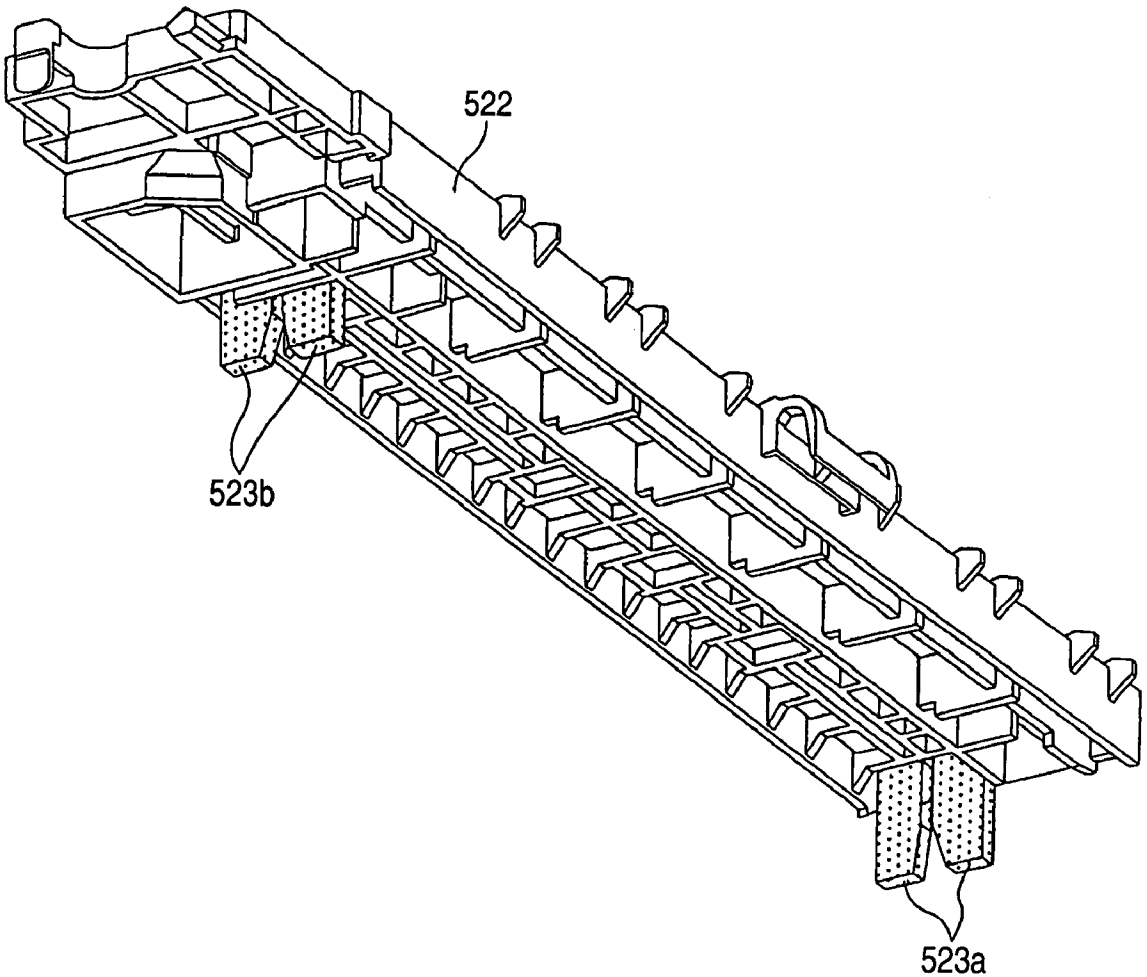
FIG. 31 is a bottom perspective view showing a state that the ink absorber is combined with the platen.
Figure 32:
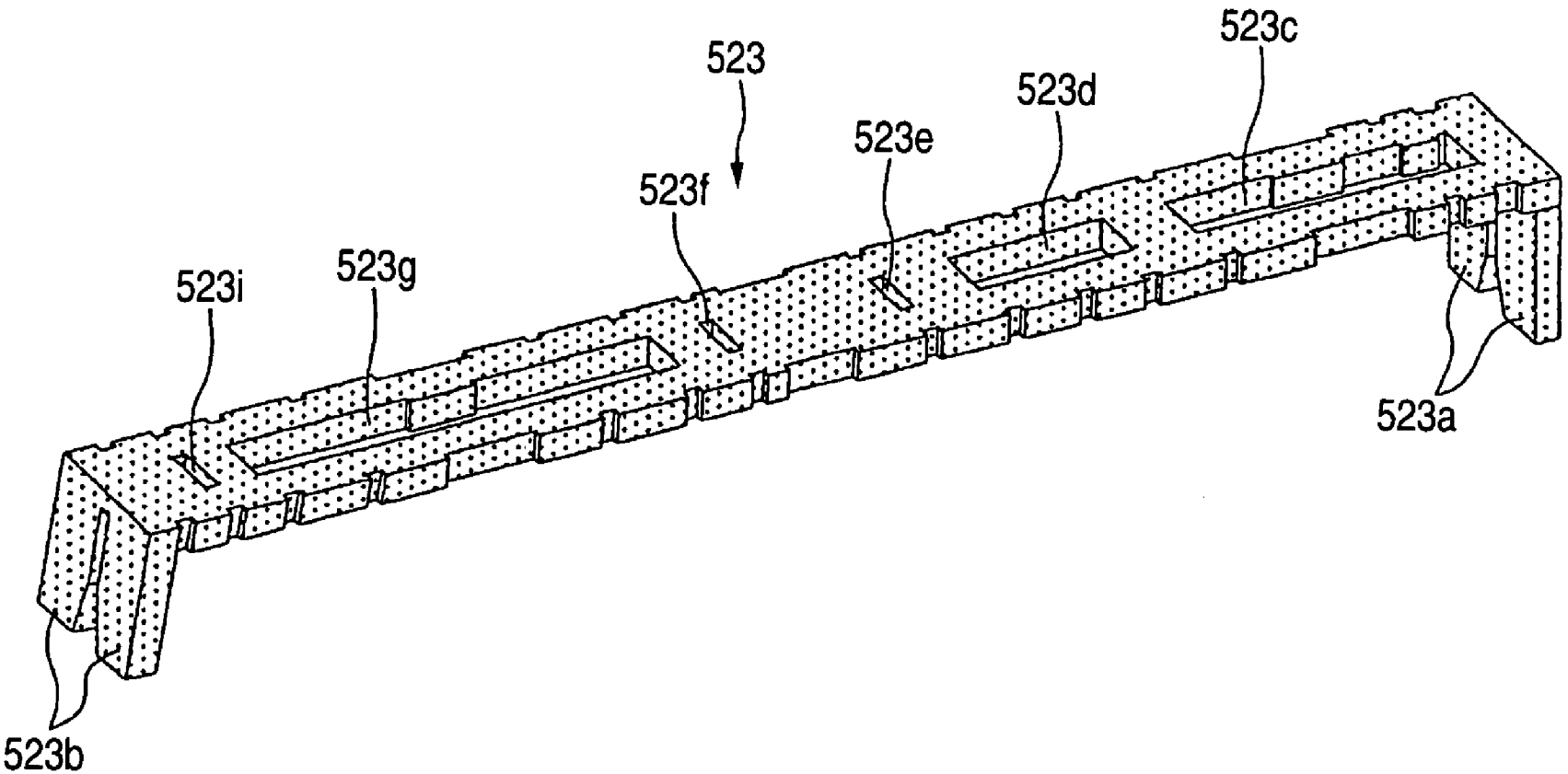
FIG. 32 is a perspective view of the ink absorber of FIG. 30.

The printer 501 has been briefly described above. The ink absorber 523 will be described below in detail with reference to FIGS. 30 through 33B. As shown in FIG. 32, the ink absorber 523 is elongated in the primary scanning direction and is formed by a material having a liquid absorbing ability (a sponge material in the embodiment), and is provided with holes 523*c*, 523*d*, 523*e*, 523*f* and 523*g* in order to avoid the rib 522*c* formed on the platen 522 as shown in FIG. 30.

Figure 33A:
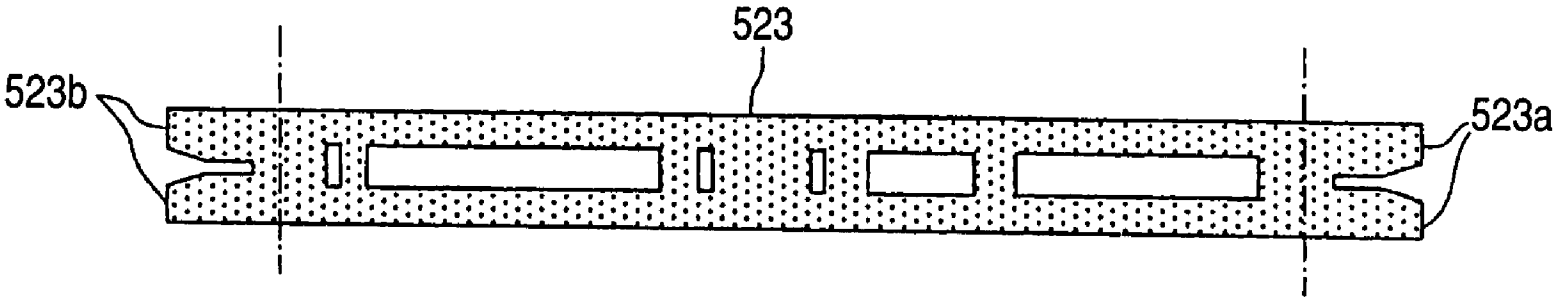
FIG. 33A is a plan view of the ink absorber of FIG. 30 showing a state before guide portions are bent.
Figure 33B:
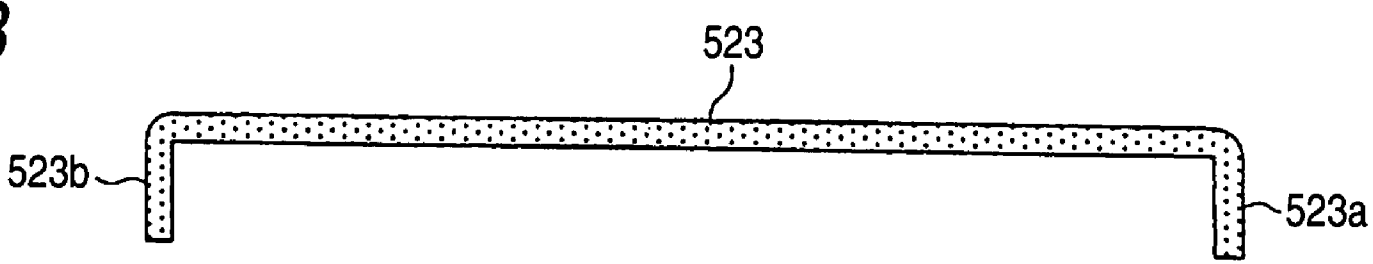
FIG. 33B is a side view of the ink absorber of FIG. 30 showing a state after the guide portions are bent.

As shown in FIG. 33A, guide portions 523*a* and 523*b* (third liquid waste absorber) are formed on both longitudinal ends of the ink absorber 523. The guide portions 523*a* and 523*b* are bent to be directed downward as shown in FIG. 33B, and inserted into holes (not shown) formed on the platen 522 so as to project downward as shown in FIGS. 29 and 31. The guide portions 523*a* and 523*b* are brought into contact with the ink absorber 525 provided in the waste liquid tray 524. Consequently, the ink absorbed in the ink absorber 523 is smoothly led to the ink absorber 525 through the guide portions 523*a* and 523*b* and is held by the ink absorber 525.

When the printer 501 is put in an inclining posture during a transportation in a state in which the ink is absorbed in the ink absorber 523 to some extent, for example, there is a possibility that the ink thus absorbed might be collected into the end of the ink absorber 523 to overflow to an outside. In order to eliminate such a trouble, in this embodiment, the guide portions 523*a* and 523*b* are positioned on endmost portions in the primary scanning direction.

That is, even in a case where the printer 501 is put in the inclining posture, the ink converging on the longitudinal end portion of the ink absorber 523 does not stay there but is smoothly led to the ink absorber 525.

Next, an ink jet printer 601 as a liquid ejecting apparatus according to a sixth embodiment of the invention will be described with reference to FIGS. 34 through 43.

Figure 34:
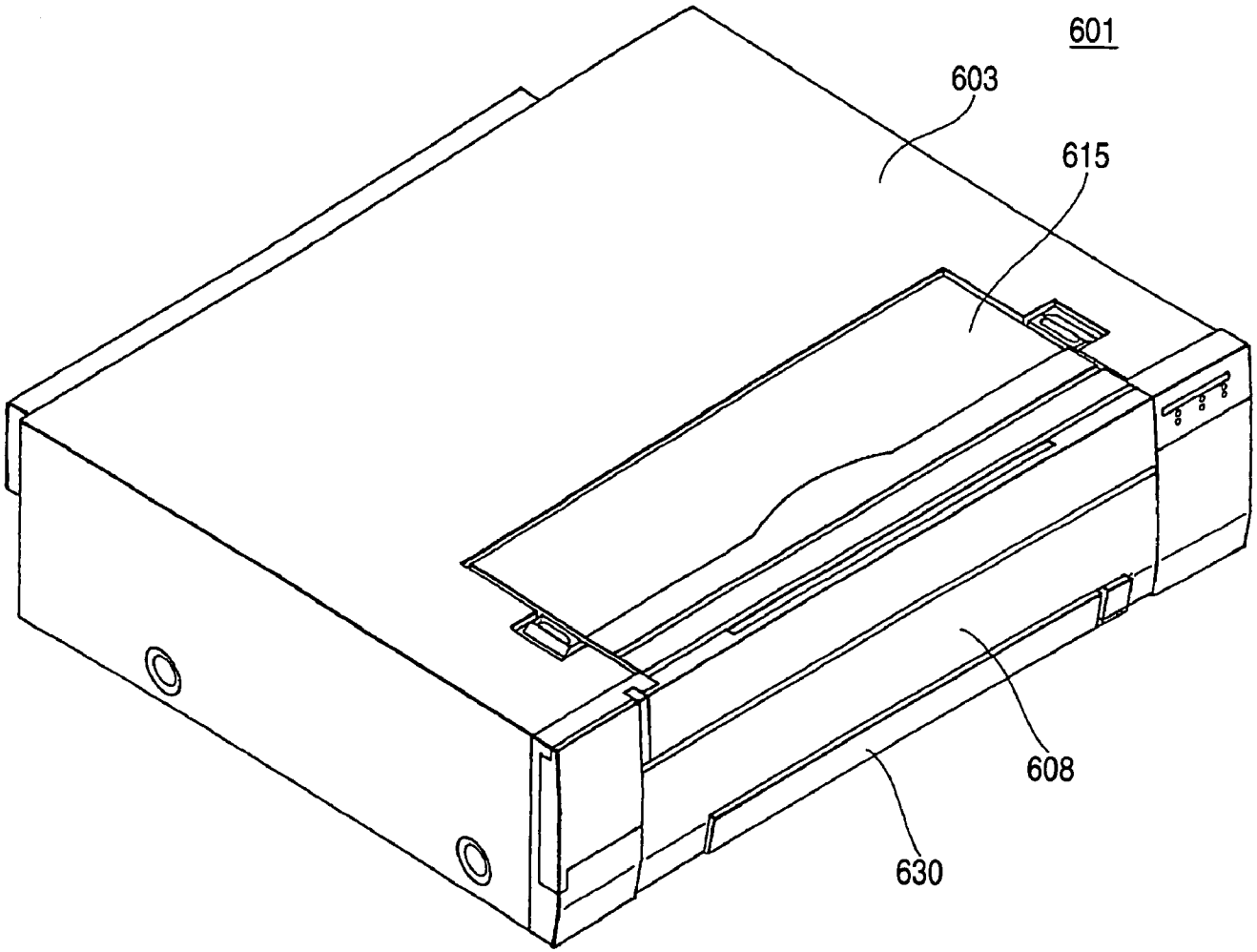
FIG. 34 is a perspective view showing an ink jet printer according to a sixth embodiment of the invention.

As shown in FIG. 34, the printer 601 takes the shape of a box and is almost formed to have the size of a video tape recorder, and is constituted on the assumption that the printer 601 is used in an accommodation state in a television rack. The appearance is generally constituted with a front cover 608 provided on the front surface of a box-shaped housing 603. The front cover 608 is pivotable between a closed position (shown in the drawing; non-using state) and an opened position (not shown; a using state). When the front cover 608 is opened, it is possible to eject a target medium such as recording paper P therefrom, and to carry out a loading/unloading operation of a disk tray 633 (see FIG. 36; described later). A paper feeding tray 630 is removably provided under the front cover 608, and is pulled out toward the front side of the printer 601 and removed so that the recording paper P can be set. An ink cartridge unit 615 is provided above the front cover 608, and a plurality of ink cartridges 616 (see FIG. 36) arranged in the transverse direction of the printer 601 are detachably provided in the ink cartridge unit 615.

Figure 35:
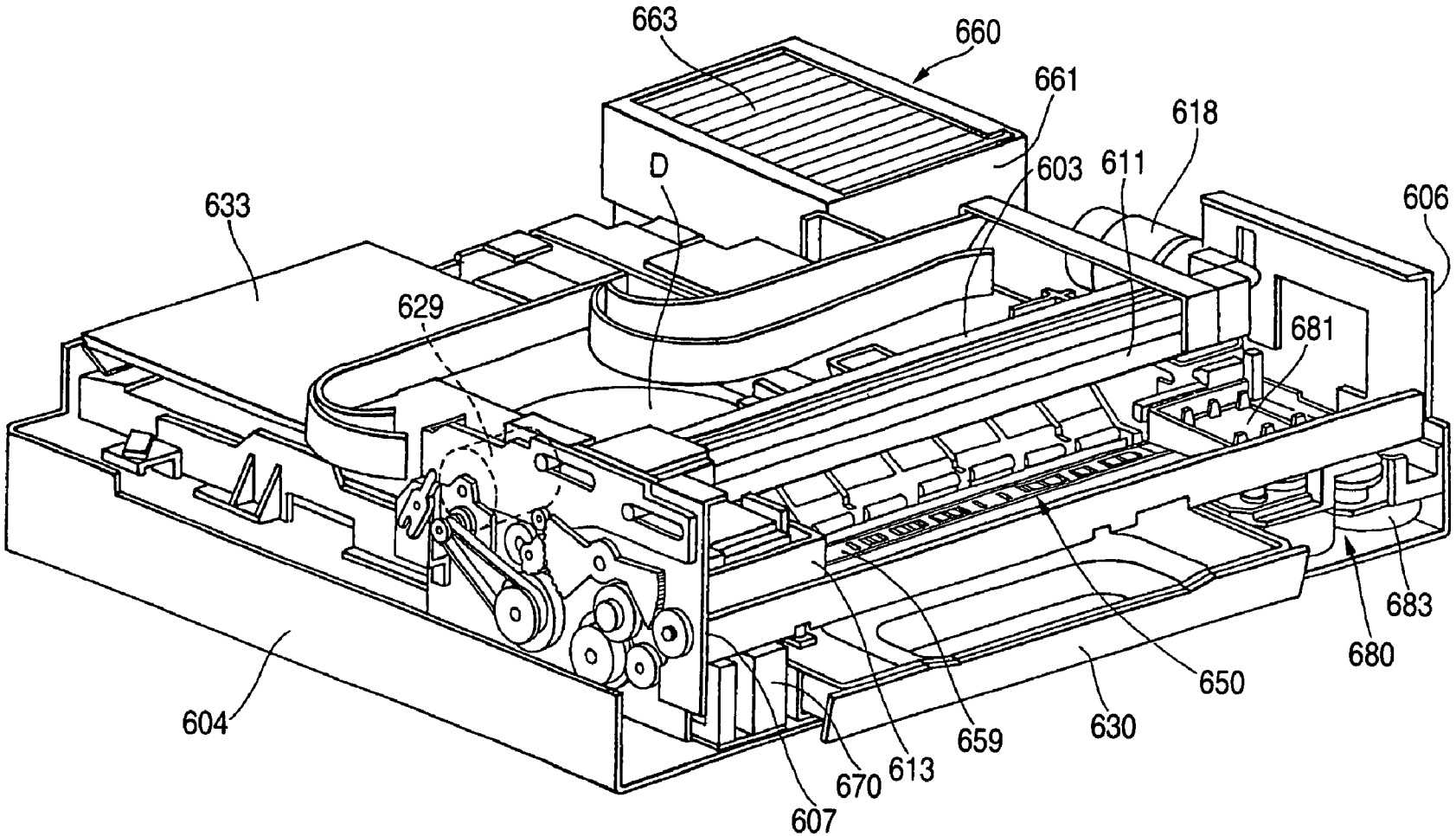
FIG. 35 is a perspective view showing an internal configuration of the ink jet printer of FIG. 34.

Next, the internal structure of the printer 601 will be briefly described with reference to FIGS. 35 and 36. As shown in FIG. 35, the base body of the printer 601 is constituted by a lower chassis 604, a main frame 605 extended in the transverse direction (the primary scanning direction) of the apparatus body, and a right side frame 606 and a left side frame 607 which are erected on both sides of the main frame 605 in parallel with the front-rear direction (the secondary scanning) of the apparatus body. A main guide shaft 611 and an auxiliary guide shaft 612 which are extended in the primary scanning direction are pivotally supported between the right side frame 606 and the left side frame 607 at a predetermined interval in the secondary scanning direction.

The main guide shaft 611 and the auxiliary guide shaft 612 serve to guide a carriage 613 to be driven by a carriage motor 618 in the primary scanning direction, and the main guide shaft 611 is inserted through the rear portion of the carriage 613 and the auxiliary guide shaft 612 supports the front portion of the carriage 613 from below. Consequently, a distance between a nozzle formation face 617 of a recording head 614 (FIG. 36) and the recording paper P (a platen 650) is defined.

During recording, the carriage 613 reciprocates in the primary scanning direction while opposing the recording head 614 to the platen 650. The movable range of the recording head 614 reciprocating in the recording is referred as a recording region of the printer 601. During non-recording, the carriage 613 is moved to a home position adjacent to the recording region to be placed in a stand-by state. In the home position, capping and suction cleaning can be executed by a maintenance unit 680 (see FIG. 43) including a cap 681 capable of sealing the nozzle formation face 617 of the recording head 614 with a well-known mechanism. A first waste ink tank 660 is connected to the maintenance unit 680 to form a waste ink path.

On the other hand, a second waste ink tank 670 is disposed below the end of the platen 650 which is an opposite end to the home position side, and connected to an ink absorber 657 (see FIG. 38; described later in detail). In this embodiment, the first and second waste ink tanks 660, 670 are disposed at both sides of the recording region in the primary scanning direction.

Figure 36:
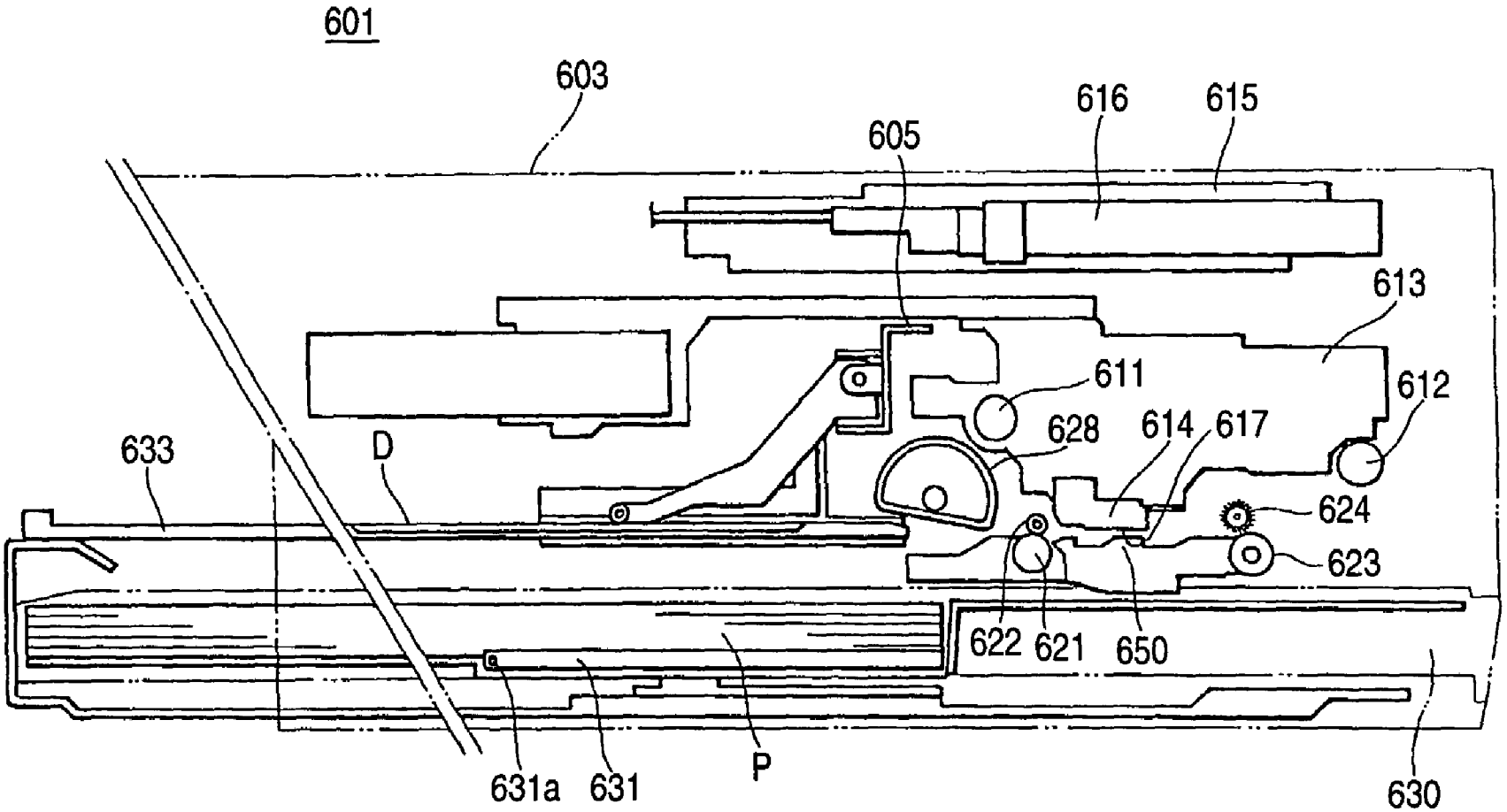
FIG. 36 is a schematic side view of the internal configuration of the ink jet printer of FIG. 34.
Figure 37A:
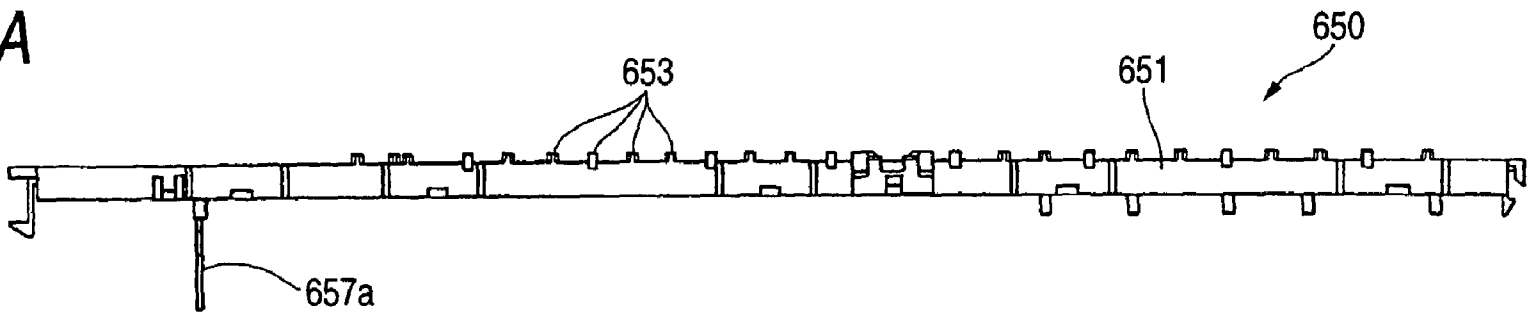
FIG. 37A is a side view of a platen incorporated in the ink jet printer of FIG. 34.
Figure 37B:
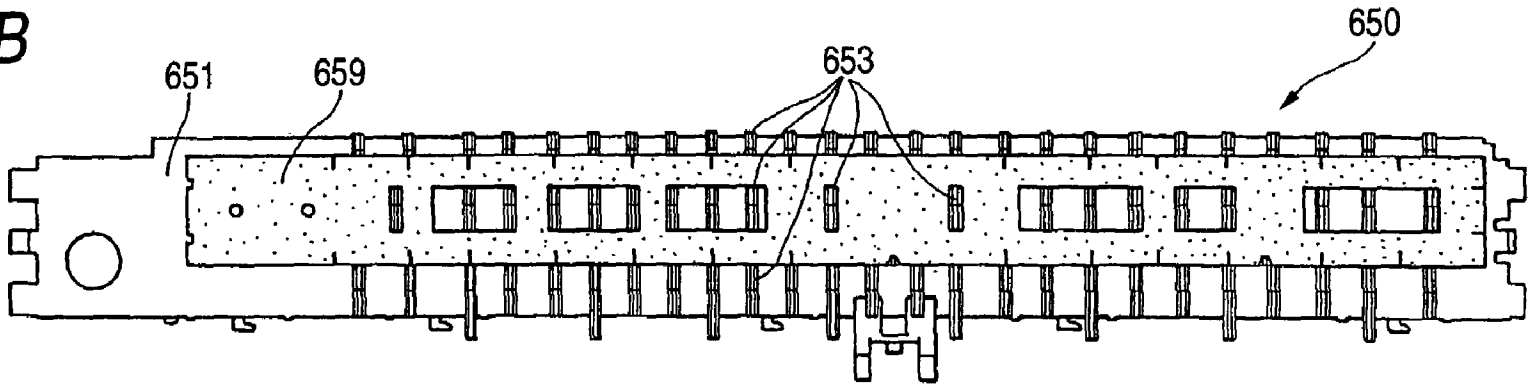
FIG. 37B is a plan view of the platen of FIG. 37A.

As shown in FIG. 36, the paper feeding tray 630 is detachably provided in the bottom portion of the printer 601. Plural sheets of recording paper P can be set in the paper feeding tray 630 in a laminated manner. A hopper 631 is disposed in the bottom portion of the paper feeding tray 630 so as to be pivotable about a pivot shaft 631*a*. When the hopper 631 lifts up the set recording paper P, the uppermost recording paper P is brought into press contact with a feeding roller 628 disposed thereabove.

The feeding roller 628 takes an almost D shape seen from a side so as to have an arcuate portion and a flat portion. An outer periphery of the feeding roller 628 is formed by a high frictional member (for example, a rubber material). The uppermost recording paper P which is brought into contact with the arcuate portion of the feeding roller 628 is fed to the downstream side (the right side in FIG. 36). A frictional separator (not shown) is disposed below the feeding roller 628 so that the uppermost recording paper P is nipped between the feeding roller 628 and the frictional separator, thereby separating the uppermost recording paper P from the second uppermost recording paper to prevent overlapped plural sheets of recording paper P from being fed.

The downstream side of the feeding roller 628 is provided with a delivery driving roller 621 to be rotated by a paper feeding motor 629 (see FIG. 35; hereinafter referred to as a "PF motor") and a delivery driven roller 622 to be rotated by the delivery driving roller 621. The recording paper P is nipped by these rollers and the delivery driving roller 621 is rotated. Consequently, the recording paper P is delivered to a portion under the recording head 614. The nozzle formation face 617 of the recording head 614 and the platen 650 are opposed to each other on the downstream side of the delivery driving roller 621, and an ink droplet (liquid) is ejected from a nozzle (not shown) of the recording head 614 onto the recording paper P. The recording paper P is transported to be subjected to the recording operation while being supported by the platen 650 from below. The recording head 614 is provided in the bottom part of the carriage 613. A plurality of ink cartridges 616 are detachably disposed above the carriage 613 (not on the carriage 613) and arrayed in the primary scanning direction. Ink is supplied from the cartridges 616 to the recording head 614 via ink tubes (not shown).

The downstream side of the recording head 614 is provided with an ejection driving roller 623 to be rotated by the PF motor 629 and an ejection driven roller 24 to be rotated by the ejection driving roller 623. The recording paper P is nipped by these rollers and ejected to the outside of the printer 601 in accordance with the rotation of the ejection driving roller 623.

On the other hand, an optical disk D such as a DVD (Digital Versatile Disk) is placed in the disk tray 633 which is provided above the paper feeding tray 630. A rack (not shown) is formed on the side end of the disk tray 633. In accordance with the rotation of a pinion gear (not shown) meshed with the rack, the disk tray 633 is moved horizontally. When the recording operation is performed with respect to the optical disk D, the disk tray 633 is moved by the tray driving mechanism toward the downstream side until an end of the optical disk D is nipped by the delivery driving roller 621 and the delivery driven roller 622. In accordance with the rotation of the delivery driving roller 621, the optical disk D is transported toward the recording head 614 with a fixed pitch to be subjected to the recording operation. The tray driving mechanism is also driven by the PF motor 629.

The platen 650 comprises a substrate 651 molded with a material such as a synthetic resin. In the embodiment, a concave portion 655 and a plurality of protruded ribs 653 are formed on the upper surface of the substrate 651. As is well known, these ribs 653 support the recording paper P at a top part thereof and serves to define an interval between the recording paper P and the nozzle formation face 617 of the recording head 614.

Figure 38:
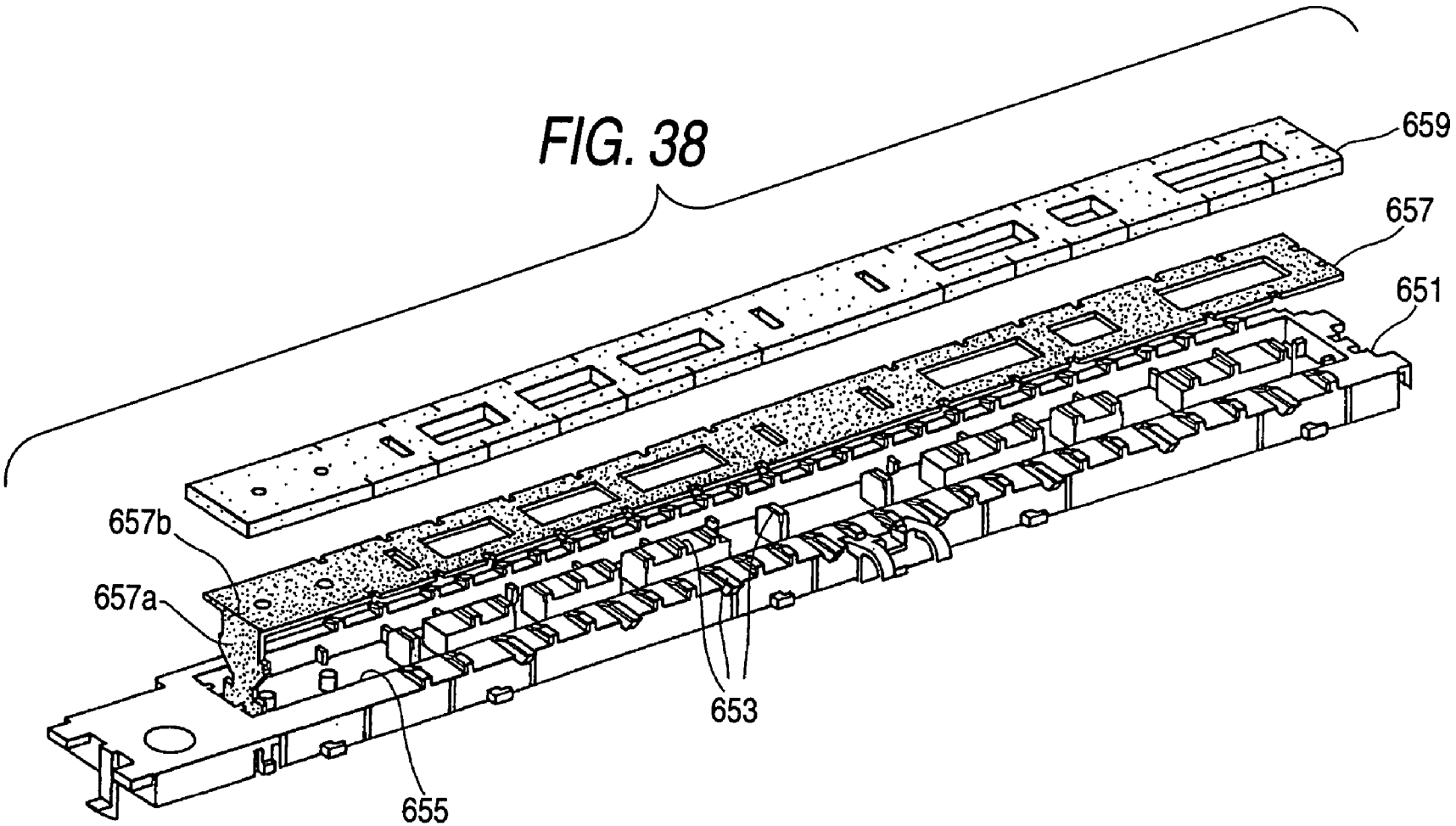
FIG. 38 is a perspective view showing a disassembled state of the platen of FIG. 37B.

As shown in FIG. 38, the ink absorber 657 (first waste liquid absorber) is disposed within the concave portion 655, and an ink absorbing sheet 659 is laminated thereon. The ribs 653 includes one solely provided and ones gathered to form an island portion. The ink absorber 657 and the ink absorbing sheet 659 are formed with holes to avoid the ribs 653. A region where the ink absorbing sheet 659 is exposed at the top face of the platen 650 serves as an ink receiving part.

In the so-called marginless printing, the recording head 614 ejects ink droplets to the outside of the edges of the recording medium. The discarded ink is received by the ink absorbing sheet 659 in the ink receiving part. The received ink is permeated and diffused to the ink absorber 657 and held therein. Consequently, it is possible to prevent the generation of a mist due to the discarded ink, and furthermore, the waste ink is held quickly so that the ink can be prevented from scattering and leaking.

Figure 39:
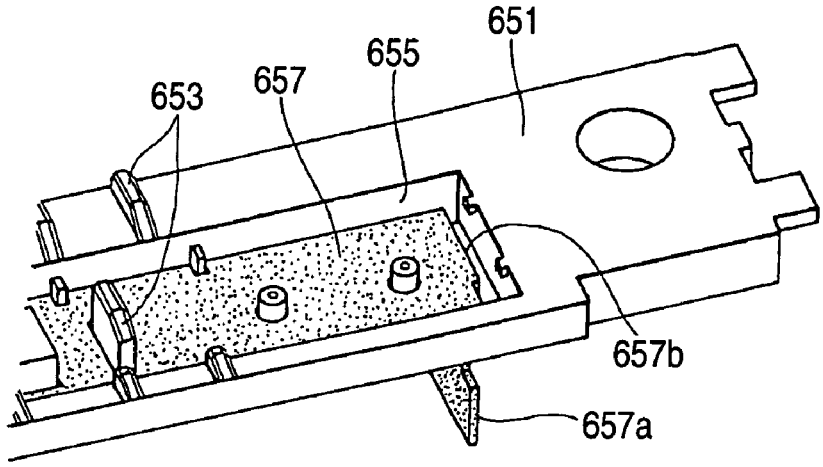
FIG. 39 is an enlarged perspective view showing a top side of one end portion of the platen of FIG. 37B.
Figure 40:
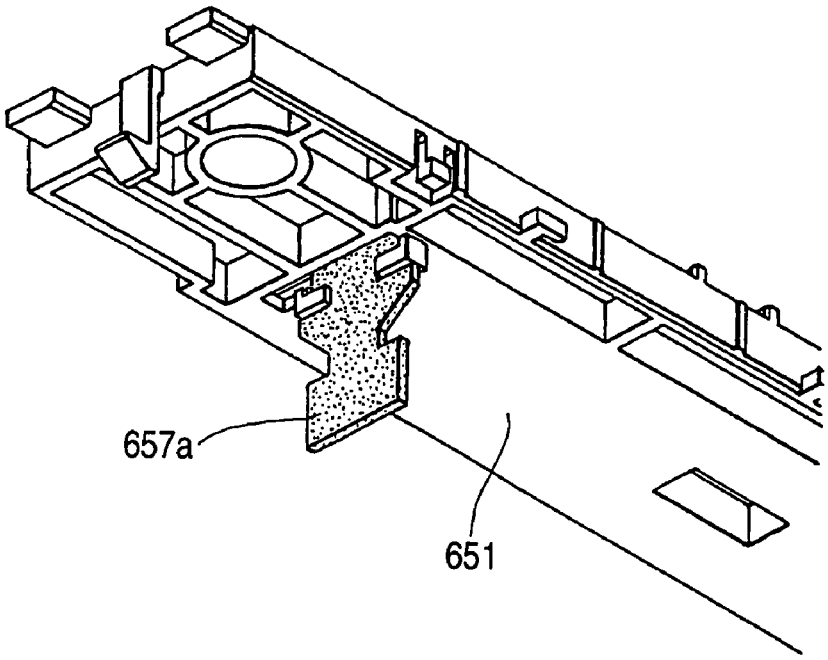
FIG. 40 is an enlarged perspective view showing a bottom side of the one end portion of the platen of FIG. 37B.

The ink absorber 657 is a thin and slender sheet-shaped member as shown in FIG. 38. One longitudinal end portion is narrowed to form a tongue piece 657*a* (third waste liquid absorber). The tongue piece 657*a* is bent to be directed downward and inserted into a through hole (not shown) formed in the substrate 651 of the platen 650 as shown in FIGS. 39 and 40. The tongue piece 657*a* is so formed as to be narrowed toward the distal end thereof, but the width thereof is again enlarged at the distal end portion. The enlarged portion serves as a retainer for retaining the ink absorber 657 on the platen 650.

The through hole (not shown) of the platen 650 is provided in a position shifted from the recording region. Accordingly, the ink absorber 657 extended in the concave portion 655 of the platen 650 is constituted to move the waste ink in a lateral direction and to lead the waste ink to the back side of the platen 650 via the tongue piece 657*a*.

While the material of the ink absorber 657 is not particularly restricted if it has a predetermined liquid absorbing performance, a porous material such as a polyvinyl formal based sponge (for example, Belleater manufactured by Kanebo Chemical Industries) can be used for a sponge material. Moreover, a porous material such as a sponge can also be used for the ink absorbing sheet 659. A material having a higher ink holding performance than that of the ink absorbing sheet 659 is used for the ink absorber 657. In a porous member having a liquid absorbing performance, generally, a lower void fraction tends to have a higher performance for absorbing and holding liquid such as ink. Accordingly, a material having a lower void fraction than the void fraction of the ink absorbing sheet 659 is suitable for the ink absorber 657.

The ink absorbing sheet 659 is formed to have a slightly greater thickness than the thickness of the ink absorber 657. By using, as the ink absorbing sheet 659, a material having a high void fraction and an excellent liquid permeability, moreover, clogging is caused by a pigment contained in the ink with difficulty. Consequently, an absorbing performance can be maintained for a long period of time.

As described above, the ink holding ability of the ink absorber 657 is greater than that of the ink absorbing sheet 659. Therefore, the waste ink ejected to the surface of the ink absorbing sheet 659 is permeated and absorbed in the ink absorbing sheet 659 and is then transferred to the ink absorber 657 to be the lower layer relatively quickly.

More specifically, the waste ink transferred to the ink absorber 657 is diffused through the void of the ink absorber 657 and is thus held, and furthermore, is led to the back side of the platen 650 along the tongue piece 657*a*.

Figure 41:
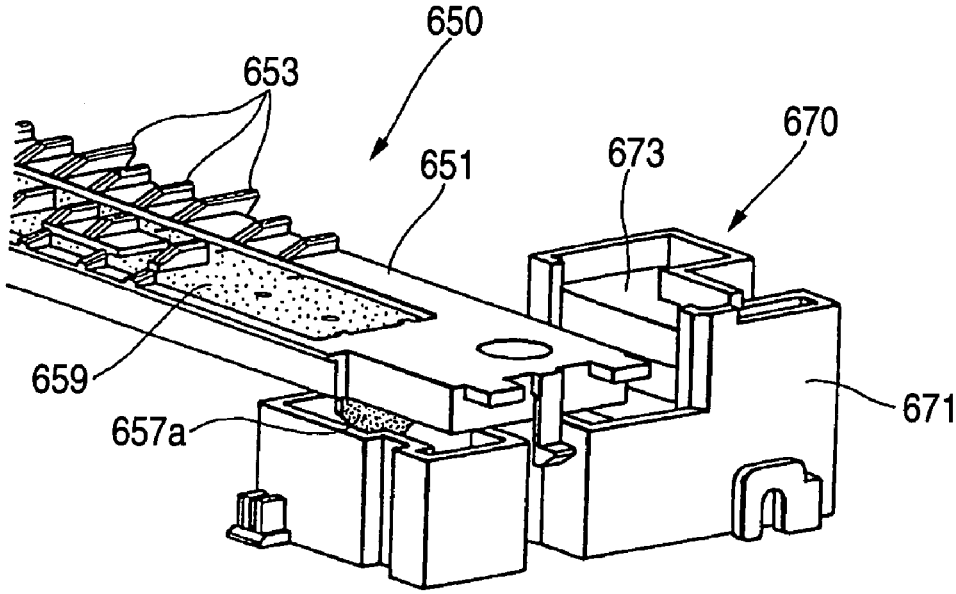
FIG. 41 is an enlarged perspective view showing a top side of the other end portion of the platen of FIG. 37B and a second waste ink tank incorporated in the ink jet printer of FIG. 34.
Figure 42:
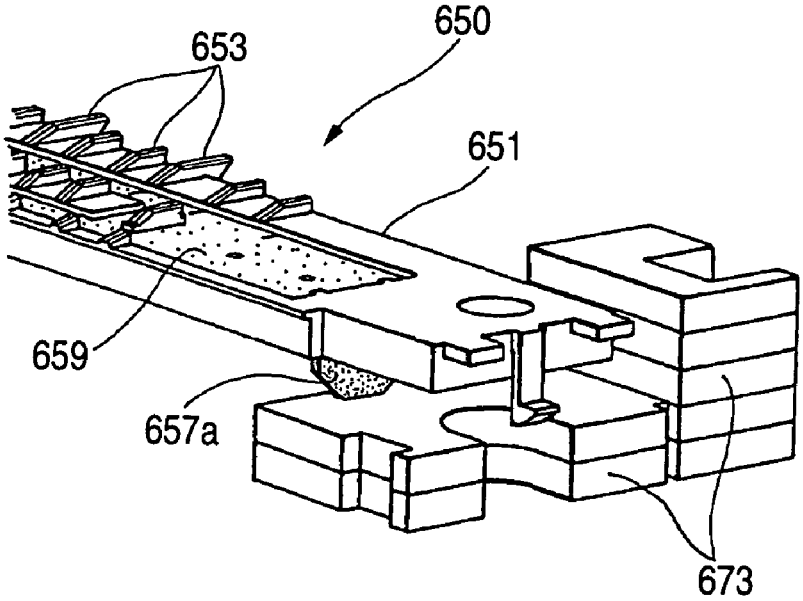
FIG. 42 is an enlarged perspective view showing a state that a case of the second waste ink tank of FIG. 41 is removed.

The second waste ink tank 670 is provided in the vicinity of the end on either side of the platen 650 with a positional relationship shown in FIG. 41. The second waste ink tank 670 is constituted to include a case 671 formed of a synthetic resin and an ink absorbing member 673 (second waste liquid absorber) provided therein. Any material of the ink absorbing member 673 which has a liquid absorbing performance can be used without a particular restriction and a sheet-shaped nonwoven fabric is laminated to constitute the ink absorbing member 673 in this embodiment. FIG. 42 shows a state in which the case 671 of the second waste ink tank 670 is removed.

The ink absorber 657 accommodated in the concave portion 655 of the platen 650 has the tongue piece 657*a* to be inserted in the through hole (not shown) of the platen 650 as described above. The tongue piece 657*a* is hung down to reach the ink absorbing member 673 of the second waste ink tank 670 from the platen 650 such that the enlarged distal end portion of the tongue piece 657*a* is inserted in the ink absorbing Member 673. The waste ink ejected to the ink receiving part of the platen 650 is permeated into the ink absorbing sheet 659 and is quickly led to the second waste ink tank 670 through the waste ink path communicating with the ink absorber 657 and the tongue piece 657*a*.

In the embodiment, the second waste ink tank 670 and the first waste ink tank 660 are provided separately. Consequently, the capacity of the second waste ink tank 670 can be minimized and can be provided in a relatively small space. Moreover, since the first waste ink tank 660 and the second waste ink tank 670 are provided to be shifted from the recording region in the primary scanning direction, the paper feeding tray 630 can be accommodated in the large space provided just below the recording region. In comparison with the printer in which the waste liquid tank is disposed just below the recording region, it is possible to efficiently utilize a limited space in the apparatus.

Figure 43:
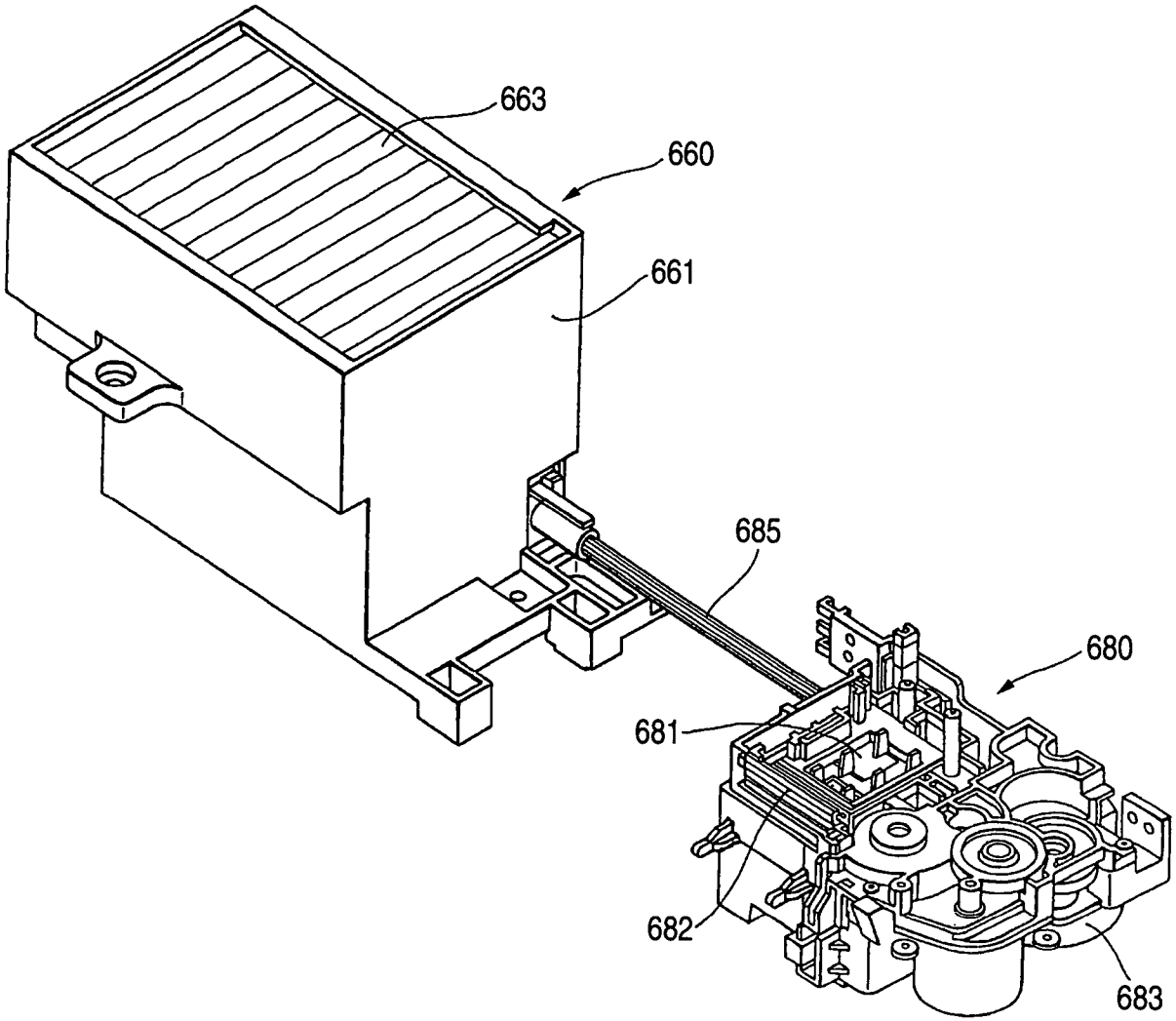
FIG. 43 is a perspective view showing a maintenance unit and a first waste ink tank incorporated in the ink jet printer of FIG. 34.

As shown in FIG. 43, the maintenance unit 680 is provided in a position corresponding to the home position of the carriage 613 (the vicinity of the right side frame 606 in FIG. 35). The maintenance unit 680 comprises the cap 681, a wiping member 682, and a suction pump 683 to execute capping, wiping and suction cleaning. The first waste ink tank 660 is connected to an inner side of the maintenance unit 680 via a waste ink tube 685 at a rear portion of the printer 601 to form a waste ink path.

The first waste ink tank 660 comprises a case 661 formed of a synthetic resin and an ink absorbing member 663 accommodated in the case 661. While any material having a liquid absorbing performance can be used for the ink absorbing member 663 without a particular restriction, a sheet-shaped nonwoven fabric is laminated in a lateral direction to constitute the ink absorbing member 663 in this embodiment. The first waste ink tank 660 is small-sized corresponding to the subtraction of the capacity of the second waste ink tank 670 and can be provided in the rear part of the maintenance unit 680 in the position shifted from the recording region in the primary scanning direction. In the printer 601, since a space can easily be taken in a vertical direction in the position where the first waste ink tank 660 is provided, the first waste ink tank 660 takes such a shape as to have a sufficient height. Correspondingly, the ink absorbing member 663 to be accommodated in the first waste ink tank 660 is laminated in the lateral direction so that the waste ink to be introduced from the lower part of the tank through the waste ink tube 685 can easily be permeated in an upward direction.

Next, an ink jet printer 700 as a liquid ejecting apparatus according to a seventh embodiment of the invention will be described with reference to FIGS. 44 through 51.

Figure 44:
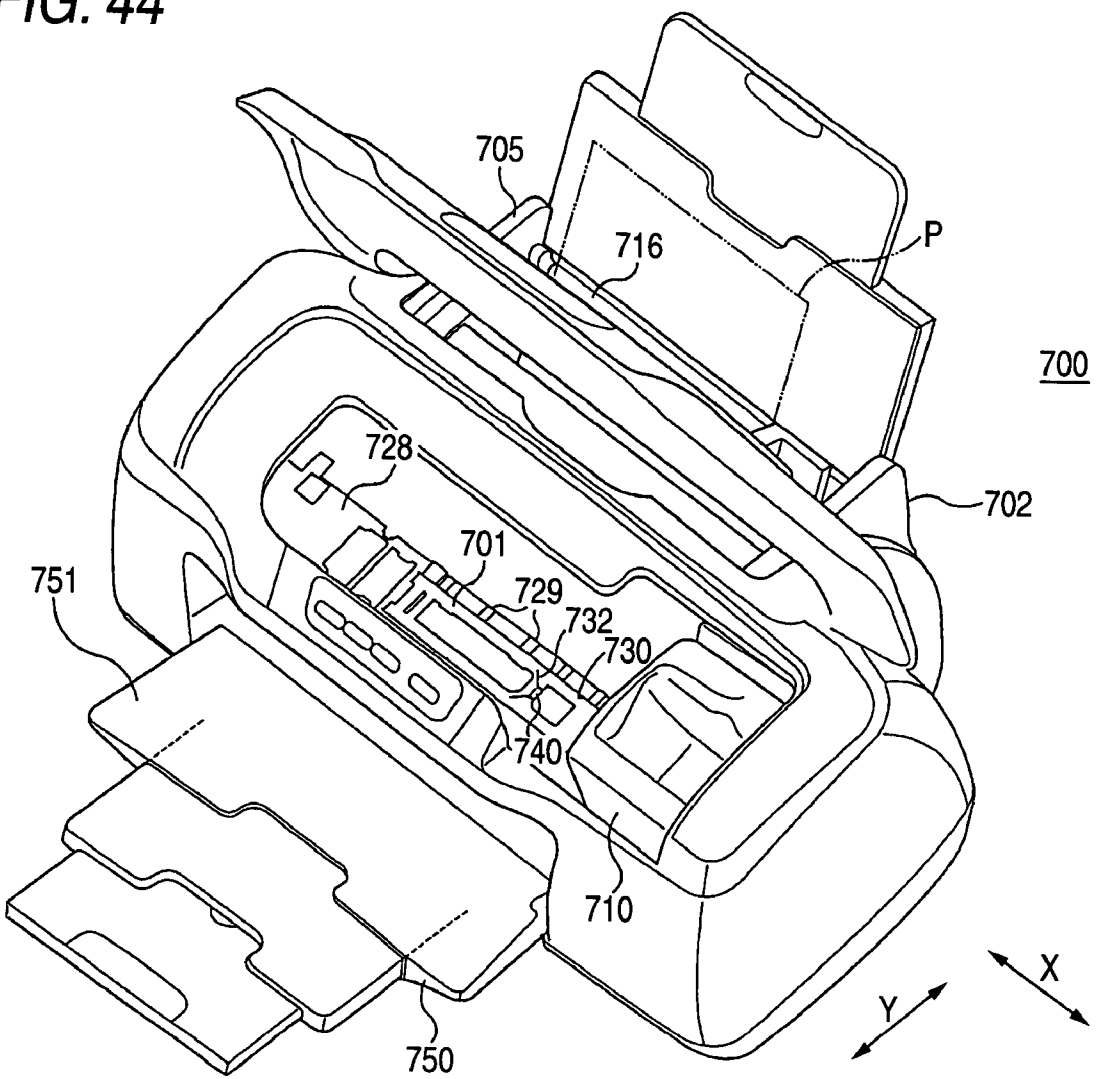
FIG. 44 is a perspective view showing an ink jet printer according to a seventh embodiment of the invention.
Figure 45:
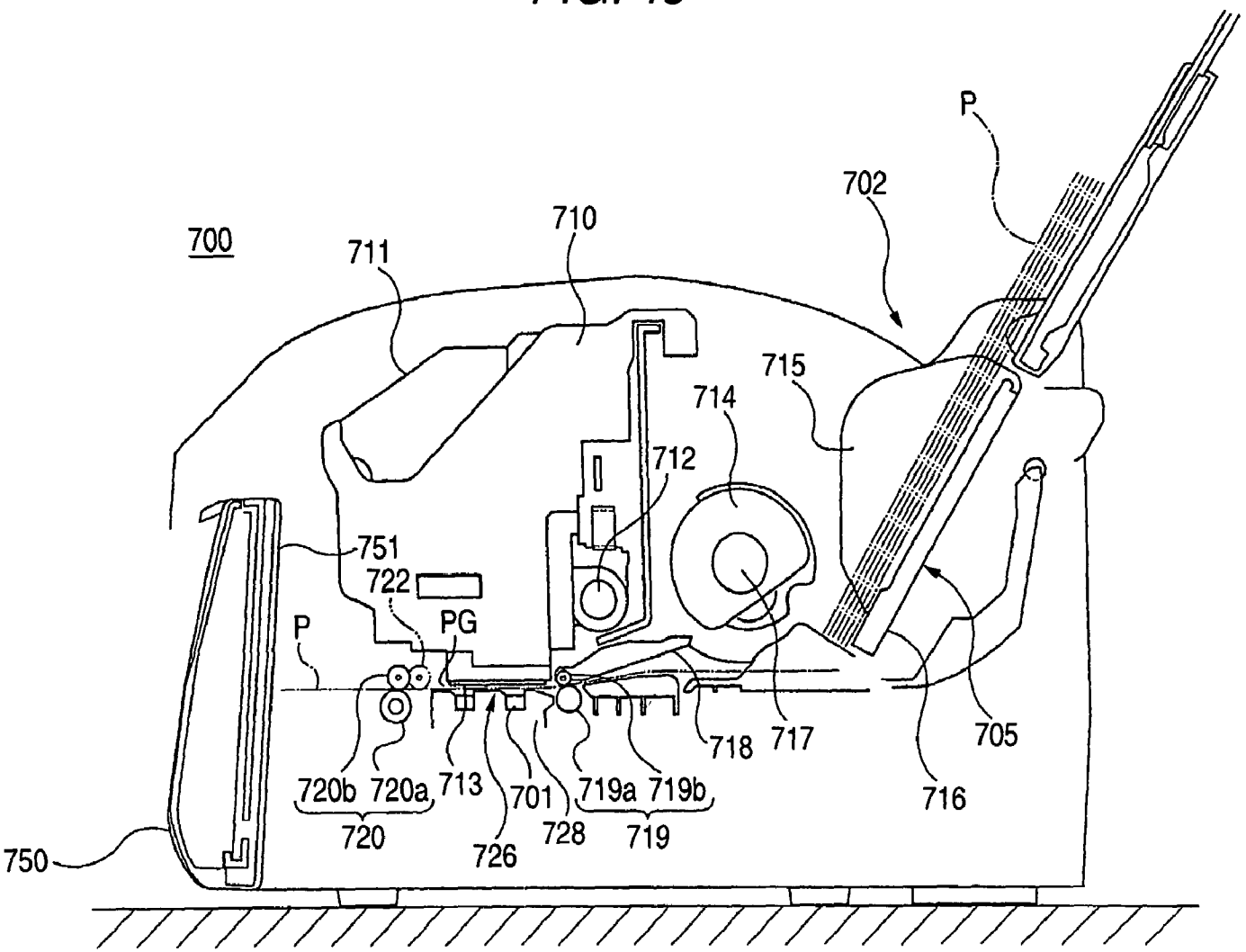
FIG. 45 is a schematic side view showing an internal configuration of the ink jet printer of FIG. 44.

As shown in FIG. 44, an ink jet printer 700 is provided with a carriage 710 supported pivotally by a guide shaft 712 to be reciprocatable in a primary scanning direction X for executing the recording operation with respect to a target medium such as paper P. A recording head 713 for ejecting ink G onto the paper P to carry out the recording is mounted on the carriage 710. Moreover, an ink cartridge 711 is attached to the carriage 710.

A platen 728 for defining a gap PG between the head surface of the recording head 713 and the paper P is provided below the recording head 713. By alternately repeating an operation for delivering the paper P between the carriage 710 and the platen 728 with a fixed pitch in a secondary scanning direction Y which is orthogonal to a primary scanning direction X, and ejecting ink from the recording head 713 onto the paper P during one reciprocation of the recording head 713 in the primary scanning direction X, the recording is carried out over the paper P.

Next, the structure of the ink jet printer 700 will be further described in accordance with a delivery path for the paper P. First of all, a feeding tray 705 for superposing the paper P is provided on the most upstream side in a delivery direction (the secondary scanning direction Y). Moreover, the feeding tray 705 is provided with an edge guide 715 abutting on the side edge of the paper P and guiding a smooth delivery in the secondary scanning direction Y. A hopper 716 is lifted in a predetermined timing with the rotation of a rotary shaft 717 of a feeding roller 714 so that the paper P put on the feeding tray 705 is pushed up toward the feeding roller 714.

The feeding tray 705, the feeding roller 714 and the hopper 716 constitute an automatic feeder 702 to pick up a unit number of paper P and sequentially feed them toward a downstream in the delivery direction with the aid of a separator disposed in the vicinity of the feeding roller 714.

A detector (not shown) for detecting the passage of the paper P is provided on the downstream of the feeding roller 714, and delivery rollers 719 constituted by a delivery driving roller 719*a* and a delivery driven roller 719*b* is provided on the downstream of the detector. The delivery driven roller 719*b* is rotatably supported at the downstream side of a pivotable roller holder 718. The delivery driven roller 719*b* is rotated and urged to bring a nip state in which it always comes in pressure contact with the delivery driving roller 719*a* by a torsion coil spring (not shown).

The paper P nipped by the delivery rollers 719 is led to a recording position 726 placed under the recording head 713, and desirable recording is executed over almost the whole recording surface of the paper P. The gap PG between the recording head 713 and the platen 728 is a very important factor for executing the recording with high precision and is properly regulated depending on a change in the thickness of the paper P.

Ejection rollers 720 constituted by an ejection driving roller 720*a* and an ejection driven roller 720*b* is provided on the downstream of the recording head 713, and the paper P ejected by the ejection roller 720 is further delivered to a stacking face 751 on an ejection stacker 750.

The ejection driven roller 720*b* is a toothed roller having a plurality of teeth on an outer periphery thereof, and is rotatably supported by a roller holder (not shown). An auxiliary roller 722 is provided on the upstream of the ejection driven roller 720*b* to urge the paper P downward.

An axis of the delivery driven roller 719*b* is positioned on a slight downstream side of an axis of the delivery drive roller 719*a*. An axis of the ejection driven roller 720*b* is positioned on a slight upstream side of an axis of the ejection drive roller 720*a*.

With such a structure, the paper P is brought into a curving state which is so called as a "reverse warpage" generating a slightly downward convex portion between the delivery rollers 719 and the ejection rollers 720, so that the paper P placed in an opposed position to the recording head 713 is pushed against the platen 728. Consequently, the floatation of the paper P can be prevented and the recording can be normally executed. The auxiliary roller 722 is constituted by the toothed roller as well as the ejection driven roller 720*b*, and is rotatably supported by a roller holder (not shown).

A rib 729 for supporting the paper P from below is directly formed on an opposed surface to the recording head 713 over the upper surface of the platen 728 for defining the gap PG between the paper P and the recording head 713. Moreover, the upper surface of the platen 728 is provided with a concave portion 730 for receiving the ink G which is ejected from the recording head 713 to the outside of the edges of the paper P to perform so-called marginless printing in which the printing is carried out without a margin at the end of the paper P.

Figure 46:
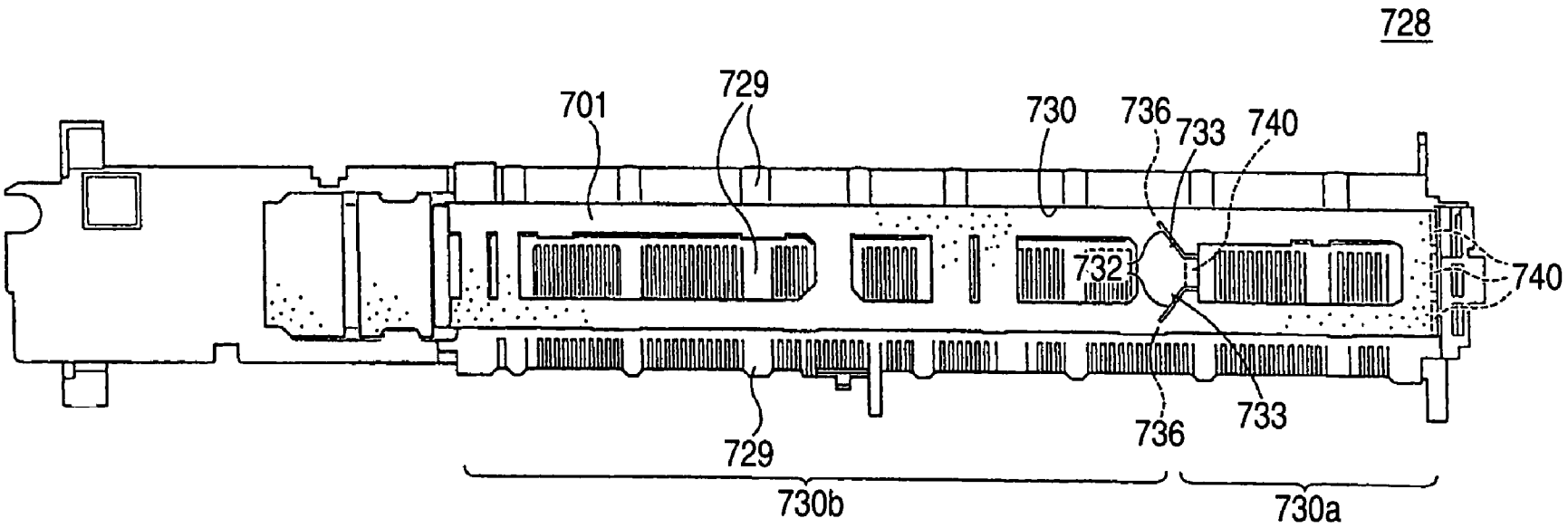
FIG. 46 is a plan view of a platen and an ink absorber incorporated in the ink jet printer of FIG. 44.
Figure 48:
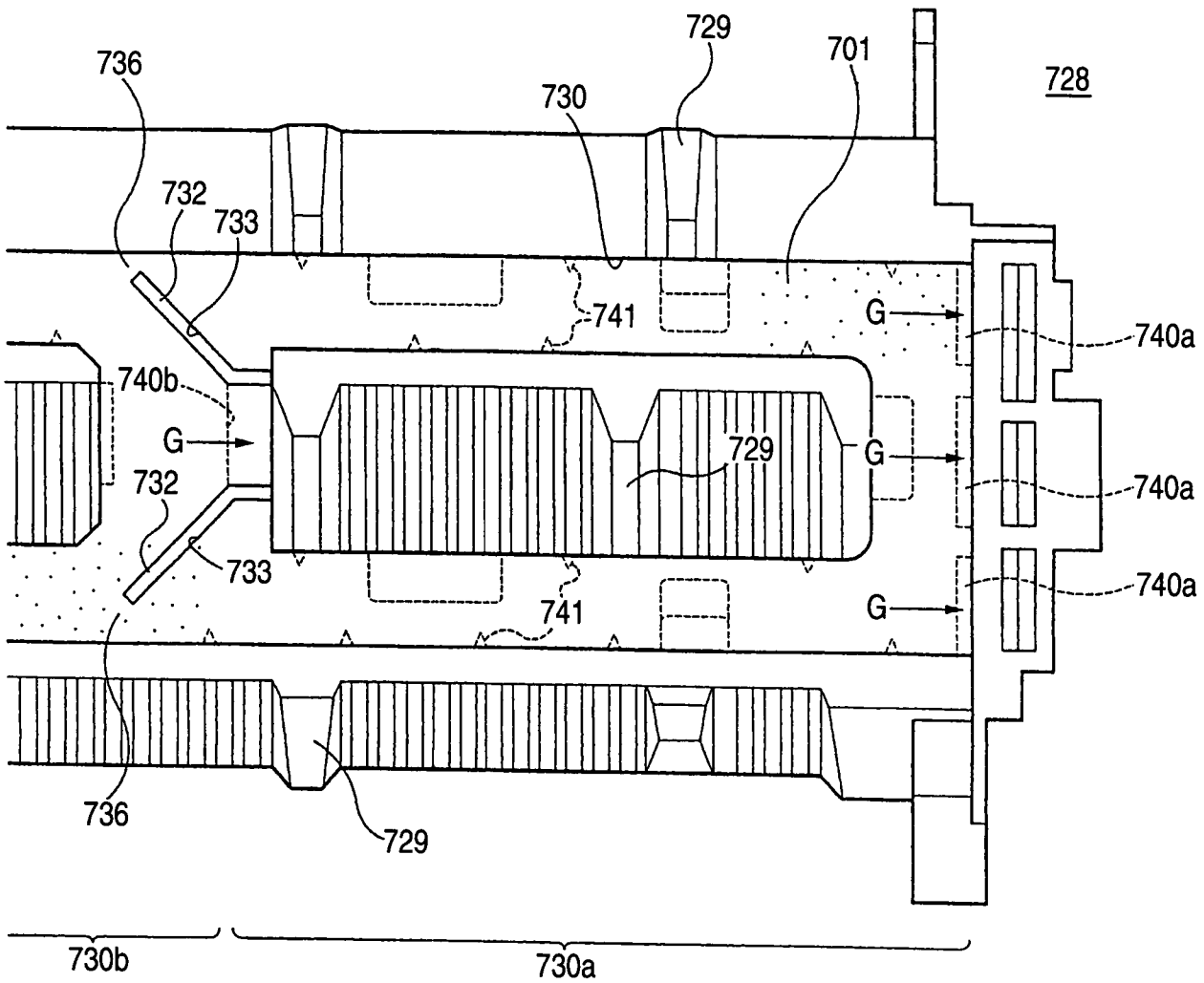
FIG. 48 is an enlarged plan view showing an essential portion of the platen of FIG. 46.
Figure 49:
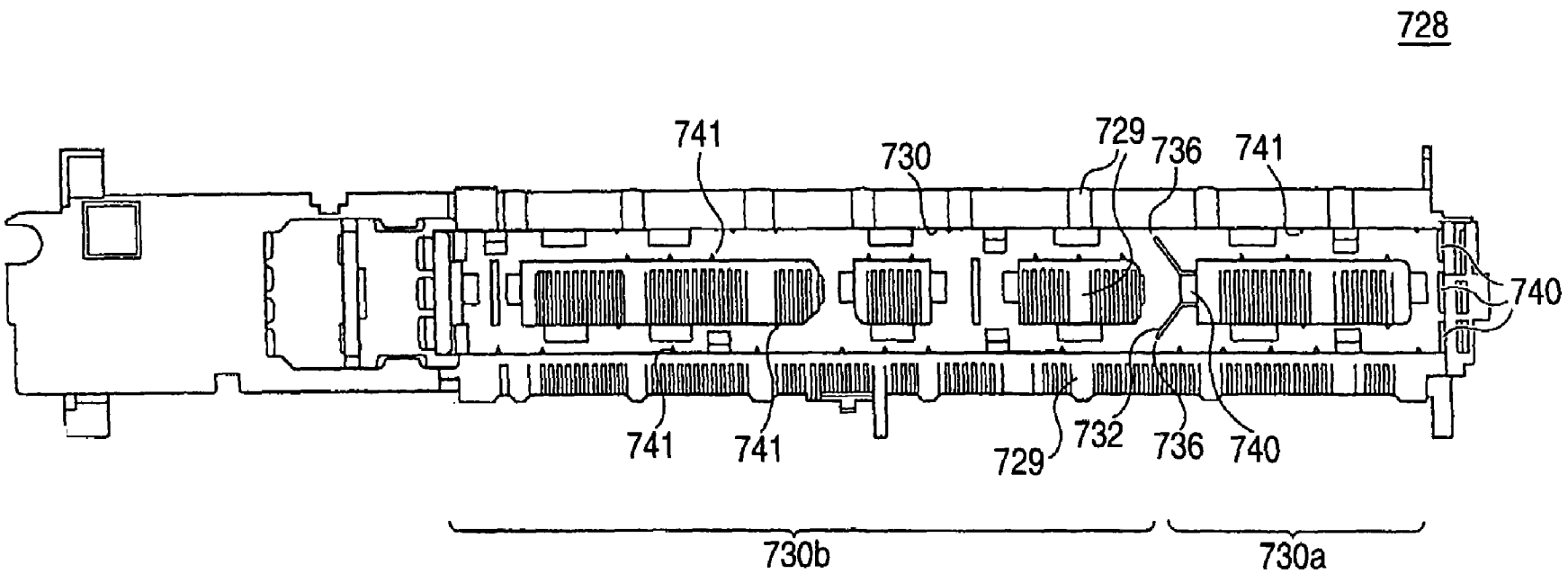
FIG. 49 is a plan view of the platen of FIG. 46.

An ink absorber 701 (first waste liquid absorber) is attached to the concave portion 730 for absorbing the discarded ink G and for leading the absorbed ink G to a waste ink tray 731 (described later in detail). The ink absorber 701 is excellent in an ink absorption, and furthermore, is formed by a material having a proper flexibility, for example, a foam (foaming) material. As shown in FIGS. 46 and 48, the ink absorber 701 is an integral plate-shaped member, and is formed with slits 733 penetrating the ink absorber 701 in the thickness direction into which dispersion walls 732 (described later) are inserted.

The dispersion walls 732 are provided close to one of ends in the longitudinal direction of the concave portion 730 of the platen 728 (on the home position side of the carriage 710 in the example). The dispersion walls 732 are two rib-shaped projections extending in the longitudinal direction of the platen 728. Gaps 736 are formed between the distal ends of the dispersion walls 732 and longitudinal side walls of the concave portion 730.

The height of the dispersion walls 732 is set in such a manner that the dispersion walls 732 are not exposed to the top face of the ink absorber 701. More specifically, the height of the dispersion walls 732 is equal to or less than the thickness of the ink absorber 701.

The dispersion walls 732 also serve to partition the concave portion 730 into plural areas 730*a* and 730*b*, thereby forming an ink leading path for each of the areas 730*a* and 730*b*.

In addition, a plurality of holes 740*a*, 740*b* for leading the ink G flowing in the concave portion 730 into the waste ink tray 731 are formed on the bottom face of the concave portion 730, and a plurality of retaining claws 741 are provided on the side walls of the concave portion 730 for retaining the ink absorber 701 within the concave portion 730.

A main chute 737 having a U-shaped section is vertically extended downward in the vicinity of the side edge of the holes 740*a* situated in the home position side of the platen 728.

On the other hand, an auxiliary chute 738 having a U-shaped section is extended downward in the vicinity of the side edge of the hole 740*b* in another portion of the platen 728. The extending angle of the auxiliary chute 738 relative to the bottom face of the concave portion 730 is so determined as to directed somewhat downward when the platen 728, which usually takes a horizontal posture, is placed so as to take a vertical posture.

In this embodiment, the dispersion walls 732 partition the concave portion 730 into two areas, that is, the area 730*a* closer to the home position and the area 730*b* closer to a flushing position which is an opposite side of the home position relative to the recording region.

Figure 47:
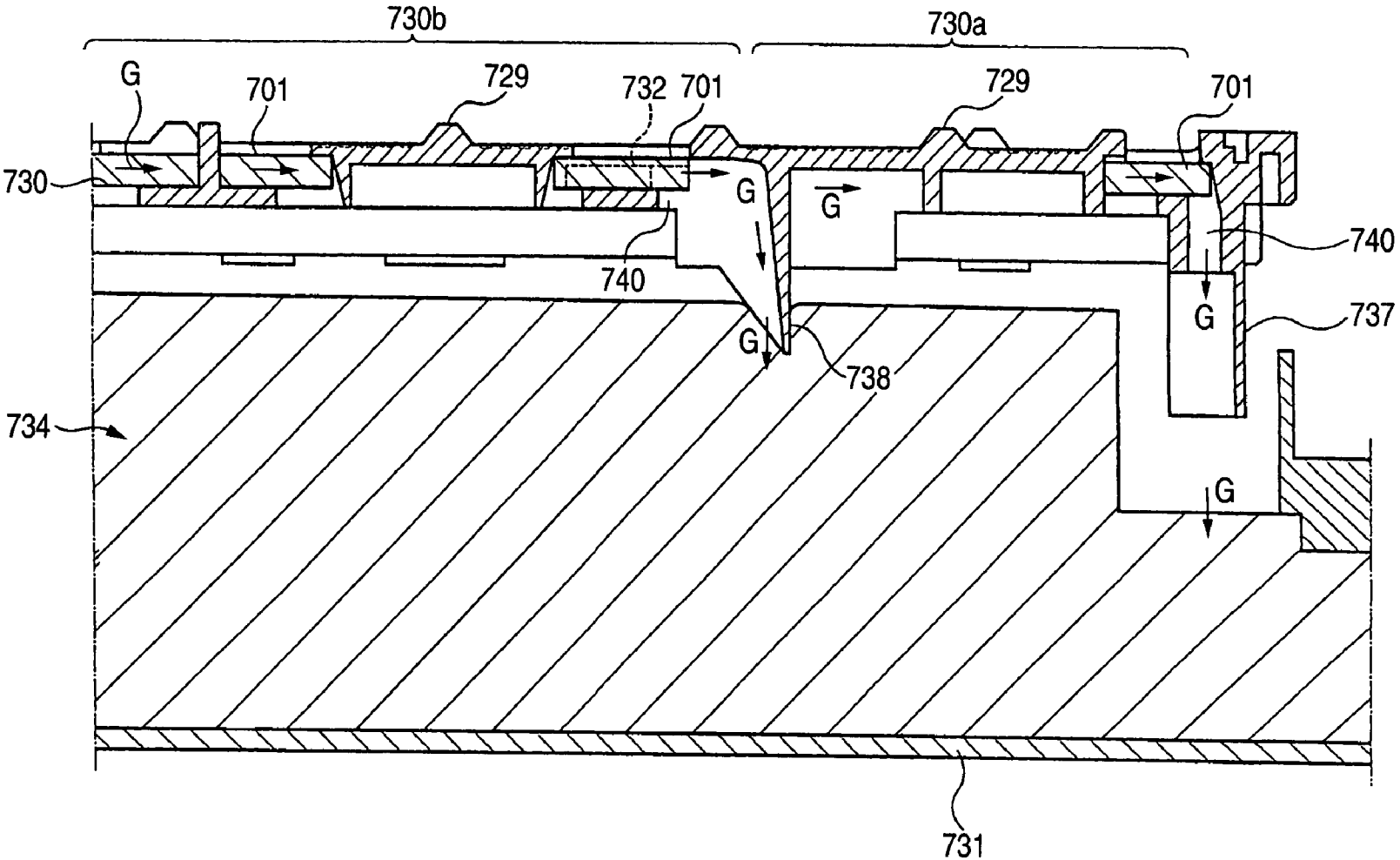
FIG. 47 is a section view showing ink leading paths formed by the platen and the ink absorber of FIG. 46.

An ink leading path originated from the area 730*a* is constituted by the holes 740*a*, the main chute 737 and an ink absorber 734 (second waste liquid absorber) disposed in the waste ink tray 731. As shown in FIG. 47, not only the ink G permeating into the ink absorber 701 in the area 730*a*, but also the ink G permeating into the ink absorber in the area 730*b* flow into the holes 740*a* by passing through the gaps 736 or getting over the dispersion walls 732.

On the other hand, an ink leading path originated from the area 730*b* is constituted by the hole 740*b*, the auxiliary chute 738 and the ink absorber 734 disposed in the waste ink tray 731. Only the ink G permeating into the ink absorber 701 in the area 730*b* flows into the hole 740*b* while being guided by the dispersion walls 732.

The ink G entered from the hole 740*b* flows downward along the inclination of the auxiliary chute 738 and reaches the highest portion of the ink absorber 734. Accordingly, the ink G permeating into the ink absorber 701 does not converge on one portion even if the ink jet printer 700 is inclined, and the dispersed ink G is recovered into the waste ink tray 731.

Figure 50A:
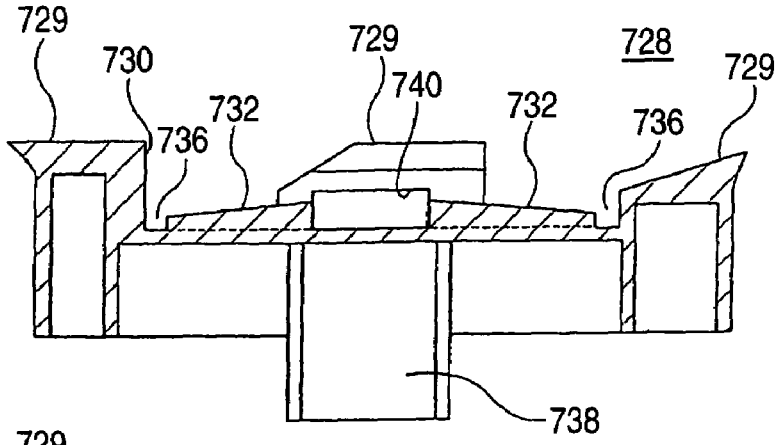
FIG. 50A is a section view showing a first modified example of the platen of FIG. 46.
Figure 50B:
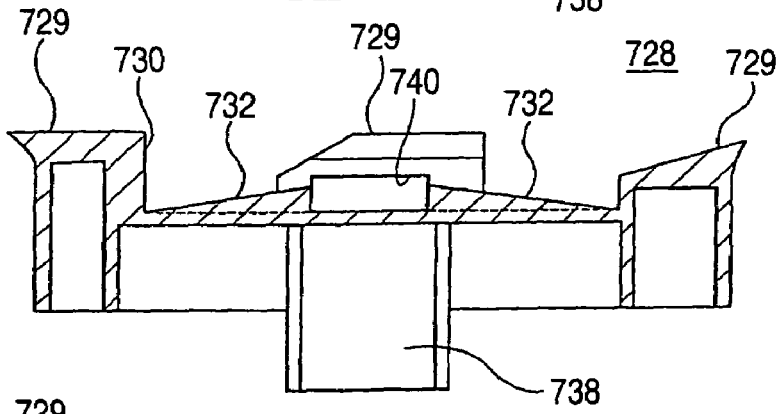
FIG. 50B is a section view showing a second modified example of the platen of FIG. 46.
Figure 50C:
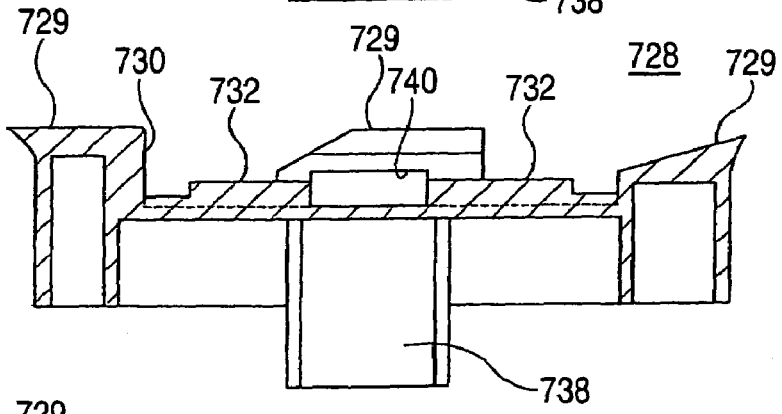
FIG. 50C is a section view showing a third modified example of the platen of FIG. 46.

The height of the dispersion walls 32 may not be uniform. For example, as shown in FIGS. 50A and 50B, the height of the dispersion walls 732 may be gradually decreased toward the side walls of the concave portion 730. Alternatively, as shown in FIG. 50C, the height of the dispersion walls 732 may be decreased in a stepped manner at the distal end portions thereof.

Figure 50D:
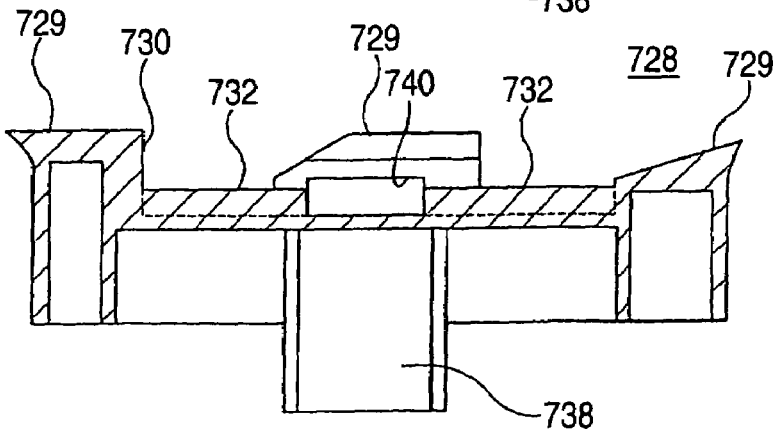
FIG. 50D is a section view showing a fourth modified example of the platen of FIG. 46.
Figure 51:
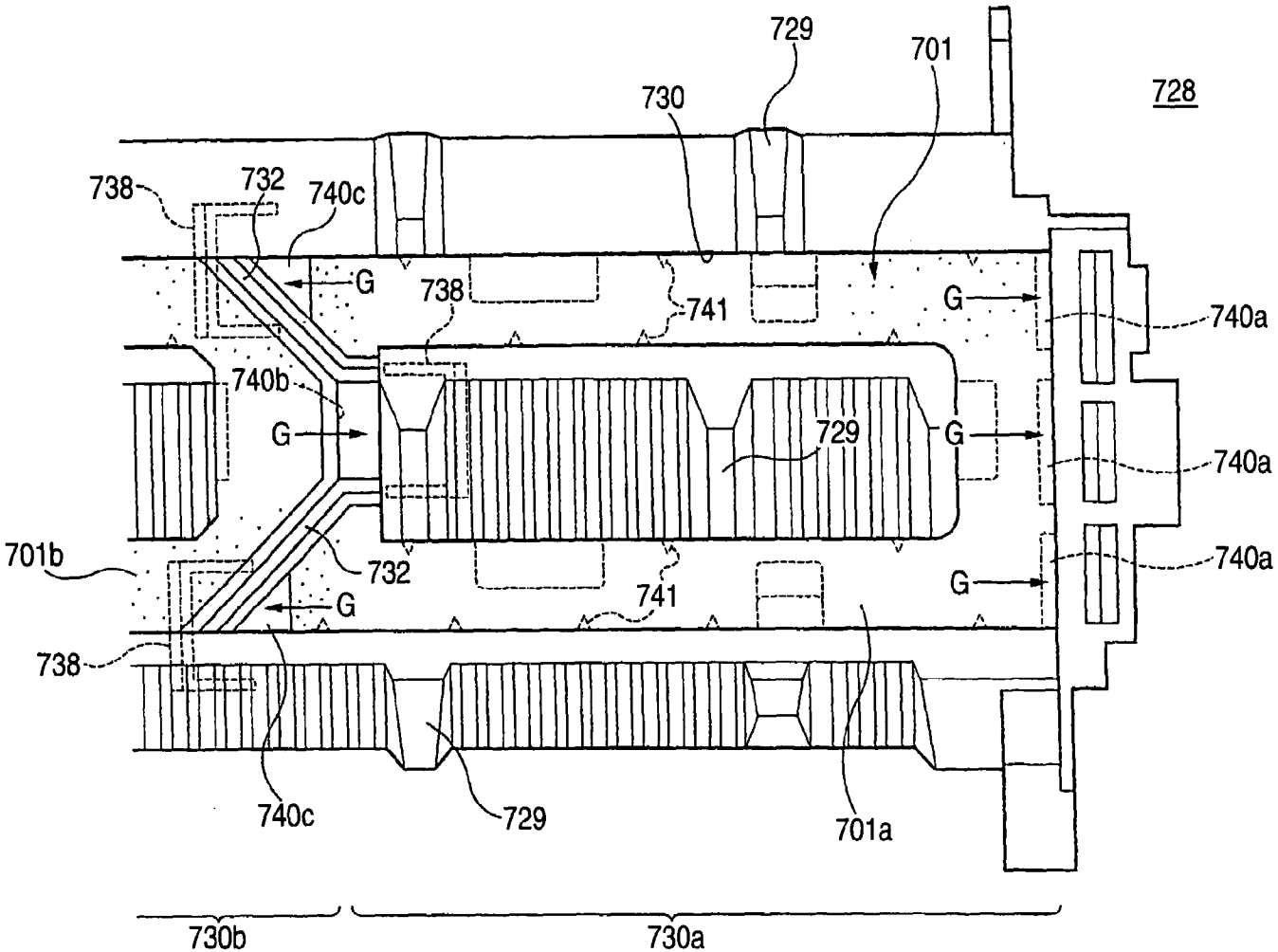
FIG. 51 is an enlarged plan view showing an essential portion of the platen of FIG. 50D.
Figure 52:
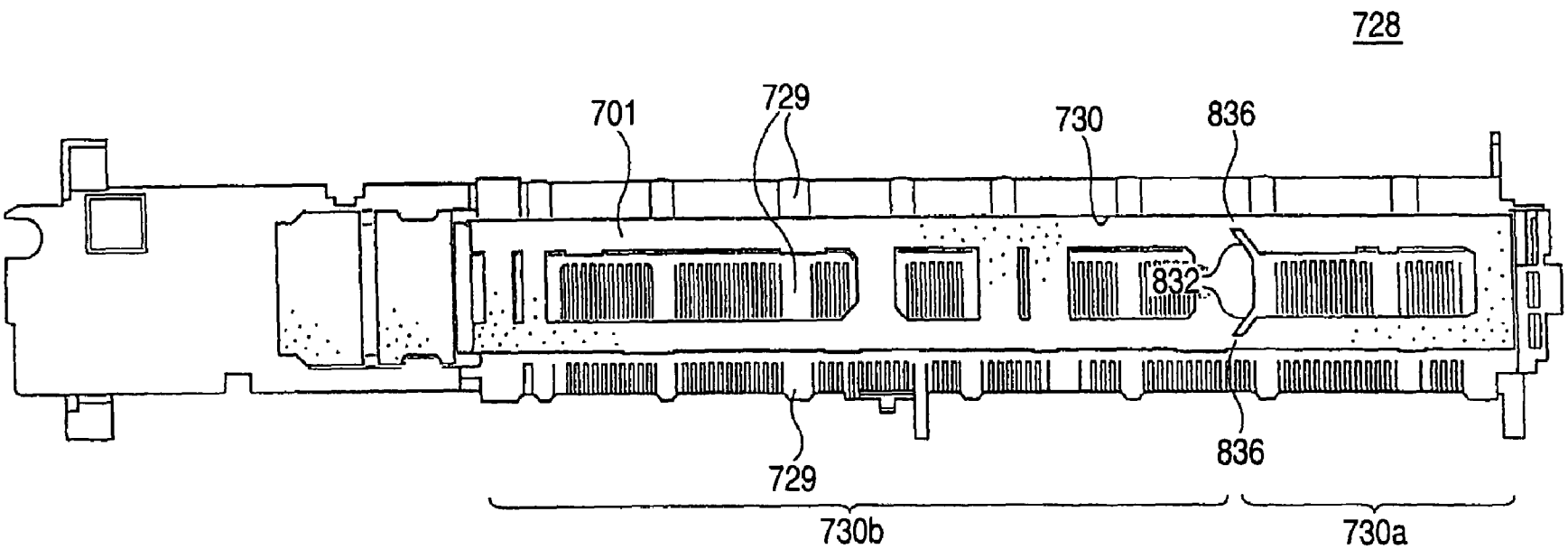
FIG. 52 is a plan view of a platen and an ink absorber incorporated in an ink jet printer according to an eight embodiment of the invention.

Further, as shown in FIGS. 50B and 50D, the gaps 736 may be omitted. In the case of FIG. 50D, since the inside of the concave portion 730 is completely partitioned by the dispersion walls 732, there may be adopted the configuration shown in FIG. 51.

In this case, the ink absorber 701 is constituted by two members, that is, an absorber element 701*a* on the home position side and an absorber element 701*b* on the flushing position side. These elements 701*a* and 701*b* are attached separately to the areas 730*a* and 730*b*, respectively.

In the concave portion 730, a hole 740*b* is formed in the vicinity of the proximal ends of the dispersion walls 732, and a pair of holes 740*c* are formed in the vicinity of connecting portions between the respective dispersion walls 732 and the side walls of the concave portion 730. Auxiliary chutes 738 are provided for the respective holes 740*b*, 740*c* so as to extend downward at a predetermined angle.

When the platen 728 having the above configuration is inclined with the home position side set onto a lower side, the ink G permeating into the absorber element 701*b* on the flashing position side is guided by one side (the left side in this figure) of the dispersion walls 732 and flows into the hole 740*b*, and reaches the ink absorber 734 in the waste ink tray 731 along the auxiliary chute 738 associated with the hole 740*b*. To the contrary, when the platen 728 is inclined with the flashing position side set onto the lower side, the ink G permeating into the absorber element 701*a* on the home position side is guided by the other side (the right side in this figure) of the dispersion walls 732 and flows into the two holes 740*c*, and reaches the ink absorber 734 in the waste ink tray 731 along each of the auxiliary chutes 738 associated with the holes 740*c*.

Next, an eighth embodiment of the invention will be described with reference to FIGS. 52 through 56. The members similar to those in the seventh embodiment will be designated by the same reference numerals and the repetitive explanations for those will be omitted.

In this embodiment, ink leading slits 832 are formed in the ink absorber 701 close to one of the ends thereof on the home position side of the carriage 10. The ink leading slits 832 serve as invisible air walls. The air walls are called for convenience because an advance of the ink G coming to the ink leading slits 832 is impeded as if there is a wall. The ink G is thus started to flow along the inclination of the ink leading slits 832.

The ink leading slits 832 also serve to partition the concave portion 730 into plural areas 730*a* and 730*b*.

Figure 54:
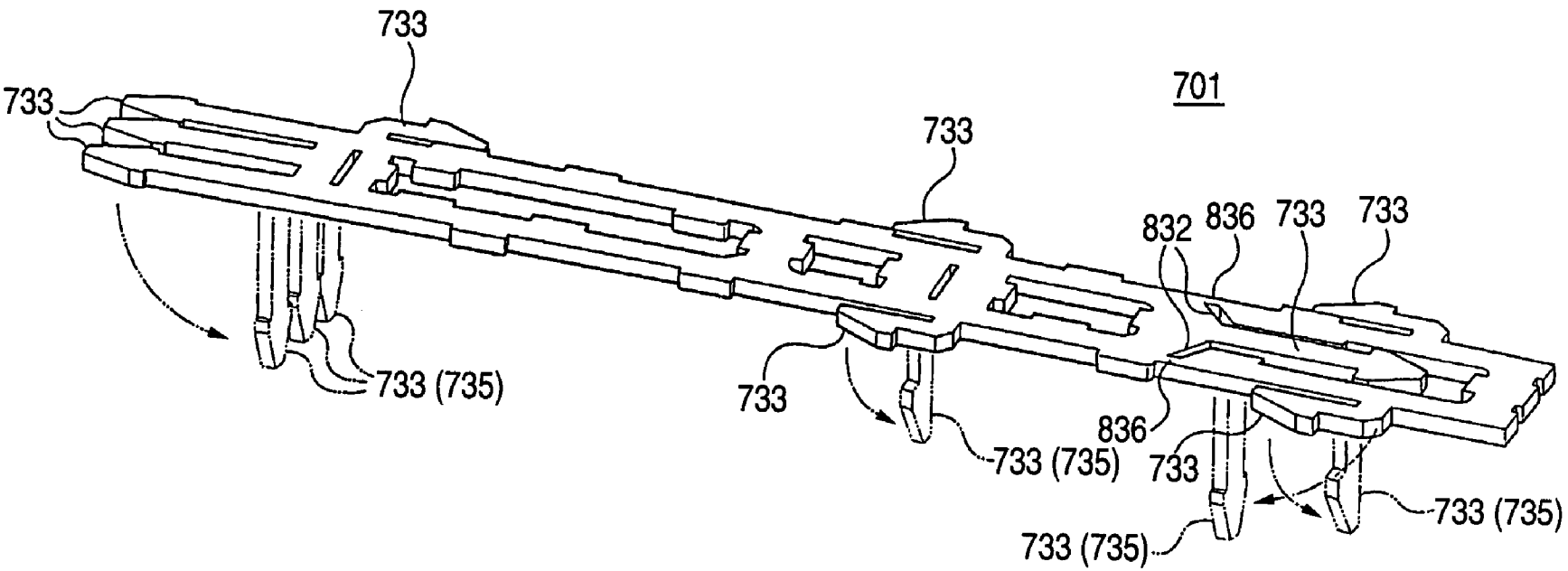
FIG. 54 is a perspective view of the ink absorber of FIG. 52.

In this embodiment, as shown in FIG. 54, tongue pieces 733 each having a hook or arrow-shaped distal end are formed on plural points on the outer periphery of the ink absorber 701 (including both longitudinal end portions thereof).

Figure 55:
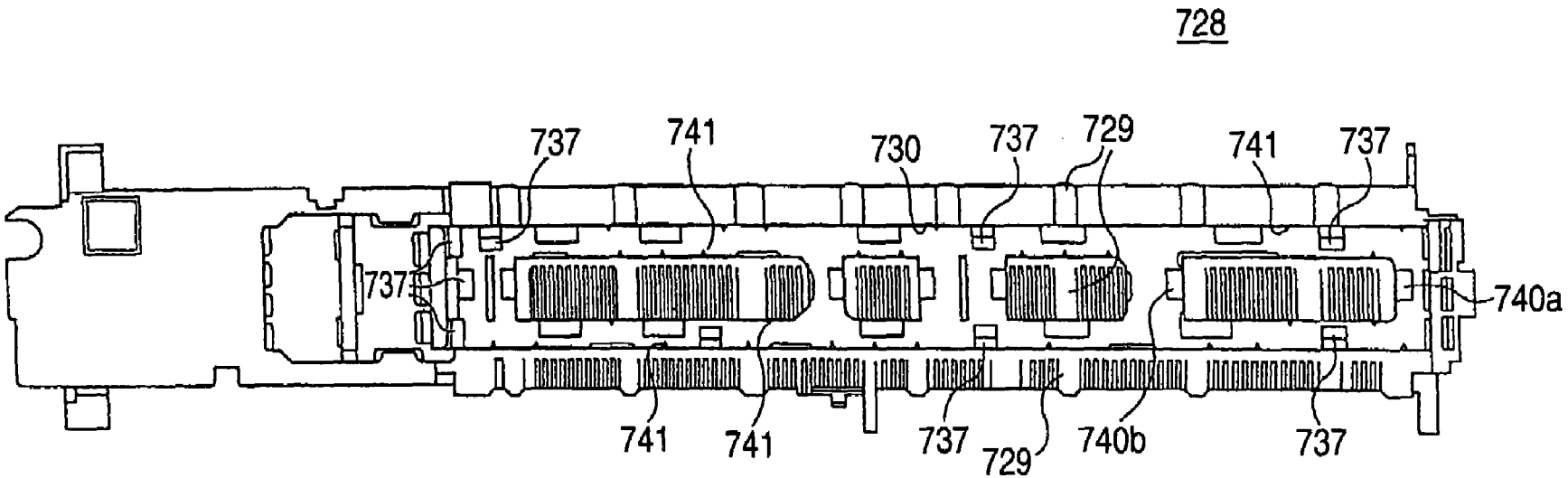
FIG. 55 is a plan view of the platen of FIG. 52.

The tongue pieces 733 are bent to be directed downward (as indicated by phantom lines in FIG. 54 and to be used for attaching the ink absorber 701 to the concave portion 730 of the platen 728 by inserting the tongue pieces 733 into through holes 737 formed in the concave portion 730 (see FIG. 55). The tongue pieces 733 serve as guide portions 35 (third waste liquid absorber) for promoting the flow of the ink G into the waste liquid tray 31.

The ink leading slits 832 is so formed as to remain continuous parts 836 (see FIGS. 52 and 54) so that the ink absorber 701 is provided as an integral member.

In addition, a plurality of holes 740*a*, 740*b* for leading the ink G flowing in the concave portion 730 into the waste ink tray 731 are formed on the bottom face of the concave portion 730, and a plurality of retaining claws 741 are provided on the side walls of the concave portion 730 for retaining the ink absorber 701 within the concave portion 730.

A plurality of chutes 738 having a U-shaped section are extended downward in the vicinity of the side edge of the holes 740*a*, 740*b*.

The extending angle of the chutes 738 relative to the bottom face of the concave portion 730 is so determined as to directed somewhat downward when the platen 728, which usually takes a horizontal posture, is placed so as to take a vertical posture.

Figure 53:
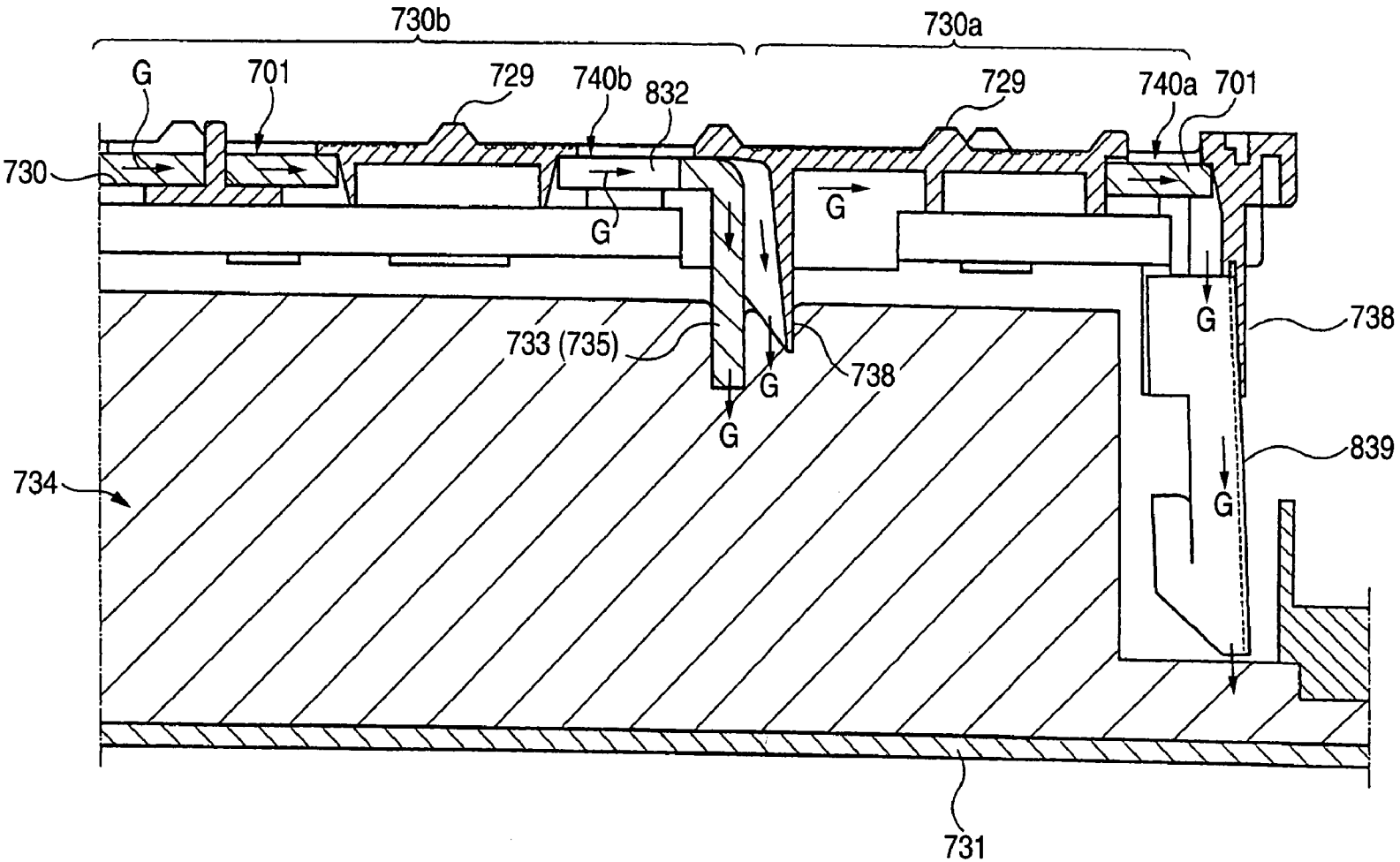
FIG. 53 is a section view showing ink leading paths formed by the platen and the ink absorber of FIG. 52.

Further, as shown in FIG. 53, there is provided a guard member 839 which is continued from the chute 738 of the home position side to reliably eliminate the overflow of the ink G from the end portion of the platen 728 closer to the home position of the carriage 710.

An ink leading path originated from the area 730*a* is constituted by the hole 740*a*, the chute 738, the guard member 839 and an ink absorber 734 (second waste liquid absorber) disposed in the waste ink tray 731. As shown in FIG. 47, not only the ink G permeating into the ink absorber 701 in the area 730*a*, but also the ink G permeating into the ink absorber in the area 730*b* flow into the hole 740*a* by passing through the continuous parts 836.

The ink G entered from the hole 740*a* flows downward along the inclination of the chute 738 and the lumiler 739, and reaches the lower portion of the ink absorber 734.

On the other hand, an ink leading path originated from the area 730*b* is constituted by the hole 740*b*, the chute 738 and the ink absorber 734 disposed in the waste ink tray 731. Only the ink G permeating into the ink absorber 701 in the area 730*b* flows into the hole 740*b* while being guided by the ink leading slits 832.

The ink G entered from the hole 740*b* flows downward along the inclination of the chute 738 and reaches the upper portion of the ink absorber 734.

In addition to the above ink leading paths, the ink G is led to the ink absorber 734 via the guide portions 735 as shown in FIG. 53.

Accordingly, the ink G permeating into the ink absorber 701 does not converge on one portion even if the ink jet printer 700 is inclined, and the dispersed ink G is recovered into the waste ink tray 731.

Figure 56:
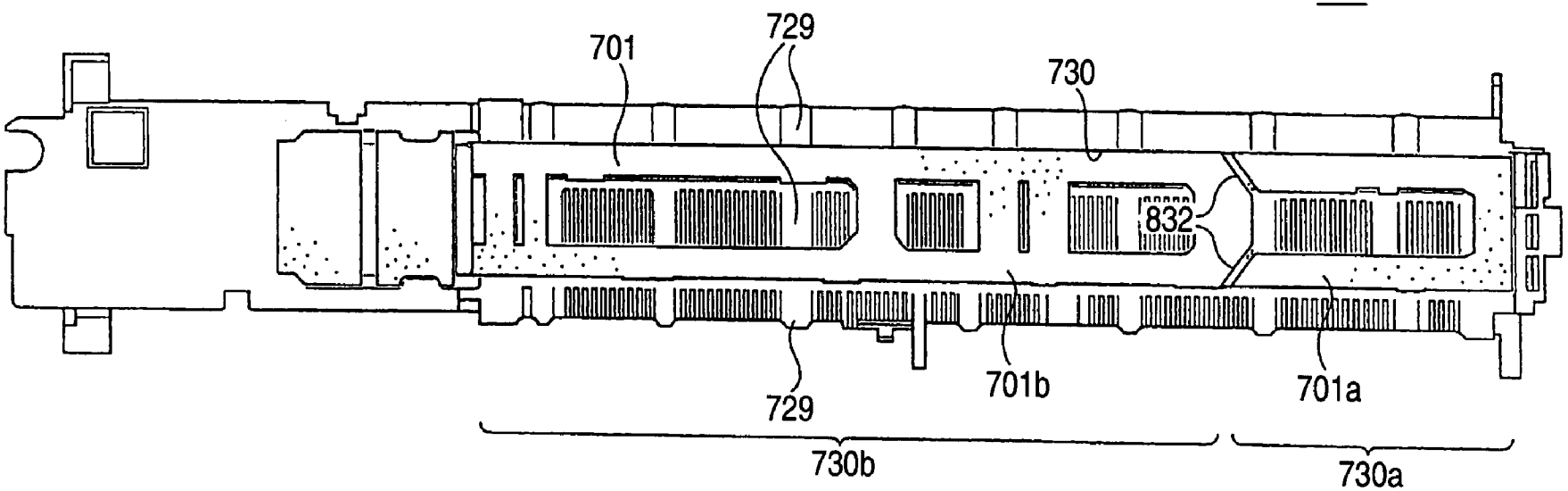
FIG. 56 is a plan view of a modified example of the platen and the ink absorber of FIG. 52.

As shown in FIG. 56, the ink absorber 701 may be constituted by a plurality of members.

Specifically, the ink absorber 701 is constituted by two members, that is, an absorber element 701*a* on a home position side and an absorber element 701*b* on a flashing position side and is provided in such a manner that a gap 832 is formed therebetween. In such a case, the gap 832 between the absorber elements 701*a* and 701*b* serve as an air wall as discussed the above. Accordingly, the continuous parts 836 are absent in this example.

While the printer for ejecting ink (the printing apparatus including a facsimile and a copier) has been described as the liquid ejecting apparatus in the above embodiments, a liquid ejecting apparatus for ejecting another liquid may be employed. For example, it is also possible to employ a liquid ejecting apparatus for ejecting a liquid such as an electrode material or a colorant which is used for manufacturing a liquid crystal display, an EL display or an FED (a field emission display), a liquid ejecting apparatus for ejecting a biological organic matter to be used for manufacturing a biochip or a sample ejecting apparatus to be a precision pipette.

What is claimed is:

1. A liquid ejecting apparatus, comprising:

a liquid ejecting head, operable to move in a first direction;

a platen, opposed to the liquid ejecting head to support an object to which a liquid droplet is ejected from the liquid ejecting head and to define a gap between the liquid ejecting head and the object, the platen formed with a groove hole to which a liquid droplet deviated from an edge of the object is disposed, and through holes formed in a bottom portion of the groove hole and arranged in the first direction;

a first liquid absorber, provided in the groove hole;

a second liquid absorber at least a part of which is arranged below the platen to receive liquid dropped through the through holes; and at least one liquid leading member, extending through at least one of the through holes to lead liquid absorbed by the first liquid absorber to the second liquid absorber.

2. The liquid ejecting apparatus as set forth in claim 1, wherein the liquid leading member is a third liquid absorber having a liquid absorbance higher than a liquid absorbance of the first liquid absorber.

3. The liquid ejecting apparatus as set forth in claim 2, wherein a liquid absorbance of the second liquid absorber is higher than the liquid absorbance of the third liquid absorber.

4. The liquid ejecting apparatus as set forth in claim 1, wherein the through hole in which the liquid leading member is provided is placed at a position where a flushing operation of the liquid ejecting head is performed.

5. The liquid ejecting apparatus as set forth in claim 4, wherein the position at which the flushing operation is performed is not located at a home position of the liquid ejecting head.

6. The liquid ejecting apparatus as set forth in claim 1, wherein the through hole in which the liquid leading member is provided is placed at a position where a lower position of the platen which is an inclined state in connection with the first direction.

7. The liquid ejecting apparatus as set forth in claim 1, wherein the liquid ejecting apparatus is an ink jet recording apparatus in which an ink droplet is ejected toward a target medium supported by the platen.

8. The liquid ejecting apparatus as set forth in claim 1, wherein the liquid leading member is an individual member comprised of a porous material.

9. The liquid ejecting apparatus as set forth in claim 1, wherein the liquid leading member is a sheet-like member having a portion to be extended through the at least one of the through holes.

10. The liquid ejecting apparatus as set forth in claim 9, wherein the liquid leading member has a size which is at least equal to a movable range of the liquid ejecting head in the first direction.

11. The liquid ejecting apparatus as set forth in claim 9, wherein the liquid leading member is fitted into the groove hole, and the first liquid absorber is laminated thereon.

12. The liquid ejecting apparatus as set forth in claim 1, wherein a tip end of the liquid leading member which is to be brought into contact with the second liquid absorber is cut out obliquely.

13. The liquid ejecting apparatus as set forth in claim 1, wherein a liquid absorbance of the liquid leading member is different from a liquid absorbance of the second liquid absorber.

14. The liquid ejecting apparatus as set forth in claim 1, wherein the first liquid absorber is comprised of a material having a first density, and the liquid leading member is comprised of a material having a second density.

15. The liquid ejecting apparatus as set forth in claim 1, wherein the platen is operable to support a plurality of objects having different sizes, and the through holes are located so as to correspond to edges of the objects.

16. A waste liquid treating device, comprising:

a platen, opposed to a liquid ejecting head of a liquid ejecting apparatus, to support an object to which a liquid droplet is ejected from the liquid ejecting head, the platen formed with a groove hole to which a liquid droplet deviated from an edge of the object is disposed, and a through hole formed in a bottom portion of the groove hole;

a first liquid absorber, provided in the groove hole;

a second liquid absorber at least a part of which is arranged below the platen to receive liquid dropped through the through hole;

a liquid leading member, extending through the through hole to lead liquid absorbed by the first liquid absorber to the second liquid absorber; and a guide member, which regulates an attitude and a position of the liquid leading member.

17. The waste liquid treating device as set forth in claim 16, wherein the guide member is a sheet member formed with a slit through which the liquid leading member extends.

18. The waste liquid treating device as set forth in claim 17, wherein the sheet member is comprised of an elastic resin material.

19. The waste liquid treating device as set forth in claim 17, wherein a portion of the sheet member in which no slit is formed is opposed to an electronic unit of the liquid ejecting apparatus.

20. The waste liquid treating device as set forth in claim 16, further comprising a cover member, which covers an upper portion of the second liquid absorber while retaining the guide member.

21. The waste liquid treating device as set forth in claim 16, wherein the liquid leading member is integrally formed with the first liquid absorber.

22. A waste liquid treating device, comprising:

a platen, opposed to a liquid ejecting head of a liquid ejecting apparatus, to support an object to which a liquid droplet is ejected from the liquid ejecting head, the platen formed with a groove hole to which a liquid droplet deviated from an edge of the object is disposed, and a through hole formed in a bottom portion of the groove hole;

a first liquid absorber, provided in the groove hole;

a second liquid absorber at least a part of which is arranged below the platen to receive liquid dropped through the through hole; and a liquid leading member, extending through the through hole to lead liquid absorbed by the first liquid absorber to the second liquid absorber, the liquid leading member integrally formed with the first liquid absorber.

23. The waste liquid treating device as set forth in claim 22, wherein the first liquid absorber and the liquid leading member are comprised of a porous soft material.

24. The waste liquid treating device as set forth in claim 22, wherein the second liquid absorber has a liquid absorbance higher than a liquid absorbance of the first liquid absorber and the liquid leading member.

25. The waste liquid treating device as set forth in claim 22, wherein:

a first part of an inner face of the groove hole and a second part of an inner face of the through hole are made flush with each other; and the liquid leading member extends along the first part and the second part.

26. The waste liquid treating device as set forth in claim 25, wherein:

at least one more through hole is arranged with the through hole in a direction along which the liquid ejecting head is operable to move; and the liquid leading member is provided in each of the through holes.

27. The waste liquid treating device as set forth in claim 22, wherein the liquid leading member is deformably connected to the first liquid absorber.

28. A liquid ejecting apparatus, comprising the waste liquid treating device as set forth in claim 16 or 22, wherein the platen is arranged so as to define a gap between the liquid ejecting head and the object.

* * * * *